US008388803B2

(12) United States Patent
Super et al.

(10) Patent No.: US 8,388,803 B2
(45) **Date of Patent: *Mar. 5, 2013**

(54) METHOD OF MAKING A FABRIC-CREPED ABSORBENT CELLULOSIC SHEET

(75) Inventors: Guy H. Super, Menasha, WI (US); Steven L. Edwards, Fremont, WI (US); Stephen J. McCullough, Mount Calvary, WI (US); Frank C. Murray, Marietta, GA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/397,745

(22) Filed: Feb. 16, 2012

(65) Prior Publication Data

US 2012/0180965 A1 Jul. 19, 2012

Related U.S. Application Data

(60) Continuation of application No. 12/804,210, filed on Jul. 16, 2010, now Pat. No. 8,152,958, which is a division of application No. 11/108,375, filed on Apr. 18, 2005, now Pat. No. 7,789,995, which is a continuation-in-part of application No. 10/679,862, filed on Oct. 6, 2003, now Pat. No. 7,399,378.

(60) Provisional application No. 60/416,666, filed on Oct. 7, 2002.

(51) Int. Cl.
*B31F 1/16* (2006.01)
*B31F 1/07* (2006.01)

(52) U.S. Cl. ..... 162/111; 162/117; 162/123; 156/183; 264/282

(58) Field of Classification Search ..... 162/109, 162/111–113, 115–117, 123–133, 193, 197, 162/204–207; 156/183; 264/282–283; 226/7, 226/91, 97.3; 34/114, 117, 122, 359, 444
See application file for complete search history.

(56) References Cited

U.S. PATENT DOCUMENTS

| | | | |
|---|---|---|---|
| 3,432,936 | A | 3/1969 | Cole et al. |
| 3,545,705 | A | 12/1970 | Hodgson |
| 3,549,742 | A | 12/1970 | Benz |
| 3,556,932 | A | 1/1971 | Coscia et al. |
| 3,556,933 | A | 1/1971 | Williams et al. |

(Continued)

FOREIGN PATENT DOCUMENTS

| | | |
|---|---|---|
| CA | 2053505 | 4/1992 |
| JP | 8-3890 A | 1/1996 |

(Continued)

OTHER PUBLICATIONS

Espy, Herbert H., "Chapter 2: Alkaline-Curing Polymeric Amine-Epichlorohydrin Resins," in Wet Strength Resins and Their Application, L. Chan, Editor, 1994.

(Continued)

*Primary Examiner* — José A Fortuna
(74) *Attorney, Agent, or Firm* — Laura L. Bozek

(57) ABSTRACT

A method of making a fabric-creped absorbent cellulosic sheet includes compactively dewatering a papermaking furnish to form a nascent web having a random distribution of papermaking fiber, applying the nascent web to a translating transfer surface that is moving at a transfer surface speed, fabric-creping the nascent web from the transfer surface at a consistency of from about 30 to about 60 percent utilizing a patterned creping fabric that is traveling at a fabric-creping speed that is slower than the transfer surface speed, the fabric-creping step occurring under pressure in a fabric creping nip defined between the transfer surface and the creping fabric, such that the nascent web is creped from the transfer surface and redistributed on the creping fabric to form a creped web with a drawable reticulum having a plurality of interconnected regions of different local basis weights.

48 Claims, 29 Drawing Sheets

U.S. PATENT DOCUMENTS

| | | | |
|---|---|---|---|
| 3,700,623 | A | 10/1972 | Keim |
| 3,772,076 | A | 11/1973 | Keim |
| 3,858,623 | A | 1/1975 | Lefkowitz |
| 3,926,716 | A | 12/1975 | Bates |
| 3,974,025 | A | 8/1976 | Ayers |
| 3,994,771 | A | 11/1976 | Morgan, Jr. et al. |
| 4,041,989 | A | 8/1977 | Johansson et al. |
| 4,071,050 | A | 1/1978 | Codorniu |
| 4,102,737 | A | 7/1978 | Morton |
| 4,112,982 | A | 9/1978 | Bugge et al. |
| 4,149,571 | A | 4/1979 | Burroughs |
| 4,157,276 | A | 6/1979 | Wandel et al. |
| 4,161,195 | A | 7/1979 | Khan |
| 4,182,381 | A | 1/1980 | Gisbourne |
| 4,184,519 | A | 1/1980 | McDonald et al. |
| 4,225,382 | A | 9/1980 | Kearney et al. |
| 4,239,065 | A | 12/1980 | Trokhan |
| 4,314,589 | A | 2/1982 | Buchanan et al. |
| 4,356,059 | A | 10/1982 | Hostetler |
| 4,359,069 | A | 11/1982 | Hahn |
| 4,376,455 | A | 3/1983 | Hahn |
| 4,379,735 | A | 4/1983 | MacBean |
| 4,420,372 | A | 12/1983 | Hostetler |
| 4,440,597 | A | 4/1984 | Wells et al. |
| 4,445,638 | A | 5/1984 | Connell et al. |
| 4,448,638 | A | 5/1984 | Klowak |
| 4,453,573 | A | 6/1984 | Thompson |
| 4,482,429 | A | 11/1984 | Klowak |
| 4,490,925 | A | 1/1985 | Smith |
| 4,529,480 | A | 7/1985 | Trokhan |
| 4,533,437 | A | 8/1985 | Curran et al. |
| 4,543,156 | A | 9/1985 | Cheshire et al. |
| 4,551,199 | A | 11/1985 | Weldon |
| 4,552,709 | A | 11/1985 | Koger, II et al. |
| 4,556,450 | A | 12/1985 | Chuang et al. |
| 4,564,052 | A | 1/1986 | Borel |
| 4,592,395 | A | 6/1986 | Borel |
| 4,603,176 | A | 7/1986 | Bjorkquist et al. |
| 4,605,585 | A | 8/1986 | Johansson |
| 4,605,702 | A | 8/1986 | Guerro et al. |
| 4,611,639 | A | 9/1986 | Bugge |
| 4,614,679 | A | 9/1986 | Farrington, Jr. et al. |
| 4,637,859 | A | 1/1987 | Trokhan |
| 4,640,741 | A | 2/1987 | Tsuneo |
| 4,675,394 | A | 6/1987 | Solarek et al. |
| 4,689,119 | A | 8/1987 | Weldon |
| 4,709,732 | A | 12/1987 | Kinnunen |
| 4,720,383 | A | 1/1988 | Drach et al. |
| 4,759,391 | A | 7/1988 | Waldvogel et al. |
| 4,759,976 | A | 7/1988 | Dutt |
| 4,795,530 | A | 1/1989 | Soerens et al. |
| 4,804,769 | A | 2/1989 | Solarek et al. |
| 4,834,838 | A | 5/1989 | Klowak |
| 4,849,054 | A | 7/1989 | Klowak |
| 4,866,151 | A | 9/1989 | Tsai et al. |
| 4,942,077 | A | 7/1990 | Wendt et al. |
| 4,967,085 | A | 10/1990 | Bryan et al. |
| 4,973,512 | A | 11/1990 | Stanley et al. |
| 4,981,557 | A | 1/1991 | Bjorkquist |
| 4,983,748 | A | 1/1991 | Tsai et al. |
| 4,998,568 | A | 3/1991 | Vohringer |
| 5,008,344 | A | 4/1991 | Bjorkquist |
| 5,016,678 | A | 5/1991 | Borel et al. |
| 5,023,132 | A | 6/1991 | Stanley et al. |
| 5,054,525 | A | 10/1991 | Vohringer |
| 5,066,532 | A | 11/1991 | Gaisser |
| 5,085,736 | A | 2/1992 | Bjorkquist |
| 5,087,324 | A | 2/1992 | Awofeso et al. |
| 5,098,519 | A | 3/1992 | Ramasubramanian et al. |
| 5,103,874 | A | 4/1992 | Lee |
| 5,114,777 | A | 5/1992 | Gaisser |
| 5,129,988 | A | 7/1992 | Farrington, Jr. |
| 5,138,002 | A | 8/1992 | Bjorkquist |
| 5,167,261 | A | 12/1992 | Lee |
| 5,182,164 | A | 1/1993 | Eklund et al. |
| 5,199,261 | A | 4/1993 | Baker |
| 5,199,467 | A | 4/1993 | Lee |
| 5,211,815 | A | 5/1993 | Ramasubramanian et al. |
| 5,217,576 | A | 6/1993 | Van Phan |
| 5,219,004 | A | 6/1993 | Chiu |
| 5,223,096 | A | 6/1993 | Phan et al. |
| 5,225,269 | A | 7/1993 | Bohlin |
| 5,240,562 | A | 8/1993 | Phan et al. |
| 5,245,025 | A | 9/1993 | Trokhan et al. |
| 5,262,007 | A | 11/1993 | Phan et al. |
| 5,264,082 | A | 11/1993 | Phan et al. |
| 5,277,761 | A | 1/1994 | Van Phan et al. |
| 5,312,522 | A | 5/1994 | Van Phan et al. |
| 5,314,584 | A | 5/1994 | Grinnell et al. |
| 5,328,565 | A | 7/1994 | Rasch et al. |
| 5,336,373 | A | 8/1994 | Scattolino et al. |
| 5,348,620 | A | 9/1994 | Hermans et al. |
| 5,366,785 | A | 11/1994 | Sawdai |
| 5,368,696 | A | 11/1994 | Cunnane, III et al. |
| 5,372,876 | A | 12/1994 | Johnson et al. |
| 5,379,808 | A | 1/1995 | Chiu |
| 5,411,636 | A | 5/1995 | Hermans et al. |
| 5,415,737 | A | 5/1995 | Phan et al. |
| 5,449,026 | A | 9/1995 | Lee |
| 5,492,598 | A | 2/1996 | Hermans et al. |
| 5,494,554 | A | 2/1996 | Edwards et al. |
| 5,501,768 | A | 3/1996 | Hermans et al. |
| 5,503,715 | A | 4/1996 | Trokhan et al. |
| 5,505,818 | A | 4/1996 | Hermans et al. |
| 5,508,818 | A | 4/1996 | Hamma |
| 5,510,001 | A | 4/1996 | Hermans et al. |
| 5,510,002 | A | 4/1996 | Hermans et al. |
| 5,549,790 | A | 8/1996 | Van Phan |
| 5,556,509 | A | 9/1996 | Trokhan et al. |
| 5,601,871 | A | 2/1997 | Krzysik et al. |
| 5,607,551 | A | 3/1997 | Farrington, Jr. et al. |
| 5,609,725 | A | 3/1997 | Van Phan |
| 5,614,293 | A | 3/1997 | Krzysik et al. |
| 5,618,612 | A | 4/1997 | Gstrein |
| H001672 | H | 8/1997 | Hermans et al. |
| 5,656,132 | A | 8/1997 | Farrington, Jr. et al. |
| 5,657,797 | A | 8/1997 | Townley et al. |
| 5,667,636 | A | 9/1997 | Engel et al. |
| 5,672,248 | A | 9/1997 | Wendt et al. |
| 5,674,590 | A | 10/1997 | Anderson et al. |
| 5,690,149 | A | 11/1997 | Lee |
| 5,690,788 | A | 11/1997 | Marinack et al. |
| 5,695,607 | A | 12/1997 | Oriaran et al. |
| 5,725,734 | A | 3/1998 | Herman et al. |
| 5,730,839 | A | 3/1998 | Wendt et al. |
| 5,746,887 | A | 5/1998 | Wendt et al. |
| 5,772,845 | A | 6/1998 | Farrington, Jr. et al. |
| 5,814,190 | A | 9/1998 | Van Phan |
| 5,830,321 | A | 11/1998 | Lindsay et al. |
| 5,840,403 | A | 11/1998 | Trokhan et al. |
| 5,840,404 | A | 11/1998 | Graff |
| 5,851,353 | A | 12/1998 | Fiscus et al. |
| 5,865,955 | A | 2/1999 | Ilvespaa et al. |
| 5,888,347 | A | 3/1999 | Engel et al. |
| 5,932,068 | A | 8/1999 | Farrington, Jr. et al. |
| 5,935,381 | A | 8/1999 | Trokhan et al. |
| 5,968,590 | A | 10/1999 | Ahonen et al. |
| 6,001,421 | A | 12/1999 | Ahonen et al. |
| 6,017,417 | A | 1/2000 | Wendt et al. |
| 6,027,611 | A | 2/2000 | McFarland et al. |
| 6,080,279 | A | 6/2000 | Hada et al. |
| 6,083,346 | A | 7/2000 | Hermans et al. |
| 6,093,284 | A | 7/2000 | Hada et al. |
| 6,096,169 | A | 8/2000 | Hermans et al. |
| 6,117,525 | A | 9/2000 | Trokhan et al. |
| 6,119,362 | A | 9/2000 | Sundqvist |
| 6,136,146 | A | 10/2000 | Phan et al. |
| 6,139,686 | A | 10/2000 | Trokhan et al. |
| 6,143,135 | A | 11/2000 | Hada et al. |
| 6,149,767 | A | 11/2000 | Hermans et al. |
| 6,149,769 | A | 11/2000 | Mohammadi et al. |
| 6,162,327 | A | 12/2000 | Batra et al. |
| 6,171,442 | B1 | 1/2001 | Farrington, Jr. et al. |
| 6,187,137 | B1 | 2/2001 | Druecke et al. |
| 6,197,154 | B1 | 3/2001 | Chen et al. |
| 6,210,528 | B1 | 4/2001 | Wolkowicz |
| 6,228,220 | B1 | 5/2001 | Hada et al. |

| | | | | |
|---|---|---|---|---|
| 6,280,573 | B1 | 8/2001 | Lindsay et al. | |
| 6,287,426 | B1 | 9/2001 | Edwards et al. | |
| 6,306,257 | B1 | 10/2001 | Hada et al. | |
| 6,306,258 | B1 | 10/2001 | Lange et al. | |
| 6,318,727 | B1 | 11/2001 | Hada | |
| 6,331,230 | B1 | 12/2001 | Hermans et al. | |
| 6,350,349 | B1 | 2/2002 | Hermans et al. | |
| 6,420,013 | B1 | 7/2002 | Vinson et al. | |
| 6,432,267 | B1 | 8/2002 | Watson | |
| 6,436,234 | B1 | 8/2002 | Chen et al. | |
| 6,447,640 | B1 | 9/2002 | Watson et al. | |
| 6,447,641 | B1 | 9/2002 | Wolkowicz et al. | |
| 6,454,904 | B1 | 9/2002 | Hermans et al. | |
| 6,461,474 | B1 | 10/2002 | Lindsay et al. | |
| 6,464,829 | B1 | 10/2002 | Chen et al. | |
| 6,478,927 | B1 | 11/2002 | Chen et al. | |
| 6,497,789 | B1 | 12/2002 | Hermans et al. | |
| 6,534,151 | B2 | 3/2003 | Merker | |
| 6,540,879 | B2 | 4/2003 | Marinack et al. | |
| 6,547,924 | B2 | 4/2003 | Klerelid et al. | |
| 6,551,461 | B2 | 4/2003 | Hermans et al. | |
| 6,565,707 | B2 | 5/2003 | Behnke et al. | |
| 6,579,418 | B2 | 6/2003 | Lindsay et al. | |
| 6,585,855 | B2 | 7/2003 | Drew et al. | |
| 6,607,638 | B2 | 8/2003 | Drew et al. | |
| 6,610,173 | B1 | 8/2003 | Lindsay et al. | |
| 6,698,681 | B1 | 3/2004 | Guy et al. | |
| 6,709,548 | B2 | 3/2004 | Marinack et al. | |
| 6,749,723 | B2 | 6/2004 | Linden | |
| 6,827,819 | B2 | 12/2004 | Dwiggins et al. | |
| 6,998,022 | B2 | 2/2006 | Hultcrantz | |
| 7,070,678 | B2 | 7/2006 | Allen et al. | |
| 7,070,679 | B2 | 7/2006 | Cason et al. | |
| 7,300,543 | B2 | 11/2007 | Mullally et al. | |
| 7,399,378 | B2 | 7/2008 | Edwards et al. | |
| 7,416,637 | B2 | 8/2008 | Murray et al. | |
| 7,442,278 | B2 | 10/2008 | Murray et al. | |
| 7,494,563 | B2 | 2/2009 | Edwards et al. | |
| 7,503,998 | B2 | 3/2009 | Murray et al. | |
| 7,563,344 | B2 | 7/2009 | Beuther et al. | |
| 7,585,388 | B2 | 9/2009 | Yeh et al. | |
| 7,585,389 | B2 | 9/2009 | Yeh et al. | |
| 7,585,392 | B2 | 9/2009 | Kokko et al. | |
| 7,588,660 | B2 | 9/2009 | Edwards et al. | |
| 7,588,661 | B2 | 9/2009 | Edwards et al. | |
| 7,591,925 | B2 | 9/2009 | Scherb et al. | |
| 7,608,164 | B2 | 10/2009 | Chou et al. | |
| 7,651,589 | B2 | 1/2010 | Murray et al. | |
| 7,662,255 | B2 | 2/2010 | Murray et al. | |
| 7,662,257 | B2 | 2/2010 | Edwards et al. | |
| 7,670,457 | B2 | 3/2010 | Murray et al. | |
| 7,691,228 | B2 | 4/2010 | Edwards et al. | |
| 7,704,349 | B2 | 4/2010 | Edwards et al. | |
| 7,718,036 | B2 | 5/2010 | Sumnicht et al. | |
| 7,726,349 | B2 | 6/2010 | Mullally et al. | |
| 7,789,995 | B2 | 9/2010 | Super et al. | |
| 7,820,008 | B2 | 10/2010 | Edwards et al. | |
| 7,828,931 | B2 | 11/2010 | Edwards et al. | |
| 7,850,823 | B2 | 12/2010 | Chou et al. | |
| 7,918,964 | B2 | 4/2011 | Edwards et al. | |
| 7,935,220 | B2 * | 5/2011 | Edwards et al. | 162/109 |
| 7,951,264 | B2 | 5/2011 | Sumnicht | |
| 7,951,266 | B2 | 5/2011 | Kokko et al. | |
| 7,985,321 | B2 | 7/2011 | Sumnicht et al. | |
| 7,988,829 | B2 | 8/2011 | Klerelid et al. | |
| 8,066,849 | B2 | 11/2011 | Kokko et al. | |
| 8,105,463 | B2 | 1/2012 | Goulet et al. | |
| 2002/0062936 | A1 | 5/2002 | Klerelid et al. | |
| 2002/0088577 | A1 | 7/2002 | Watson et al. | |
| 2002/0134520 | A1 | 9/2002 | Behnke et al. | |
| 2002/0189773 | A1 | 12/2002 | Marinack et al. | |
| 2003/0000664 | A1 | 1/2003 | Drew et al. | |
| 2003/0098134 | A1 | 5/2003 | Scherb et al. | |
| 2003/0102098 | A1 | 6/2003 | Allen et al. | |
| 2003/0111195 | A1 | 6/2003 | Hu | |
| 2003/0121626 | A1 | 7/2003 | Hutlzcrantz | |
| 2003/0131959 | A1 | 7/2003 | Marinack et al. | |
| 2004/0238135 | A1 | 12/2004 | Edwards et al. | |
| 2005/0217814 | A1 | 10/2005 | Super et al. | |
| 2005/0236122 | A1 | 10/2005 | Mullally et al. | |
| 2005/0241786 | A1 | 11/2005 | Edwards et al. | |
| 2005/0241787 | A1 | 11/2005 | Murray et al. | |
| 2005/0279471 | A1 | 12/2005 | Murray et al. | |
| 2006/0000567 | A1 | 1/2006 | Murray et al. | |
| 2006/0237154 | A1 | 10/2006 | Edwards et al. | |
| 2006/0289133 | A1 | 12/2006 | Yeh et al. | |
| 2006/0289134 | A1 | 12/2006 | Yeh et al. | |
| 2007/0062656 | A1 | 3/2007 | Murray et al. | |
| 2007/0107863 | A1 | 5/2007 | Edwards et al. | |
| 2007/0137807 | A1 | 6/2007 | Schulz et al. | |
| 2007/0204966 | A1 | 9/2007 | Chou et al. | |
| 2008/0008860 | A1 | 1/2008 | Murray et al. | |
| 2008/0029235 | A1 | 2/2008 | Edwards et al. | |
| 2008/0035288 | A1 | 2/2008 | Mullally et al. | |
| 2008/0047675 | A1 | 2/2008 | Murray et al. | |
| 2008/0083519 | A1 | 4/2008 | Kokko et al. | |
| 2008/0099169 | A1 | 5/2008 | Beuther et al. | |
| 2008/0173419 | A1 | 7/2008 | Sumnicht | |
| 2008/0208831 | A1 | 8/2008 | Farago et al. | |
| 2008/0236772 | A1 | 10/2008 | Edwards et al. | |
| 2008/0245492 | A1 | 10/2008 | Edwards et al. | |
| 2008/0264589 | A1 | 10/2008 | Chou et al. | |
| 2009/0020139 | A1 | 1/2009 | Sumnicht et al. | |
| 2009/0020248 | A1 | 1/2009 | Sumnicht et al. | |
| 2009/0038768 | A1 | 2/2009 | Murray et al. | |
| 2009/0120598 | A1 | 5/2009 | Edwards et al. | |
| 2009/0126884 | A1 | 5/2009 | Murray et al. | |
| 2009/0159223 | A1 | 6/2009 | Edwards et al. | |
| 2009/0294079 | A1 | 12/2009 | Edwards et al. | |
| 2009/0301675 | A1 | 12/2009 | Edwards et al. | |
| 2009/0308551 | A1 | 12/2009 | Kokko et al. | |
| 2010/0006249 | A1 | 1/2010 | Kokko et al. | |
| 2010/0170647 | A1 | 7/2010 | Edwards et al. | |
| 2010/0186913 | A1 | 7/2010 | Super et al. | |
| 2010/0236735 | A1 | 9/2010 | Goulet et al. | |
| 2010/0282423 | A1 | 11/2010 | Super et al. | |
| 2010/0326616 | A1 | 12/2010 | Klerelid et al. | |
| 2011/0011545 | A1 * | 1/2011 | Edwards et al. | 162/111 |
| 2011/0265965 | A1 | 11/2011 | Sumnicht et al. | |

FOREIGN PATENT DOCUMENTS

| | | | |
|---|---|---|---|
| SU | 1771983 | A1 | 10/1992 |
| WO | 97/43484 | A1 | 11/1997 |
| WO | 00/14330 | A1 | 3/2000 |
| WO | 2004/033793 | A2 | 4/2004 |
| WO | 2005/103375 | A1 | 11/2005 |
| WO | 2005/106117 | A1 | 11/2005 |
| WO | 2006/113025 | A2 | 10/2006 |
| WO | 2007/001837 | A2 | 1/2007 |
| WO | 2007/109259 | A2 | 9/2007 |
| WO | 2007/139726 | A1 | 12/2007 |
| WO | 2008/002420 | A2 | 1/2008 |
| WO | 2008/045770 | A2 | 4/2008 |

OTHER PUBLICATIONS

Westfelt, Lars, "Chemistry of Paper Wet-Strength. I. A Survey of Mechanisms of Wet Strength Development," in Cellulose Chemistry and Technology, V. 13, pp. 813-825, 1979.

Evans, W. P., "Cationic fabric softeners," Chemistry and Industry, Jul. 5, 1969, pp. 893-903.

Egan, R. R., "Cationic Surface Active Agents as Fabric Softeners," J. Am. Oil Chemist's Soc., V. 55 (1978), pp. 118-121.

Trivedi, B. C., et al., "Quaternization of Imidazoline: Unequivocal Structure Proof," J. Am. Oil Chemist's Soc., Jun. 1981, pp. 754-756.

Parker, J. D., "Chapter 2 Practical Applications," in the Sheet Forming Process, STAP No. 9, 1972, pp. 63-93.

European Search Report issued in counterpart European patent application No. EP 06 73 9068 in a Communication mailed Jun. 4, 2010.

* cited by examiner

FABRIC CREPED

FABRIC CREPED AND DRAWN

CAN DRIED FABRIC CREPE PRODUCT

FABRIC COMPARISONS

METHOD OF MAKING A FABRIC-CREPED ABSORBENT CELLULOSIC SHEET

CLAIM FOR PRIORITY AND TECHNICAL FIELD

This application is a continuation application of U.S. patent application No. 12/804,210, filed on Jul. 16, 2010, now U.S. Pat. No. 8,152,958, which is a divisional of U.S. patent application No. 11/108,375 filed Apr. 18, 2005, entitled "Fabric Crepe/Draw Process for Producing Absorbent Sheet", now U.S. Pat. No. 7,789,995. U.S. patent application No. 11/108,375 is a continuation-in-part of U.S. patent application No. 10/679,862 entitled "Fabric Crepe Process for Making Absorbent Sheet", filed on Oct. 6, 2003, now U.S. Pat. No. 7,399,378. Further, this application claims the benefit of the filing date of U.S. Provisional Patent Application No. 60/416,666, filed Oct. 7, 2002. This application is directed, in part, to a process wherein a web is compactively dewatered, creped into a creping fabric and drawn to expand the dried web. The priorities of U.S. patent application No. 11/108,375, U.S. patent application No. 10/679,862 and U.S. Provisional Patent Application No. 60/416,666 are hereby claimed and their disclosures are incorporated herein in their entireties.

BACKGROUND

Methods of making paper tissue, towel, and the like, are well known, including various features such as Yankee drying, throughdrying, fabric creping, dry creping, wet creping, and so forth. Conventional wet pressing processes have certain advantages over conventional through-air drying (TAD) processes including: (1) lower energy costs associated with the mechanical removal of water rather than transpiration drying with hot air, and (2) higher production speeds, which are more readily achieved with processes that utilize wet pressing to form a web. On the other hand, through-air drying processing has been widely adopted from new capital investment, particularly, for the production of soft, bulky, premium quality tissue and towel products.

Fabric creping has been employed in connection with papermaking processes that include mechanical or compactive dewatering of the paper web as a means to influence product properties. See U.S. Pat. Nos. 4,689,119 and 4,551,199 to Weldon; U.S. Pat. Nos. 4,849,054 and 4,834,838 to Klowak; and U.S. Pat. No. 6,287,426 to Edwards et al. Operation of fabric creping processes has been hampered by the difficulty of effectively transferring a web of high or intermediate consistency to a dryer. Note also U.S. Pat. No. 6,350,349 to Hermans et al., which discloses wet transfer of a web from a rotating transfer surface to a fabric. Further United States Patents relating to fabric creping more generally include the following: U.S. Pat. Nos. 4,834,838; 4,482,429 and 4,445,638, as well as U.S. Pat. No. 4,440,597 to Wells et al.

In connection with papermaking processes, fabric molding has also been employed as a means to provide texture and bulk. In this respect, there is seen in U.S. Pat. No. 6,610,173 to Lindsey et al. a method of imprinting a paper web during a wet pressing event which results in asymmetrical protrusions corresponding to the deflection conduits of a deflection member. The '173 patent reports that a differential velocity transfer during a pressing event serves to improve the molding and imprinting of a web with a deflection member. The tissue webs produced are reported as having particular sets of physical and geometrical properties, such as a pattern densified network and a repeating pattern of protrusions having asymmetrical structures. With respect to wet-molding of a web using textured fabrics, see, also, the following United States Patents: U.S. Pat. Nos. 6,017,417 and 5,672,248 both to Wendt et al.; U.S. Pat. Nos. 5,508,818 and 5,510,002 to Hermans et al. and U.S. Pat. No. 4,637,859 to Trokhan. With respect to the use of fabrics used to impart texture to a mostly dry sheet, see U.S. Pat. No. 6,585,855 to Drew et al., as well as United States Patent Application Publication No. 2003/0000664, now U.S. Pat. No. 6,607,638.

Throughdried, creped products are disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer. A relatively permeable web is typically required, making it difficult to employ recycle furnish at levels which may be desired. Transfer to the Yankee typically takes place at web consistencies of from about 60% to about 70%. See also, U.S. Pat. No. 6,187,137 to Druecke et al. As to the application of a vacuum while the web is in a fabric, the following are noted: U.S. Pat. No. 5,411,636 to Hermans et al.; U.S. Pat. No. 5,492,598 to Hermans et al.; U.S. Pat. No. 5,505,818 to Hermans et al.; U.S. Pat. No. 5,510,001 to Hermans et al.; and U.S. Pat. No. 5,510,002 to Hermans et al.

As noted in the above, throughdried products tend to exhibit enhanced bulk and softness. Thermal dewatering with hot air, however, tends to be energy intensive. Wet-press operations wherein the webs are mechanically dewatered are preferable from an energy perspective and are more readily applied to furnishes containing recycle fiber, which tends to form webs with less permeability than virgin fiber. Many improvements relate to increasing the bulk and absorbency of compactively dewatered products, which are typically dewatered, in part, with a papermaking felt.

SUMMARY OF THE INVENTION

Fabric-creped products of the present invention typically include fiber-enriched regions of relatively elevated basis weight linked together with regions of lower basis weight. Especially preferred products have a drawable reticulum which is capable of expanding, that is, increasing in void volume and bulk when drawn to a greater length. This highly unusual and surprising property is further appreciated by considering the photomicrographs of FIGS. 1 and 2, as well as the data discussed in the Detailed Description section hereafter.

A photomicrograph of the fiber-enriched region of an undrawn, fabric-creped web is shown in FIG. 1, which is in section along the MD (left to right in the photo). It is seen that the web has microfolds transverse to the machine direction, i.e., the ridges or creases extend in the CD (into the photograph). FIG. 2 is a photomicrograph of a web similar to that shown in FIG. 1, wherein the web has been drawn 45%. Here, it is seen that the microfolds have been expanded, dispersing fiber from the fiber-enriched regions along the machine direction. Without intending to be bound by any theory, it is believed that this feature of the invention, rearrangement or unfolding of the material in the fiber-enriched regions gives rise to the unique macroscopic properties exhibited by the material.

In accordance with one aspect, the present invention provides a method of making a fabric-creped absorbent cellulosic sheet including the steps of (a) compactively dewatering a paper making furnish to form a nascent web having an apparently random distribution of paper making fiber, (b) applying the dewatered web having the apparently random distribution to a translating transfer surface moving at a first speed, and (c) fabric-creping the web from the transfer surface at a consistency of from about 30 to about 60 percent utilizing a patterned creping fabric, the creping step occurring under pressure in the fabric-creping nip defined between the transfer surface and the creping fabric, wherein the fabric is traveling at a second speed slower than the speed of the transfer surface, the fabric pattern, nip parameters, velocity delta and web consistency being selected such that the web is creped from the transfer surface and redistributed on the creping fabric to form a web with a drawable reticulum having a plurality of regions of different local basis weights including at least (i) a plurality of fiber enriched regions of high local basis weight, interconnected by way of (ii) a plurality of lower local basis weight linking regions. The drawable reticulum of the web is characterized in that it comprises a cohesive fiber matrix capable of increasing in void volume when dried and subsequently drawn. Drawing the web increases the bulk of the web, decreases the sidedness of the web, and attenuates the fiber enriched regions of the web.

The method of making absorbent sheet according to the invention typically results with a non-random distribution of fibers in the web, wherein the orientation of fibers in the fiber enriched regions are biased in the CD. It is apparent from the photomicrographs appended hereto, that orientation in the CD is strongest adjacent to the fabric knuckle. The web is typically characterized in that the fiber enriched regions have a plurality of micro-folds with fold lines or creases transverse to the machine direction. Drawing the web in the machine direction expands the microfolds.

The inventive process is generally operated at a fabric crepe of from about 10 to about 100 percent, such as operated at a fabric crepe of at least about 40 percent. A fabric crepe of at least about 60 or 80 is preferred in some cases; however, the process may be operated at a fabric crepe of 100 percent or more, perhaps even in excess of 125 percent, in some cases.

In another aspect, the invention provides a method of making a fabric-creped absorbent cellulosic sheet including the steps of (a) compactively dewatering a papermaking furnish to form a nascent web having an apparently random distribution of papermaking fiber (b) applying the dewatered web having the apparently random fiber distribution to a translating transfer surface moving at a first speed (c) fabric-creping the web from the transfer surface at a consistency of from about 30 to about 60 percent utilizing a patterned creping fabric, the creping step occurring under pressure in a fabric creping nip defined between the transfer surface and the creping fabric, wherein the fabric is traveling at a second speed slower than the speed of the transfer surface. The fabric pattern, nip parameters, velocity delta and web consistency are selected such that the web is creped from the transfer surface and redistributed on the creping fabric to form a web with a drawable reticulum having a plurality of interconnected regions of different local basis weight including at least (i) a plurality of fiber enriched regions of high local basis weight, interconnected by way of (ii) a plurality of lower local basis weight linking regions. The drawable reticulum of the web is characterized in that it comprises a cohesive fiber matrix capable of increasing void volume upon dry-drawing. The process further includes (d) applying the web to a drying cylinder, (e) drying the web on the drying cylinder, (f) removing the web from the drying cylinder, wherein steps (d), (e) and (f) are performed so as to substantially preserve the drawable fiber reticulum, and (g) drawing the dried web. Preferably, the drying cylinder is a Yankee dryer provided with a drying hood as is well known in the art. The web may be removed from the Yankee dryer without substantial creping. While a creping blade may or may not be used, it may be desirable in some cases to use a blade, such as a non-metallic blade, to gently assist or to initiate removal of the web from the Yankee dryer.

In general, the inventive process is operated at a fabric crepe of from about 10 to about 100 percent, or even 200 or 300 percent, fabric crepe and a crepe recovery of from about 10 to about 100 percent. As will be appreciated from the description that follows, crepe recovery is a measure of the amount of crepe that has been imparted to the web that has been subsequently pulled out. The process is operated at a crepe recovery of at least about 20 percent in preferred embodiments, such as operated at a crepe recovery of at least about 30 percent, 40 percent, 50 percent, 60 percent, 80 percent, or 100 percent.

Any suitable paper making furnish may be employed to make the cellulosic sheet according to the present invention. The process is particularly adaptable for use with secondary fiber since the process is tolerant to fines. Most preferably, the web is calendered and drawn on line.

While any suitable method may be used to draw the web, it is particularly preferred to draw the web between a first roll operated at a machine direction velocity greater than the creping fabric velocity and a second roll operated at a machine direction velocity greater than the first roll.

In preferred embodiments, the fabric creped absorbent cellulosic sheet is dried to a consistency of at least about 90, or even more preferably, at least 92 percent prior to drawing. Typically, the web is dried to about 98% consistency when dried in-fabric.

Generally speaking, the processing parameters and fabric creping are controlled such that the ratio of percent decrease in caliper/percent decrease in basis weight of web is less than about 0.85 upon drawing the web. A value of less than about 0.7 or even 0.6 is more preferred.

In another aspect, the present invention provides a method of making a fabric-creped absorbent cellulosic sheet including the steps of (a) compactively dewatering a papermaking furnish to form a nascent web having an apparently random distribution of papermaking fibers, (b) applying the dewatered web having the apparently random fiber distribution to a translating surface moving at a first speed, and (c) fabric-creping the web from the transfer surface at a consistency of from about 30 to about 60 percent utilizing a pattern creping fabric. The creping step occurs under pressure in a fabric-creping nip defined between the transfer surface and the creping fabric, wherein the fabric is traveling at a second speed slower than the speed of the transfer surface. The fabric pattern, nip parameters, and velocity delta and web consistency are selected such that the web is creped from the transfer surface and redistributed on the creping fabric to form a web with a drawable reticulum having a plurality of interconnected regions of different local basis weights including at least: (i) a plurality of fiber enriched regions of high local basis weight, interconnected by way of (ii) a plurality of lower local basis weight linking regions. The drawable reticulum of the web is characterized in that it comprises a cohesive fiber matrix capable of an increase in void volume upon dry-drawing. The process further includes the steps of (d) applying the web to a drying cylinder, (e) drying the web on the drying cylinder, (f) peeling the web from the drying cylinder, and (g) controlling the takeaway angle from the drying cylinder, wherein steps (d), (e), (f) and (g) are performed so as to substantially preserve the drawable fiber reticulum. The dried web is then drawn to final length.

The step of controlling the take away angle from the drying cylinder is carried out utilizing a sheet control cylinder in preferred embodiments. The sheet control cylinder is disposed adjacent to the drying cylinder such that the gap between the surface of the drying cylinder and the surface of the sheet control cylinder is less than about twice the thickness of the web. In preferred cases, the sheet control cylinder is disposed such that the gap between the surface of the drying cylinder and the surface of the sheet control cylinder is about the thickness of the web or less. Preferably, the web is calendered and drawn on line after being peeled from the drying cylinder.

The web is drawn by any suitable amount, depending on the desired properties. Generally, the web is drawn by at least about 10 percent, usually, by at least about 15 percent, suitably, by at least about 30 percent. The web may be drawn by at least about 45 percent or 75 percent or more depending upon the amount of fabric crepe previously applied.

Any suitable method may be used in order to draw the web. One preferred method is to draw the web between a first draw roll operated at a first machine direction velocity, which is desirably slightly greater than the creping fabric velocity, and a second draw roll operated at a machine direction velocity substantially greater than the velocity of the first draw roll. When using this apparatus, the web advantageously wraps the first draw roll over an angle sufficient to control slip, ideally, more than 180 E of its circumference. Likewise, the web wraps over the second draw roll at another angle sufficient to control slip, ideally, more than 180 E of its circumference, as well. In preferred cases, the web wraps each of the first and second draw rolls over from about 200 E to about 300 E of their respective circumferences. It is also preferred that the first and second draw rolls are movable with respect to each other, such that they are going to be disposed in a first position for threading and a second position for operation, one side of the web contacting the first draw roll and the other side of the web contacting the second draw roll.

In still a further aspect, the present invention provides a method of making a fabric-creped absorbent cellulosic sheet including the steps of (a) compactively dewatering a papermaking furnish to form a nascent web having an apparently random distribution of papermaking fiber, (b) applying the dewatered web having the apparently random fiber distribution to a transfer surface moving at a first speed, and (c) fabric-creping the web from the transfer surface at a consistency of from about 30 to about 60 percent utilizing a pattern creping fabric. The creping step is carried out under pressure in a fabric-creping nip defined between the transfer surface and the creping fabric, wherein the fabric is traveling at the second speed slower than the speed of the transfer surface. The fabric pattern, nip parameters, velocity delta, and web consistency are selected such that the web is creped from the transfer surface and redistributed on the creping fabric to form a web with a drawable reticulum having a plurality of interconnected regions of different local basis weight including at least (i) a plurality of fiber enriched regions of high local basis weight, interconnected by way of (ii) a plurality of lower local basis weight linking regions. The drawable reticulum of the web is characterized in that it includes a cohesive fiber matrix capable of increasing its void volume upon dry-drawing. The process further includes the steps of (d) adhering the web to a drying cylinder with a resinous adhesive coating composition, (e) drying the web on the drying cylinder, and (f) removing the web from the drying cylinder. Steps (d), (e) and (f) are performed so as to substantially preserve the drawable fiber reticulum. After drying, the web is drawn to its final length.

The drying cylinder is optionally provided with a resinous protective coating layer underneath the resinous adhesive coating composition. The resinous protecting coating layer preferably includes a polyamide resin, such as a diethylene triamine resin, as is well known in the art. These resins may be cross-linked by any suitable means.

The resinous adhesive coating composition is preferably rewettable. The process is operated such that it includes maintaining the adhesive resin coating composition on the drying cylinder such that the coating provides sufficient wet tack strength upon transfer of the web to the drying cylinder to secure the web thereto during drying. The adhesive resin coating composition is also maintained such that the adhesive coating composition is pliant when dried such that the web may be removed from the drying cylinder without a creping blade. In this respect, "pliant" means that the adhesive resin coating composition does not harden when dried, or is otherwise maintained in a flexible state, such that the web may be separated from the drying cylinder without substantial damage. The adhesive coating composition may include a polyvinyl alcohol resin and preferably includes at leas one additional resin. The additional resin may be a polysaccharide resin, such as a cellulosic resin or a starch.

In a still further aspect, the invention provides a method of making a fabric-creped absorbent cellulosic sheet as described above wherein the web is embossed while it is disposed on the drying cylinder. After embossing, the web is further dried on the drying cylinder and removed therefrom. Preferably, the steps of applying the web to the drying cylinder, embossing the web while it is disposed on the drying cylinder, drying the web on the drying cylinder and removing the web from the drying cylinder are performed so as to substantially preserve the drawable fiber reticulum. After removal from the drying cylinder, the dried web is drawn. The web is embossed at the drying cylinder when it has a consistency of less than about 80 percent, typically, when it has a consistency of less than 70 percent, and preferably, the web is embossed when its consistency is less than about 50 percent. In some cases, it may be possible to emboss the web while it is applied to the drying cylinder with an embossing surface traveling in the machine direction at a speed slower than the drying cylinder. In this embodiment, additional crepe is applied to the web while it is disposed on the drying cylinder.

Applied vacuum is useful for increasing CD stretch. Another method of making a fabric-creped absorbent cellulosic sheet includes (a) compactively dewatering a papermaking furnish to form a nascent web having an apparently random distribution of papermaking fiber, (b) applying the dewatered web having the apparently random fiber distribution to a translating transfer surface moving at a first speed, and (c) fabric-creping the web from the transfer surface at a consistency of from about 30 to about 60 percent utilizing a creping fabric, the creping step occurring under pressure in a fabric creping nip defined between the transfer surface and the creping fabric wherein the fabric is traveling at a second speed slower than the speed of the transfer surface. The fabric pattern, nip parameters, velocity delta and web consistency are selected such that the web is creped from the transfer surface and redistributed on the creping fabric to form a web with a drawable reticulum having a plurality of interconnected regions of different local basis weights including at least (i) a plurality of fiber enriched regions of high local basis weight, interconnected by way of (ii) a plurality of lower local basis weight linking regions. The process also includes (d) applying a vacuum to the web to increase its CD stretch by at least about 5% with respect to a like web produced by like means without applied vacuum after fabric creping. Preferably, the vacuum is applied to the web while the web is held in the creping fabric, and the creping fabric is selected to increase the CD stretch when suitable levels of vacuum are applied to the web. Generally, at least 5 inches Hg of vacuum is applied, more typically, at least 10 inches Hg of vacuum is applied when so desired. Higher vacuum levels, such as at least 15 inches Hg, or at least 20 inches Hg or at least 25 inches Hg of vacuum, or more, may be applied.

Applying vacuum to the web preferably increases the CD stretch of the web by at least about 5-7.5 percent with respect to a like web produced by the same means, but without having a vacuum applied thereto after fabric creping, more preferably, applying a vacuum to the web increases the CD stretch of the web by at least about 10 percent with respect to a like web produced by the same means, without having a vacuum applied thereto after fabric creping. In still other embodiments, applying a vacuum to the web increases the CD stretch of the web by at least about 20 percent with respect to a like web produced by the same means without having a vacuum applied thereto after fabric creping, at least about 35 percent with respect to a like web produced by the same means without having a vacuum applied thereto after fabric creping, or at least about 50 percent with respect to a like web produced by the same means without having a vacuum applied thereto after fabric creping being still more preferred in other cases.

The jet/wire velocity delta is likewise an important parameter for making the inventive products. A method of making a fabric-creped absorbent cellulosic sheet includes (a) applying a jet of papermaking furnish to a forming wire, the jet having a jet velocity and the wire moving at a forming wire velocity, the difference between the jet velocity and the forming wire velocity being referred to as the jet/wire velocity delta, (b) compactively dewatering the papermaking furnish to form a nascent web, and (c) fabric-creping the web from the transfer surface at a consistency of from about 30 to about 60 percent utilizing a creping fabric, the creping step occurring under pressure in a fabric creping nip defined between the transfer surface and the creping fabric, wherein the fabric is traveling at a second speed slower than the speed of the transfer surface. The fabric pattern, nip parameters, velocity delta and web consistency are selected such that the web is creped from the transfer surface and redistributed on the creping fabric. The process further includes (d) drying the web, and (e) controlling the jet/wire velocity delta and fabric creping step including fabric selection, such that the dry MD/CD tensile ratio of the dried web is about 1.5 or less. In some cases, it is preferred to control the jet/wire velocity delta and the fabric creping step such that the dry MD/CD tensile ratio of the dried web is about 1-0.75 or less, or about 0.5 or less. The jet/wire velocity delta may be greater than about 300 fpm, such as greater than about 350 fmp, or the jet/wire velocity delta to be less than about 50 fpm. The jet/wire velocity delta may also be less than 0 fpm, such that the forming wire speed exceeds the jet velocity.

Still yet another method of making a fabric-creped absorbent cellulosic sheet of the invention includes (a) applying a jet of papermaking furnish to a forming wire, the jet having a jet velocity and the wire moving at a forming wire velocity, the difference between the jet velocity and the forming wire velocity being referred to as the jet/wire velocity delta, (b) compactively dewatering the papermaking furnish to form a nascent web, and (c) fabric-creping the web from the transfer surface at a consistency of from about 30 to about 60 percent utilizing a creping fabric, the creping step occurring under pressure in a fabric creping nip defined between the transfer surface and the creping fabric, wherein the fabric is traveling at a second speed slower than the speed of the transfer surface. The fabric pattern, nip parameters, velocity delta and web consistency are selected such that the web is creped from the transfer surface and redistributed on the creping fabric. The process further includes (d) drying the web, and (e) controlling the jet/wire velocity delta and fabric creping step including fabric selection such that the dry MD/CD tensile ratio of the dried web is about 1.5 or less, with the proviso that the jet/wire velocity delta: (i) is negative or (ii) is greater than about 350 fpm. The jet/wire velocity delta may be greater than about 400 fpm, such as greater than about 450 fpm. Typically, the web has a reticulum with a plurality of interconnected regions of different local basis weights including at least (i) a plurality of fiber enriched regions of high local basis weight by way of (ii) a plurality of lower local basis weight linking regions. In preferred embodiments, the orientation of fibers in the fiber enriched regions is biased in the CD.

Still yet other features and advantages of the invention will become apparent from the following description and appended drawings.

BRIEF DESCRIPTION OF THE DRAWINGS

The invention is described in detail below with reference to the drawings, wherein like numerals designate similar parts.

DETAILED DESCRIPTION

Figure 1:
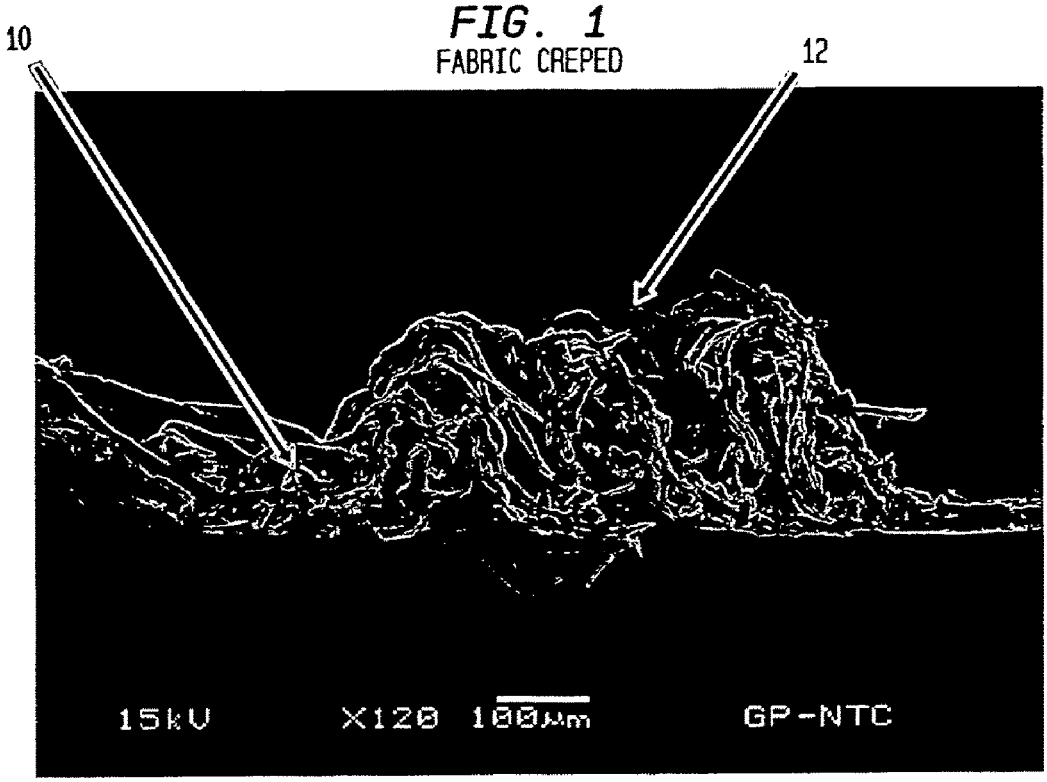
FIG. 1 is a photomicrograph (120×) in section along the machine direction of a fiber-enriched region of a fabric-creped sheet which has not been drawn subsequent to fabric creping.

The invention is described in detail below with reference to several embodiments and numerous examples. Such a discussion is for purposes of illustration only. Modifications to particular examples within the spirit and scope of the present invention, set forth in the appended claims, will be readily apparent to one of skill in the art.

Terminology used herein is given its ordinary meaning consistent with the exemplary definition set forth immediately below.

Throughout this specification and claims, when we refer to a nascent web having an apparently random distribution of fiber orientation (or use like terminology), we are referring to the distribution of fiber orientation that results when known forming techniques are used for depositing a furnish on the forming fabric. When examined microscopically, the fibers give the appearance of being randomly oriented, even though, depending on the jet to wire speed, there may be a significant bias toward machine direction orientation making the machine direction tensile strength of the web exceed the cross-direction tensile strength.

Unless otherwise specified, "basis weight", BWT, bwt, and so forth, refers to the weight of a 3000 square foot ream of product. Consistency refers to percent solids of a nascent web, for example, calculated on a bone dry basis. "Air dry" means including residual moisture, by convention, up to about 10 percent moisture for pulp and up to about 6% for paper. A nascent web having 50 percent water and 50 percent bone dry pulp has a consistency of 50 percent.

The term "cellulosic", "cellulosic sheet", and the like, is meant to include any product incorporating papermaking fiber having cellulose as a major constituent. "Papermaking fibers" include virgin pulps or recycle (secondary) cellulosic fibers or fiber mixes comprising cellulosic fibers. Fibers suitable for making the webs of this invention include: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers, such as those obtained from deciduous and coniferous trees, including softwood fibers, such as northern and southern softwood kraft fibers; hardwood fibers, such as eucalyptus, maple, birch, aspen, or the like. Papermaking fibers can be liberated from their source material by any one of a number of chemical pulping processes familiar to one experienced in the art including sulfate, sulfite, polysulfide, soda pulping, etc. The pulp can be bleached, if desired, by chemical means including the use of chlorine, chlorine dioxide, oxygen, alkaline peroxide, and so forth. The products of the present invention may comprise a blend of conventional fibers (whether derived from virgin pulp or recycle sources) and high coarseness lignin-rich tubular fibers, such as bleached chemical thermomechanical pulp (BCTMP). "Furnishes" and like terminology refers to aqueous compositions including papermaking fibers, optionally, wet strength resins, debonders, and the like, for making paper products.

As used herein, the term "comparatively dewatering" the web or furnish refers to mechanical dewatering by wet pressing on a dewatering felt, for example, in some embodiments, by use of mechanical pressure applied continuously over the web surface as in a nip between a press roll and a press shoe, wherein the web is in contact with a papermaking felt. The terminology "compactively dewatering" is used to distinguish processes wherein the initial dewatering of the web is carried out largely by thermal means as is the case, for example, in U.S. Pat. No. 4,529,480 to Trokhan and U.S. Pat. No. 5,607,551 to Farrington et al. noted above. Compactively dewatering a web thus refers, for example, to removing water from a nascent web having a consistency of less than 30 percent or so by application of pressure thereto and/or increasing the consistency of the web by about 15 percent or more by application of pressure thereto.

Creping fabric and like terminology refers to fabric or belt that bears a pattern suitable for practicing the process of the present invention and preferably, is permeable enough such that the web may be dried while it is held in the creping fabric. In cases where the web is transferred to another fabric or surface (other than the creping fabric) for drying, the creping fabric may have lower permeability.

"Fabric side" and like terminology refers to the side of the web that is in contact with the creping and drying fabric. "Dryer side" or "can side" is the side of the web opposite to the fabric side of the web.

Fpm refers to feet per minute, while consistency refers to the weight percent fiber of the web.

Jet/wire velocity delta is the difference in speed between the headbox jet issuing from a headbox (such as headbox 70, FIGS. 25, 26) and the forming wire or fabric. Jet velocity-wire speed is typically in fpm. In cases where a pair of forming fabrics are used, the speed of the fabric advancing the web in the machine direction is used to calculate jet/wire velocity delta, i.e., fabric 54, FIG. 25 or felt 78, FIG. 26, in the case of a crescent-forming machine. In any event, both forming fabrics are ordinarily at the same speed.

A "like" web produced by "like" means refers to a web made from substantially identical equipment in substantially the same way, that is, with substantially the same overall crepe, fabric crepe, nip parameters, and so forth.

MD means machine direction and CD means cross-machine direction.

Nip parameters include, without limitation, nip pressure, nip length, backing roll hardness, fabric approach angle, fabric takeaway angle, uniformity, and velocity delta between surface of the nip.

Nip length means the length over which the nip surfaces are in contact.

The drawable reticulum is "substantially preserved" when the web is capable of exhibiting a void volume increase upon drawing.

"On line" and like terminology refers to a process step performed without removing the web from the papermachine in which the web is produced. A web is drawn or calendered on line when it is drawn or calendered without being severed prior to wind-up.

"Pliant", in the context of creping adhesive, means that the adhesive resin coating composition does not harden when dried, or is otherwise maintained in a flexible state such that the web may be separated from the drying cylinder without substantial damage. The adhesive coating composition may include a polyvinyl alcohol resin, and preferably includes at least one additional resin. The additional resin may be a polysaccharide resin, such as a cellulosic resin or a starch.

A translating transfer surface refers to the surface from which the web is creped into the creping fabric. The translating transfer surface may be the surface of a rotating drum as described hereafter, or may be the surface of a continuous smooth moving belt or another moving fabric, which may have a surface texture, and so forth. The translating surface needs to support the web and facilitate the high solids creping as will be appreciated from the discussion that follows.

Calipers and/or bulk reported herein may be measured 1, 4 or 8 sheet calipers as specified. The sheets are stacked and the caliper measurement taken about the central portion of the stack. Preferably, the test samples are conditioned in an atmosphere of 23 E±1.0 EC (73.4 E±1.8 EF) at 50% relative humidity for at least about 2 hours and then measured with a Thwing-Albert Model 89-11-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product is sold. For testing in general, eight sheets are selected and stacked together. For napkin testing, napkins are unfolded prior to stacking. For basesheet testing off of winders, each sheet to be tested must have the same number of plies as produced off the winder. For basesheet testing off of the papermachine reel, single plies must be used. Sheets are stacked together aligned in the MD. On custom embossed or printed product, try to avoid taking measurements in these areas if at all possible. Bulk may also be expressed in units of volume/weight by dividing caliper by basis weight.

Absorbency of the inventive products is measured with a simple absorbency tester. The simple absorbency tester is a particularly useful apparatus for measuring the hydrophilicity and absorbency properties of a sample of tissue, napkins, or towel. In this test, a sample of tissue, napkins, or towel 2.0 inches in diameter is mounted between a top plastic cover and a bottom grooved sample plate. The tissue, napkin, or towel sample disc is held in place by a ⅛ inch wide circumference flange area. The sample is not compressed by the holder. De-ionized water at 73 EF is introduced to the sample at the center of the bottom sample plate through a 1 mm diameter conduit. This water is at a hydrostatic head of minus 5 mm. Flow is initiated by a pulse introduced at the start of the measurement by the instrument mechanism. Water is thus imbibed by the tissue, napkin, or towel sample from this central entrance point radially outward by capillary action. When the rate of water imbibition decreases below 0.005 gm water per 5 seconds, the test is terminated. The amount of water removed from the reservoir and absorbed by the sample is weighed and reported as grams of water per square meter of sample or grams of water per gram of sheet. In practice, an M/K Systems Inc. Gravimetric Absorbency Testing System is used. This is a commercial system obtainable from M/K Systems Inc., 12 Garden Street, Danvers, Mass., 01923. WAC or water absorbent capacity, also referred to as SAT, is actually determined by the instrument itself WAC is defined as the point where the weight versus time graph has a "zero" slope, i.e., the sample has stopped absorbing. The termination criteria for a test are expressed in maximum change in water weight absorbed over a fixed time period. This is basically an estimate of zero slope on the weight versus time graph. The program uses a change of 0.005 g over a 5 second time interval as termination criteria, unless "Slow SAT" is specified, in which case, the cut off criteria is 1 mg in 20 seconds.

Dry tensile strengths (MD and CD), stretch, ratios thereof, modulus, break modulus, stress and strain are measured with a standard Instron test device or other suitable elongation tensile tester, which may be configured in various ways, typically, using 3 or 1 inch wide strips of tissue or towel, conditioned in an atmosphere of 23E±1 EC (73.4E±1EF) at 50% relative humidity for 2 hours. The tensile test is run at a crosshead speed of 2 in/min. Modulus is expressed in lbs/inch per inch of elongation, unless otherwise indicated.

Tensile ratios are simply ratios of the values determined by way of the foregoing methods. Unless otherwise specified, a tensile property is a dry sheet property.

"Fabric crepe ratio" is an expression of the speed differential between the creping fabric and the forming wire, and is typically calculated as the ratio of the web speed immediately before fabric creping and the web speed immediately following fabric creping, the forming wire and transfer surface being typically, but not necessarily, operated at the same speed:

Fabric crepe ratio=transfer cylinder speed) creping fabric speed.

Fabric crepe can also be expressed as a percentage calculated as:

Fabric crepe,percent=[Fabric crepe ratio−1*JH* 100%.

A web creped from a transfer cylinder with a surface speed of 750 fpm to a fabric with a velocity of 500 fpm has a fabric crepe ratio of 1.5 and a fabric crepe of 50%.

The draw ratio is calculated similarly, typically, as the ratio of winding speed to the creping fabric speed. Draw may be expressed as a percentage by subtracting 1 from the draw ratio and multipling by 100%. The "pullout" or "draw" applied to a test specimen is calculated from the ratio of final length divided by its length prior to elongation. Unless otherwise specified, draw refers to elongation with respect to the length of the as-dried web. This quantity may also be expressed as a percentage. For example, a 4" test specimen drawn to 5" has a draw ratio of 5/4 or 1.25 and a draw of 25%.

The total crepe ratio is calculated as the ratio of the forming wire speed to the reel speed and a % total crepe is:

Total Crepe %=[Total Crepe Ratio−1*JH* 100%.

A process with a forming wire speed of 2000 fpm and a reel speed of 1000 fpm has a line or total crepe ratio of 2 and a total crepe of 100%.

The recovered crepe of a web is the amount of fabric crepe removed when the web is elongated or drawn. This quantity is calculated as follows and expressed as a percentage:

$$\text{Recovered Crepe } \% = 1 - \left[\frac{\%\ TotalCrepe}{\%\ FabricCrepe}\right] \times 100\%.$$

A process with a total crepe of 25% and a fabric crepe of 50% has a recovered crepe of 50%.

Figure 25:
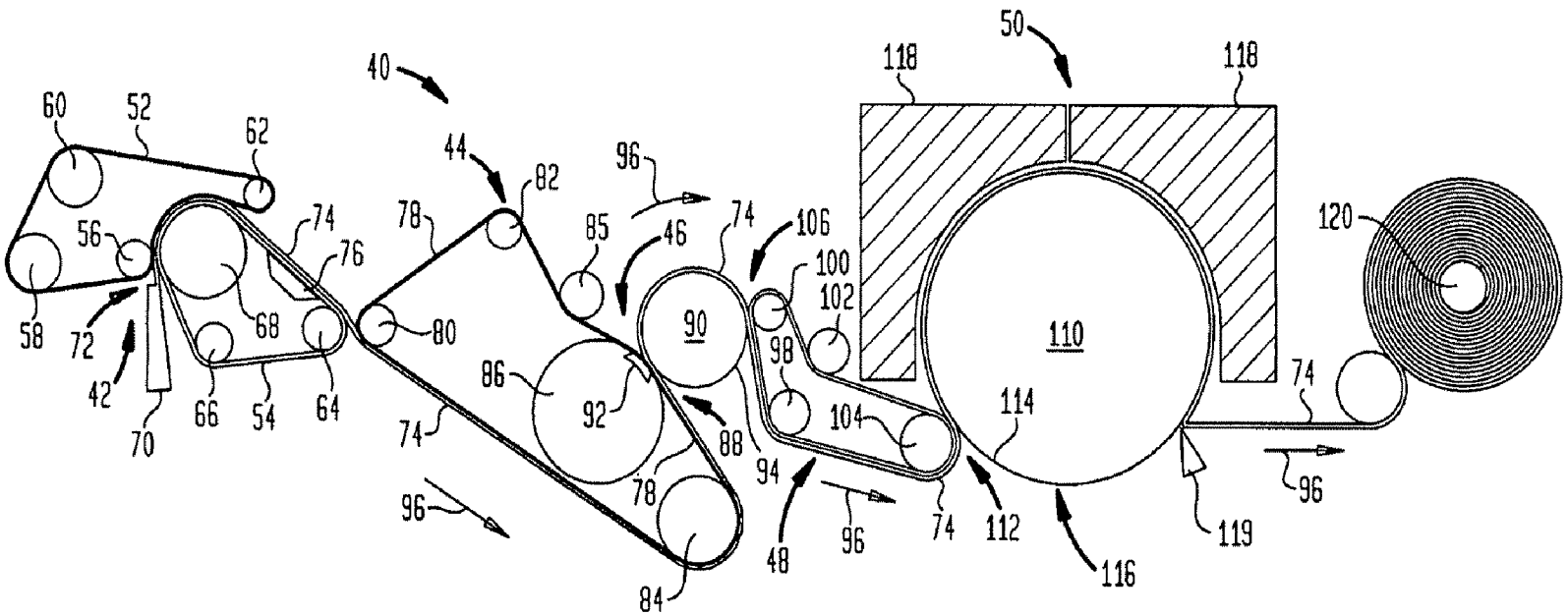
FIG. 25 is a schematic diagram of a paper machine for practicing the process of the present invention.

Recovered crepe is referred to as the crepe recovery when quantifying the amount of crepe and draw applied to a particular web. Sample calculations of the various quantities for a papermachine 40 of the type shown in FIG. 25 provided with a transfer cylinder 90, a creping fabric 48, as well as a take up reel 120, are given in Table 1 below. Recovered fabric crepe is a product attribute which relates to bulk and void volume as is seen in the Figures and Examples below.

TABLE 1

Sample Calculations of Fabric Crepe, Draw and Recovered Crepe

| Wire fpm | Crepe Fabric fpm | Reel fpm | FCRatio | FabCrp % % | DrawRatio | Draw % % | TotalCrp Ratio | ToCrptPct % | RecCrp % |
|---|---|---|---|---|---|---|---|---|---|
| 1000 | 500 | 750 | 2.00 | 100% | 1.5 | 50% | 1.33 | 33% | 67% |
| 2000 | 1500 | 1600 | 1.33 | 33% | 1.067 | 6.7% | 1.25 | 25% | 25% |
| 2000 | 1500 | 2000 | 1.33 | 33% | 1.33 | 33% | 1.00 | 0% | 100% |
| 3000 | 1500 | 2625 | 2.00 | 100% | 1.75 | 75% | 1.14 | 14% | 86% |
| 3000 | 2000 | 2500 | 1.50 | 50% | 1.25 | 25% | 1.20 | 20% | 60% |

Friction values and sidedness are calculated by a modification to the TMI method discussed in U.S. Pat. No. 6,827,819 to Dwiggins et al. This modified method is described below. A percent change in friction value or sidedness upon drawing is based on the difference between the initial value without draw and the drawn value, divided by the initial value, and expressed as a percentage.

Sidedness and friction deviation measurements can be accomplished using a Lab Master Slip & Friction tester, with special high-sensitivity load measuring option and custom top and sample support block, Model 32-90 available from:

Testing Machines Inc.
2910 Expressway Drive South
Islandia, N.Y. 11722
www.testingmachines.com
adapted to accept a Friction Sensor, available from:
Noriyuki Uezumi
Kato Tech Co., Ltd.
Kyoto Branch Office
Nihon-Seimei-Kyoto-Santetsu Bldg. 3F
Higashishiokoji-Agaru, Nishinotoin-Dor
Shimogyo-ku, Kyotot 600-8216
Japan
81-75-361-6360
katotech@mx1.alpha-web.ne.jp The software for the Lab Master Slip and Friction tester is modified to allow it: (1) to retrieve and directly record instantaneous data on the force exerted on the friction sensor as it moves across the samples; (2) to compute an average for that data; (3) to calculate the deviation-absolute value of the difference between each of the instantaneous data points and the calculated mean; and (4) to calculate the mean deviation over the scan to be reported in grams.

Prior to testing, the test samples should be conditioned in an atmosphere of 230.0 E±1 EC (73.4 E±1.8 EF) and 50%±2% R.H. Testing should also be conducted at these conditions. The samples should be handled by edges and corners only and any touching of the area of the sample to be tested should be minimized as the samples are delicate, and physical properties may be easily changed by rough handling or transfer of oils from the hands of the tester.

The samples to be tested are prepared, using a paper cutter to get straight edges, as 3-inch wide (CD) by 5-inch long (MD) strips, any sheets with obvious imperfections being moved and replaced with acceptable sheets. These dimensions correspond to those of a standard tensile test, allowing the same specimen to be first elongated in the tensile tester, then tested for surface friction.

Each specimen is placed on the sample table of the tester and the edges of the specimen are aligned with the front edge of the sample table and the chucking device. A metal frame is placed on top of the specimen in the center of the sample table while ensuring that the specimen is flat beneath the frame by gently smoothing the outside edges of the sheet. The sensor is placed carefully on the specimen with the sensor part in the middle of the sensor holder. Two MD-scans are run on each side of each specimen.

To compute the TMI Friction Value of a sample, two MD scans of the sensor head are run on each side of each sheet, where The Average Deviation value from the first MD scan of the fabric side of the sheet is recorded as $MD_{F1}$; the result obtained on the second scan on the fabric side of the sheet is recorded as $MD_{F2}$. $MD_{D1}$ and $MD_{D2}$ are the results of the scans run on the Dryer side (Can or Yankee side) of the sheet.

The TMI Friction Value for the fabric side is calculated as follows:

$$\text{TMI_FV}_F = \frac{MD_{F1} + MD_{F2}}{2}.$$

Likewise, the TMI Friction Value for the dryer side is calculated as:

$$\text{TMI_FV}_D = \frac{MD_{D1} + MD_{D2}}{2}.$$

An overall Sheet Friction Value can be calculated as the average of the fabric side and the dryer side, as follows:

$$\text{TMI_FV}_{AVG} = \frac{\text{TMI_FV}_F + \text{TMI_FV}_D}{2}.$$

Leading to Sidedness as an indication of how much the friction differs between the two sides of the sheet. The sidedness is defined as:

$$Sidedness = \frac{\text{TMI_FV}_U}{\text{TMI_FV}_L} * \text{TMI_FV}_{AVG}.$$

here "U" and "L" subscripts refer to the upper and lower values of the friction deviation of the two sides (Fabric and Dryer)—that is, the larger Friction value is always placed in the numerator.

For fabric-creped products, the fabric side friction value will be higher than the dryer side friction value. Sidedness takes into account not only the relative difference between the two sides of the sheet, but the overall friction level. Accordingly, low sidedness values are normally preferred.

PLI or pli means pounds force per linear inch.

Pusey and Jones (P&J) hardness (indentation) is measured in accordance with ASTM D 531, and refers to the indentation number (standard specimen and conditions).

Velocity delta means a difference in linear speed.

The void volume and/or void volume ratio, as referred to hereafter, are determined by saturating a sheet with a nonpolar POROFIL® liquid and measuring the amount of liquid absorbed. The volume of liquid absorbed is equivalent to the void volume within the sheet structure. The percent weight increase (PWI) is expressed as grams of liquid absorbed per gram of fiber in the sheet structure times 100, as noted hereafter. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiple samples should be separated into individual single plies and 8 sheets from each ply position used for testing. Weigh and record the dry weight of each test specimen to the nearest 0.0001 gram. Place the specimen in a dish containing POROFIL® liquid having a specific gravity of 1.875 grams per cubic centimeter, available from Coulter Electronics Ltd., Northwell Drive, Luton, Beds, England; Part No. 9902458. After 10 seconds, grasp the specimen at the very edge (1-2 Millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Lt., Maidstone, England) in order to remove any excess of the last partial drop. Immediately weigh the specimen, within 10 seconds, recording the weight to the nearest 0.0001 gram. The PWI for each specimen, expressed as grams of POROFIL® liquid per gram of fiber, is calculated as follows:

$$PWI=[(W_2-W_1)/W_1]H\ 100\%$$

wherein

"$W_1$" is the dry weight of the specimen, in grams; and

"$W_2$" is the wet weight of the specimen, in grams.

The PWI for all eight individual specimens is determined as described above and the average of the eight specimens is the PWI for the sample.

The void volume ratio is calculated by dividing the PWI by 1.9 (density of fluid) to express the ratio as a percentage, whereas the void volume (gms/gm) is simply the weight increase ratio, that is, PWI divided by 100.

During fabric creping in a pressure nip, the fiber is redistributed on the fabric, making the process tolerant of less than ideal forming conditions, as are sometimes seen with a Fourdrinier former. The forming section of a Fourdrinier machine includes two major parts, the headbox and the Fourdrinier Table. The latter consists of the wire run over the various drainage-controlling devices. The actual forming occurs along the Fourdrinier Table. The hydrodynamic effects of drainage, oriented shear, and the turbulence generated along the table are generally the controlling factors in the forming process. Of course, the headbox also has an important influence in the process, usually, on a scale that is much larger than the structural elements of the paper web. Thus, the headbox may cause such large-scale effects as variations in distribution of flow rates, velocities, and concentrations across the full width of the machine, vortex streaks generated ahead of and aligned in the machine direction by the accelerating flow in the approach to the slice, and time-varying surges or pulsations of flow to the headbox. The existence of MD-aligned vortices in headbox discharges is common. Fourdrinier formers are further described in *The Sheet Forming Process*, Parker, J. D., Ed., TAPPI Press (1972, reissued 1994) Atlanta, Ga.

According to the present invention, an absorbent paper web is made by dispersing papermaking fibers into aqueous furnish (slurry) and depositing the aqueous furnish onto the forming wire of a papermaking machine. Any suitable forming scheme might be used. For example, an extensive, but non-exhaustive list in addition to Fourdrinier formers, includes a crescent former, a C-wrap twin wire former, or a suction breast roller former. The forming fabric an be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571;4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808, all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon fabric-creping. Foam-forming techniques are disclosed in U.S. Pat. No. 4,543,156 and Canadian Patent No. 2,053,505, the disclosures of which are incorporated herein by reference. The foamed fiber furnish is made up from an aqueous slurry of fibers mixed with a foamed liquid carrier just prior to its introduction to the headbox. The pulp slurry supplied to the system has a consistency in the range of from about 0.5 to about 7 weight percent fibers, preferably, in the range of from about 2.5 to about 4.5 weight percent. The pulp slurry is added to a foamed liquid comprising water, air and surfactant containing 50 to 80 percent air by volume forming a foamed fiber furnish having a consistency in the range of from about 0.1 to about 3 weight percent fiber by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom.

The furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof; said chemicals optionally comprising polyols, starches, PPG esters, PEG esters, phospholipids, surfactants, polyamines, HMCP (Hydrophobically Modified Cationic Polymers), HMAP (Hydrophobically Modified Anionic Polymers), or the like.

The pulp can be mixed with strength adjusting agents such as wet strength agents, dry strength agents and debonders/softeners, and so forth. Suitable wet strength agents are known to the skilled artisan. A comprehensive, but non-exhaustive list of useful strength aids, includes urea-formaldehyde resins, melamine formaldehyde resins, glyoxylated polyacrylamide resins, polyamide-epichlorohydrin resins, and the like. Thermosetting polyacrylamides are produced by reacting acrylamide with diallyl ammonium chloride (DADMAC) to produce a cationic polyacrylamide copolymer, which is ultimately reacted with glyoxal to produce a cationic cross-linking wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference in their entirety. Resins of this type are commercially available under the trade name of PAREZ 631NC by Bayer Corporation. Different mole ratios of acrylamide/DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin wet strength resins, an example of which is sold under the trade names Kymene 557LX and Kymene 557H by Hercules Incorporated of Wilmington, Del. and Amres® from Georgia-Pacific Resins, Inc. These resins and the processes for making the resins are described in U.S. Pat. Nos. 3,700,623 and 3,772,076, each of which is incorporated herein by reference in its entirety. An extensive description of polymeric-epihalohydrin resins is given in "Chapter 2: Alkaline-Curing Polymeric Amine-Epicchorohydrin" by Espy in *Wet Strength Resins and Their Application* (L. Chan, Editor, 1994), incorporated herein by reference in its entirety. A reasonably comprehensive list of wet strength resins is described by Westfelt in *Cellulose Chemistry and Technology* Volume 13, p. 813, 1979, which is incorporated herein by reference.

Suitable temporary wet strength agents may likewise be included. A comprehensive, but non-exhaustive, list of useful temporary wet strength agents includes aliphatic and aromatic aldehydes including glyoxal, malonic dialdehyde, succinic dialdehyde, glutaraldehyde and dialdehyde starches, as well as substituted or reacted starches, disaccharides, polysaccharides, chitosan, or other reacted polymeric reaction products of monomers or polymers having aldehyde groups, and optionally, nitrogen groups. Representative nitrogen containing polymers, which can suitably be reacted with the aldehyde containing monomers or polymers, includes vinyl-amides, acrylamides and related nitrogen containing polymers. These polymers impart a positive charge to the aldehyde containing reaction product. In addition, other commercially available temporary wet strength agents, such as PAREZ 745, manufactured by Bayer, can be used, along with those disclosed, for example, in U.S. Pat. No. 4,605,702.

The temporary wet strength resin may be any one of a variety of water-soluble organic polymers comprising aldehydic units and cationic units used to increase dry and wet tensile strength of a paper product. Such resins are described in U.S. Pat. Nos. 4,675,394; 5,240,562; 5,138,002; 5,085,736; 4,981,557; 5,008,344; 4,603,176; 4,983,748; 4,866,151; 4,804,769 and 5,217,576. Modified starches sold under the trademarks CO-BOND® 1000 and CO-BOND® 1000 Plus, by National Starch and Chemical Company of Bridgewater, N.J., may be used. Prior to use, the cationic aldehydic water soluble polymer can be prepared by preheating an aqueous slurry of approximately 5% solids maintained at a temperature of approximately 240 degrees Farenheit and a pH of about 2.7 for approximately 3.5 minutes. Finally, the slurry can be quenched and diluted by adding water to produce a mixture of approximately 1.0% solids at less than about 130 degrees Farenheit.

Other temporary wet strength agents, also available from National Starch and Chemical Company are sold under the trademarks CO-BOND® 1600 and CO-BOND® 2300. These starches are supplied as aqueous colloidal dispersions and do not require preheating prior to use.

Temporary wet strength agents such as glyoxylated polyacrylamide can be used. Temporary wet strength agents such as glyoxylated polyacrylamide resins are produced by reacting acrylamide with diallyl dimethyl ammonium chloride (DADMAC) to produce a cationic polyacrylamide copolymer, which is ultimately reacted with glyoxal to produce a cationic cross-linking temporary or semi-permanent wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference. Resins of this type are commercially available under the trade name of PAREZ 631NC, by Bayer Industries. Different mole ratios of acrylamide/DADMAC/glyoxal can be used to produce cross-linking resins, which are useful as wet strength agents. Furthermore, other dialdehydes can be substituted for glyoxal to produce wet strength characteristics.

Suitable dry strength agents include starch, guar gum, polyacrylamides, carboxylmethyl cellulose, and the like. Of particular utility is carboxylmethyl cellulose, an example of which is sold under the trade name Hercules CMC, by Hercules Incorporated of Wilmington, Del. According to one embodiment, the pulp may contain from about 0 to about 15 lb/ton of dry strength agent. According to another embodiment, the pulp may contain from about 1 to about 5 lbs/ton of dry strength agent.

Suitable debonders are likewise known to the skilled artisan. Debonders or softeners may also be incorporated into the pulp or sprayed upon the web after its formation. The present invention may also be used with softener materials including, but not limited to, the class of amido amine salts derived from partially acid neutralized amines. Such materials are disclosed in U.S. Pat. No. 4,720,383. Evans, *Chemistry and Industry,* 5 Jul. 1969, pp. 893-903; Egan, *J. Am. Oil Chemist's Soc.*, Vol. 55 (1978), pp. 118-121; and Trivedi et al., *J. Am. Oil Chemist's Soc.*, June 1981, pp. 754-756, incorporated by reference in their entirety, indicate that softeners are often available commercially only as complex mixtures, rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably, 6 to 7 and most preferably, 6.5 to 7.

Quaternary ammonium compounds, such as dialkyl dimethyl quaternary ammonium salts are also suitable, particularly, when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

In some embodiments, a particularly preferred debonder composition includes a quaternary amine component as well as a nonionic surfactant.

The nascent web is typically dewatered on a papermaking felt. Any suitable felt may be used. For example, felts can have double-layer base weaves, triple-layer base weaves, or laminated base weaves. Preferred felts are those having the laminated base weave design. A wet-press-felt, which may be particularly useful with the present invention, is Vector 3 made by Voith Fabric. Background art in the press felt area includes U.S. Pat. Nos. 5,657,797; 5,368,696; 4,973,512; 5,023,132; 5,225,269; 5,182,164; 5,372,876; and 5,618,612. A differential pressing felt, as is disclosed in U.S. Pat. No. 4,533,437 to Curran et al., may likewise be utilized.

Suitable creping fabrics include single layer, multi-layer, or composite, preferably, open meshed structures. Fabrics may have at least one of the following characteristics: (1) on the side of the creping fabric that is in contact with the wet web (the "top" side), the number of machine direction (MD) strands per inch (mesh) is from 10 to 200 and the number of cross-direction (CD) strands per inch (count) is also from 10 to 200; (2) the strand diameter is typically smaller than 0.050 inch; (3) on the top side, the distance between the highest point of the MD knuckles and the highest point on the CD knuckles is from about 0.001 to about 0.02 or 0.03 inch; (4) in between these two levels, there can be knuckles formed either by MD or CD strands that give the topography a three dimensional hill/valley appearance which is imparted to the sheet; (5) the fabric may be oriented in any suitable way so as to achieve the desired effect on processing and on properties in the product, the long warp knuckles may be on the top side to increase MD ridges in the product, or the long shute knuckles may be on the top side if more CD ridges are desired to influence creping characteristics as the web is transferred from the transfer cylinder to the creping fabric; and (6) the fabric may be made to show certain geometric patterns that are pleasing to the eye, which is typically repeated between every two to 50 warp yarns. Suitable commercially available coarse fabrics include a number of fabrics made by Voith Fabrics.

The creping fabric may thus be of the class described in U.S. Pat. No. 5,607,551 to Farrington et al., cols. 7-8 thereof, as well as the fabrics described in U.S. Pat. No. 4,239,065 to Trokhan and U.S. Pat. No. 3,974,025 to Ayers. Such fabrics may have about 20 to about 60 filaments per inch and are formed from monofilament polymeric fibers having diameters typically ranging from about 0.008 to about 0.025 inches. Both warp and weft monofilaments may, but need not necessarily, be of the same diameter.

In some cases, the filaments are so woven and complimentarily serpentinely configured in at least the Z-direction (the thickness of the fabric) to provide a first grouping or array of coplanar top-surface-plane crossovers of both sets of filaments, and a predetermined second grouping or array of sub-top-surface crossovers. The arrays are interspersed so that portions of the top-surface-plane crossovers define an array of wicker-basket-like cavities in the top surface of the fabric, which cavities are disposed in staggered relation in both the machine direction (MD) and the cross machine direction (CD), and so that each cavity spans at least one sub-top-surface crossover. The cavities are discretely perimetrically enclosed in the plan view by a picket-like-lineament comprising portions of a plurality of the top-surface plane crossovers. The loop of fabric may comprise heat set monofilaments of thermoplastic material, the top surfaces of the coplanar top-surface-plane crossovers may be monoplanar flat surfaces. Specific embodiments of the invention include satin weaves as well as hybrid weaves of three or greater sheds, and mesh counts of from about 10 H 10 to about 120 H 120 filaments per inch (4 H 4 to about 47 H 47 per centimeter), although the preferred range of mesh counts is from about 18 by 16 to about 55 by 48 filaments per inch (9 H 8 to about 22 H 19 per centimeter).

Instead of an impression fabric, a dryer fabric may be used as the creping fabric, if so desired. Suitable fabrics are described in U.S. Pat. No. 5,449,026 (woven style) and U.S. Pat. No. 5,690,149 (stacked MD tape yarn style) to Lee, as well as U.S. Pat. No. 4,490,925 to Smith (spiral style).

If a Fourdrinier former or other gap former is used, the nascent web may be conditioned with vacuum boxes and a steam shroud until it reaches a solids content suitable for transferring to a dewatering felt. The nascent web may be transferred with vacuum assistance to the felt. In a crescent former, use of a vacuum assist is unnecessary, as the nascent web is formed between the forming fabric and the felt.

Can drying can be used alone or in combination with impingement air drying, the combination being especially convenient if a two tier drying section layout is available as hereafter described. Impingement air drying may also be used as the only means of drying the web as it is held in the fabric, if so desired, or either may be used in combination with can dryings. Suitable rotary impingement air drying equipment is described in U.S. Pat. No. 6,432,267 to Watson and U.S. Pat. No. 6,447,640 to Watson et al. Inasmuch as the process of the invention can readily be practiced on existing equipment with reasonable modifications, any existing flat dryings can be advantageously employed so as to conserve capital as well.

Alternatively, the web may be through-dried after fabric creping, as is well known in the art. Representative references include: U.S. Pat. No. 3,432,936 to Cole et al.; U.S. Pat. No. 3,994,771 to Morgan, Jr. et al.; U.S. Pat. No. 4,102,737 to Morton; and U.S. Pat. No. 4,529,480 to Trokhan.

Turning to the Figures, FIG. 1 shows a cross section (120×) along the MD of a fabric-creped, undrawn sheet 10 illustrating a fiber-enriched region 12. It will be appreciated that fibers of the fiber-enriched region 12 have an orientation biased in the CD, especially, at the right side of region 12, where the web contacts a knuckle of the creping fabric.

Figure 2:
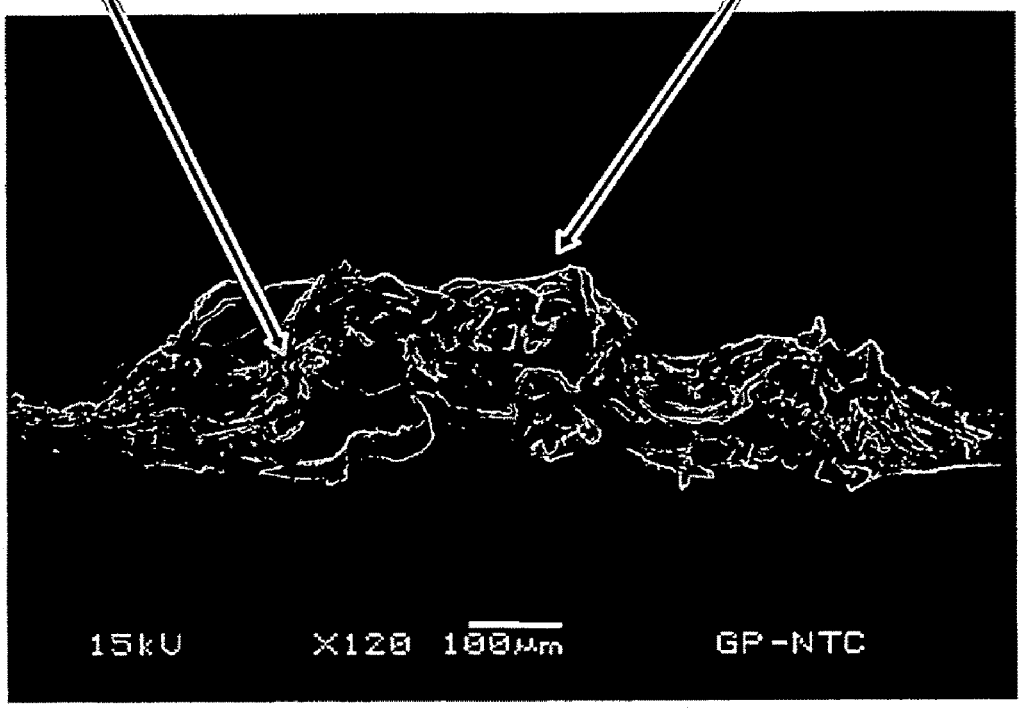
FIG. 2 is a photomicrograph (120×) in section along the machine direction of a fiber-enriched region of a fabric-creped sheet of the invention which has been drawn 45% subsequent to fabric creping.

FIG. 2 illustrates sheet 10 drawn 45% after fabric creping and drying. Here, it is seen that regions 12 are attenuated or dispersed in the machine direction when the microfolds of regions 12 expand or unfold. The drawn web exhibits increased bulk and void volume with respect to an undrawn web. Structural and property changes are further appreciated by reference to FIGS. 3-12.

Figure 3:
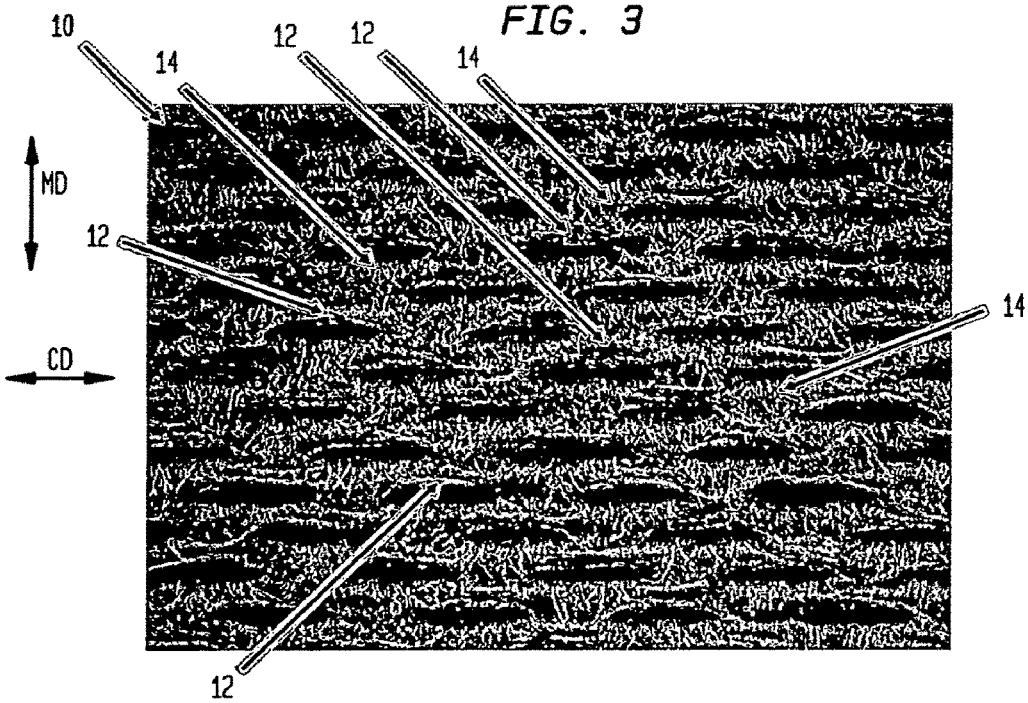
FIG. 3 is a photomicrograph (10×) of the fabric side of a fabric-creped web which was dried in the fabric.

FIG. 3 is a photomicrograph (10×) of the fabric side of a fabric-creped web of the invention that was prepared without substantial subsequent draw of the web. It is seen in FIG. 3 that sheet 10 has a plurality of very pronounced high basis weight, fiber-enriched regions 12 having fiber with orientation biased in the cross-machine (CD) linked by relatively low basis weight regions 14. It is appreciated from the photographs that linking regions 14 have fiber orientation bias extending along a direction between fiber enriched regions 12. Moreover, it is seen that the fold lines or creases of the microfolds of fiber enriched regions 12 extend along the CD.

Figure 4:
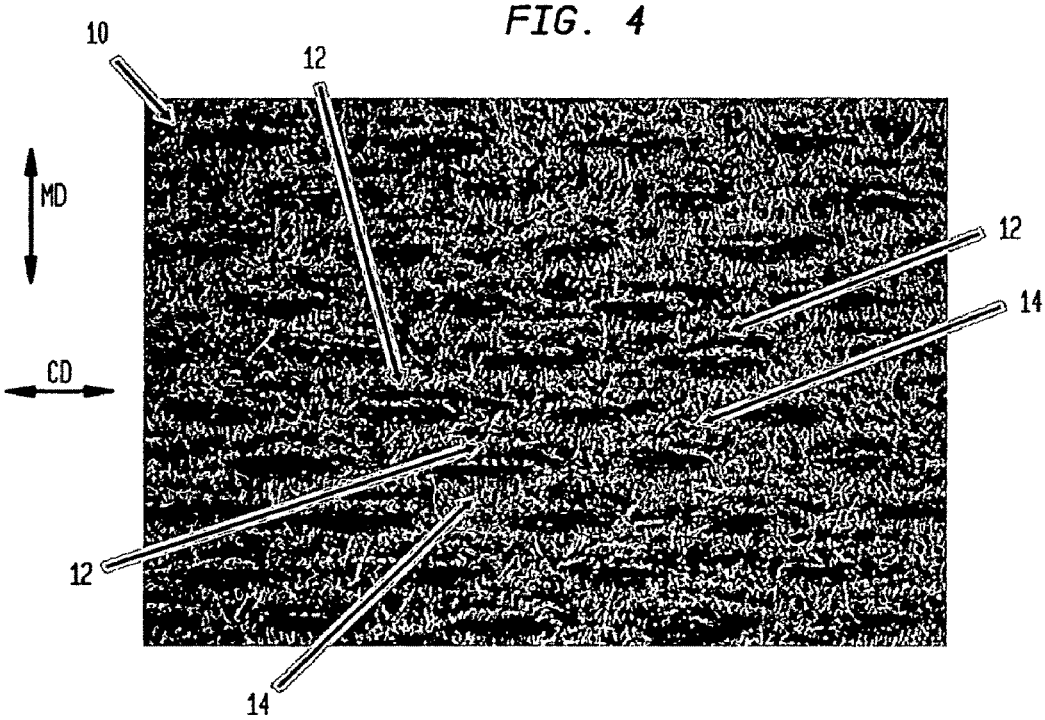
FIG. 4 is a photomicrograph (10×) of the fabric side of a fabric-creped web which was dried in-fabric, then drawn 45%.

FIG. 4 is a photomicrograph (10×) of the fabric side of a fabric-creped web of the invention which was fabric creped, dried and subsequently drawn 45%. It is seen in FIG. 4 that sheet 10 still has a plurality of relatively high basis weight regions 12 linked by lower basis regions 14; however, the fiber-enriched regions 12 are much less pronounced after the web is drawn, as will be appreciated by comparing FIGS. 3 and 4.

Figure 5:
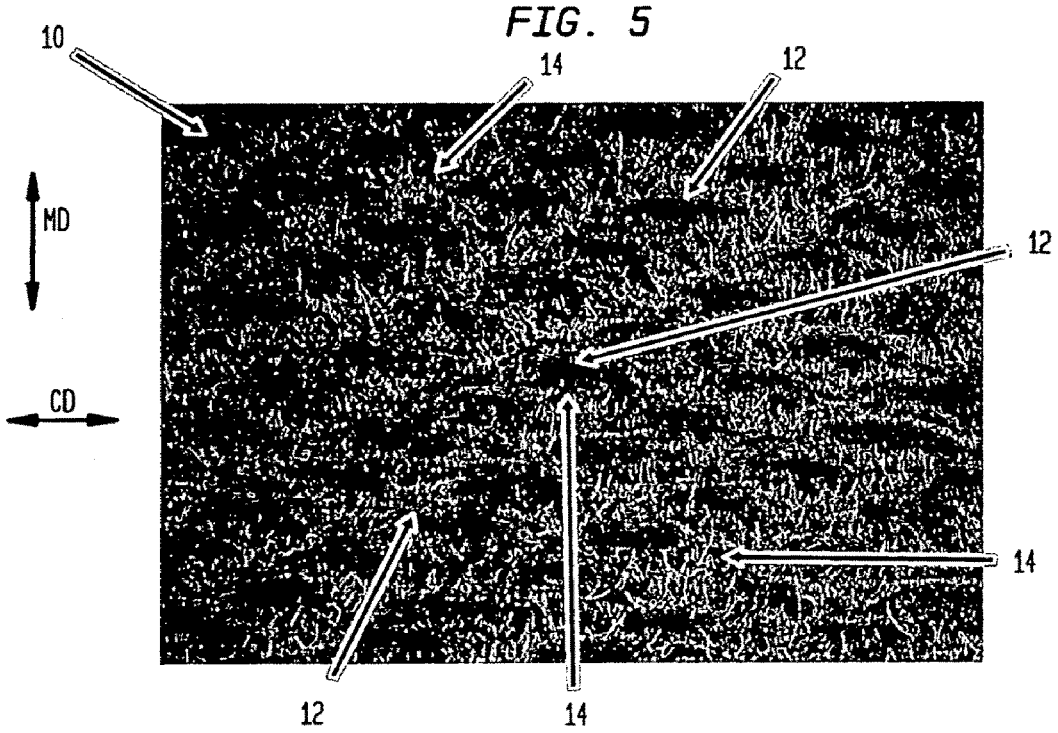
FIG. 5 is a photomicrograph (10×) of the dryer side of the web of FIG. 3.

FIG. 5 is a photomicrograph (10×) of the dryer side of the web of FIG. 3, that is, the side of the web opposite the creping fabric. This web was fabric creped and dried without drawing. Here, there are seen fiber-enriched regions 12 of relatively high basis weights, as well as lower basis weight regions 14 linking the fiber-enriched regions. These features are generally less pronounced on the dryer or "can" side of the web; except, however, the attenuation or unfolding of the fiber-enriched regions is perhaps more readily observed on the dryer side of the web when the fabric-creped web 10 is drawn, as is seen in FIG. 6.

Figure 6:
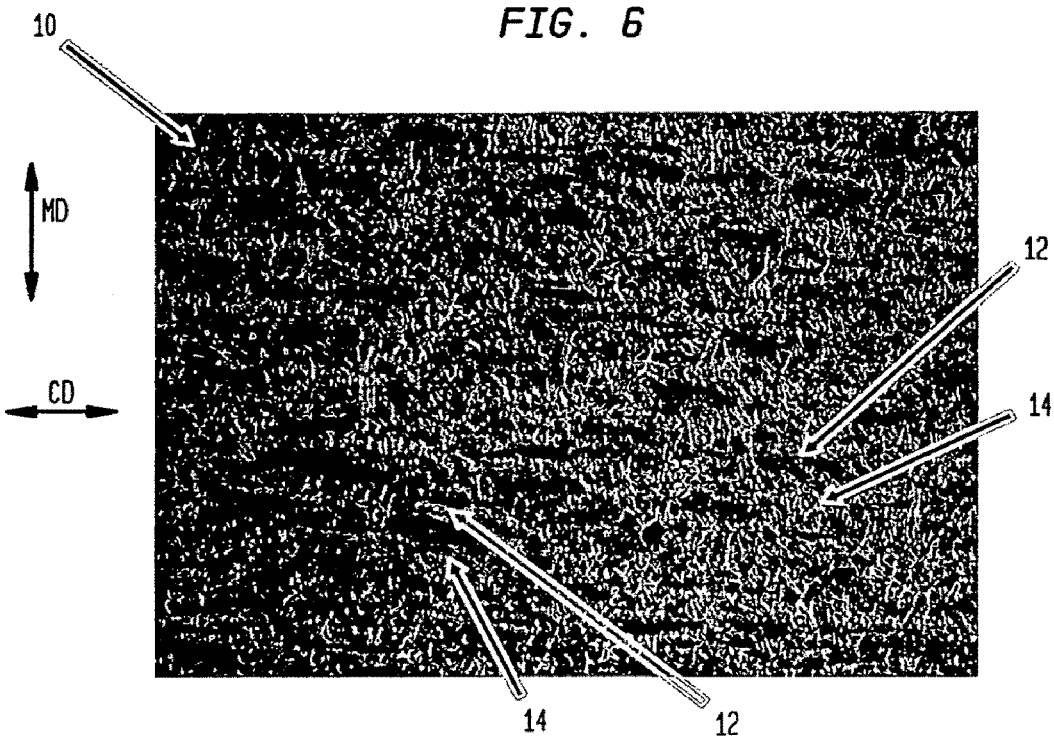
FIG. 6 is a photomicrograph (10×) of the dryer side of the web of FIG. 4.

FIG. 6 is a photomicrograph (10×) of the dryer side of a fabric-creped web 10 prepared in accordance with the invention which was fabric creped, dried and subsequently drawn 45%. Here, it is seen that fiber-enriched high basis weight regions 12 "open" or unfold somewhat as they attenuate (as is also seen in FIGS. 1 and 2 at higher magnification). The lower basis weight regions 14 remain relatively intact as the web is drawn. In other words, the fiber-enriched regions are preferentially attenuated as the web is drawn. It is further seen in FIG. 6 that the relatively compressed fiber-enriched regions 12 have been expanded in the sheet.

Without intending to be bound by any theory, it is believed that fabric-creping the web as described herein produces a cohesive fiber reticulum having pronounced variation in local basis weight. The network can be substantially preserved while the web is dried, for example, such that dry-drawing the web will disperse or attenuate the fiber-enriched regions somewhat and increase the void volume of the web. This attribute of the invention is manifested in FIG. 6 by microfolds in the web at regions 12 opening upon drawing of the web to a greater length. In FIG. 5, corresponding regions 12 of the undrawn web remain closed.

Figure 7:
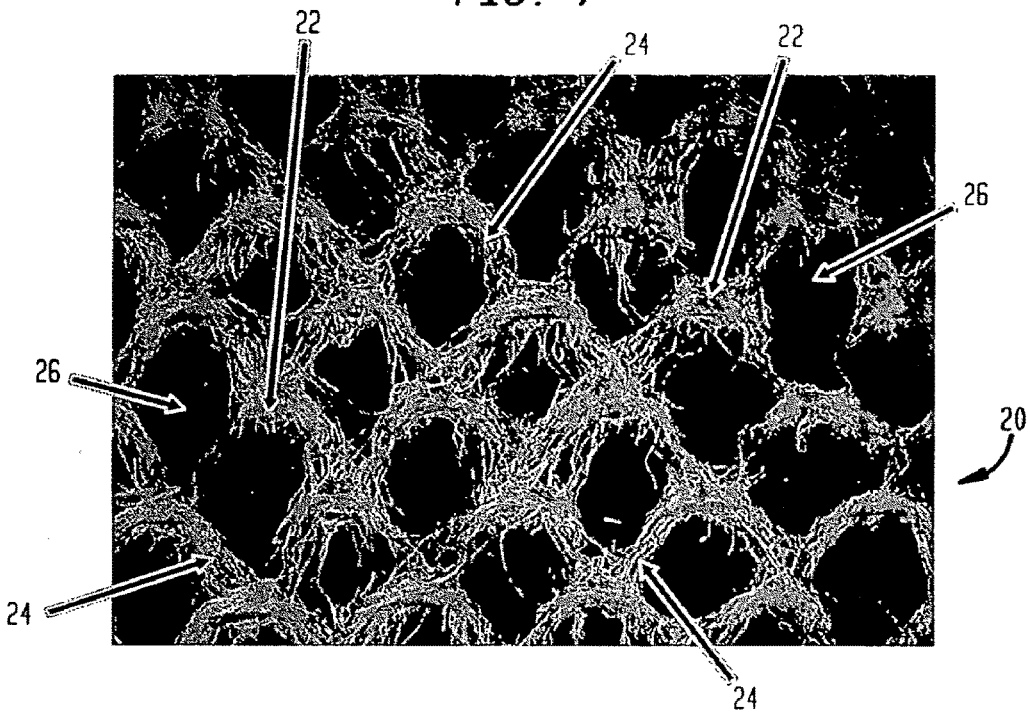
FIG. 7 is a photomicrograph (8×) of an open mesh web including a plurality of high basis weight regions linked by lower basis weight regions extending therebetween.
Figure 8:
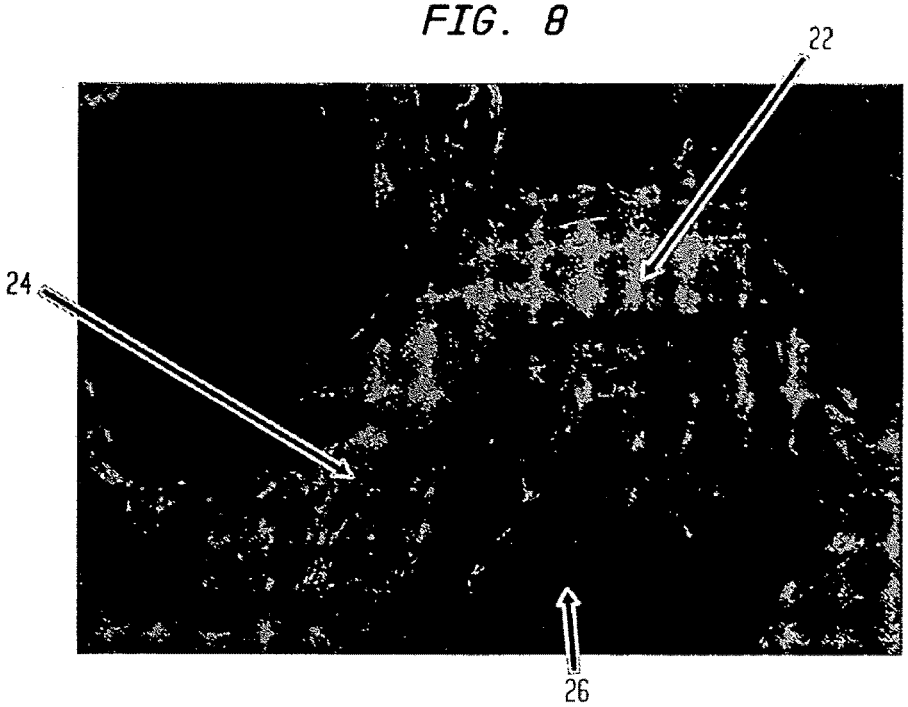
FIG. 8 is a photomicrograph showing an enlarged detail (32×) of the web of FIG. 7.

The invention process and preferred products thereof are further appreciated by reference to FIGS. 7 through 24. FIG. 7 is a photomicrograph of a very low basis weight, open mesh web 20 having a plurality of relatively high basis weight pileated regions 22 interconnected by a plurality of lower basis weight linking regions 24. The cellulosic fibers of linking regions 24 have an orientation, which is biased along the direction as to which they extend between pileated regions 22, as is perhaps best seen in the enlarged view of FIG. 8. The orientation and variation in local basis weight is surprising in view of the fact that the nascent web has an apparently random fiber orientation when formed and is transferred largely undisturbed to a transfer surface prior to being wet-creped therefrom. The imparted ordered structure is distinctly seen at extremely low basis weights where web 20 has open portions 26 and is thus an open mesh structure.

Figure 9:
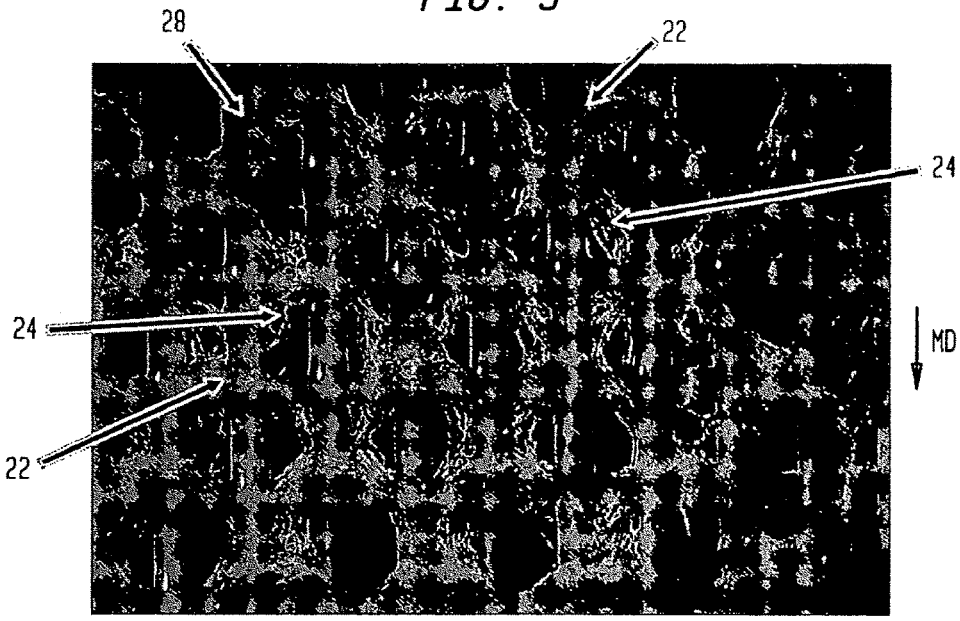
FIG. 9 is a photomicrograph (8×) showing the open mesh web of FIG. 7 placed on the creping fabric used to manufacture the web.

FIG. 9 shows a web together with the creping fabric 28 upon which the fibers were redistributed in a wet-creping nip after generally random formation to a consistency of 40-50 percent or so prior to creping from the transfer cylinder.

Figure 10:
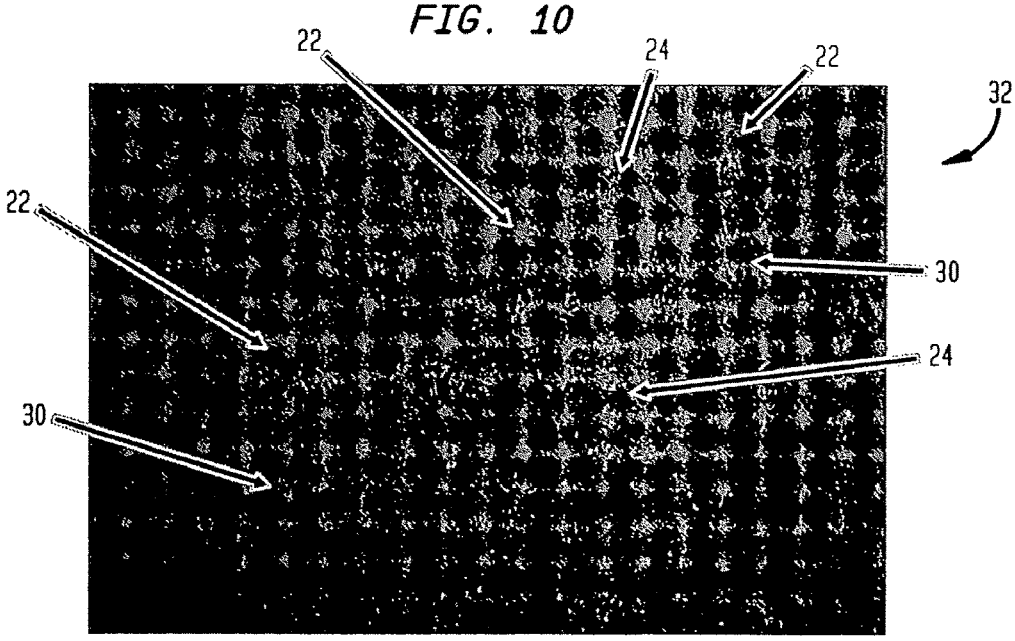
FIG. 10 is a photomicrograph showing a web having a basis weight of 19 lbs/ream produced with a 17% Fabric Crepe.
Figure 11:
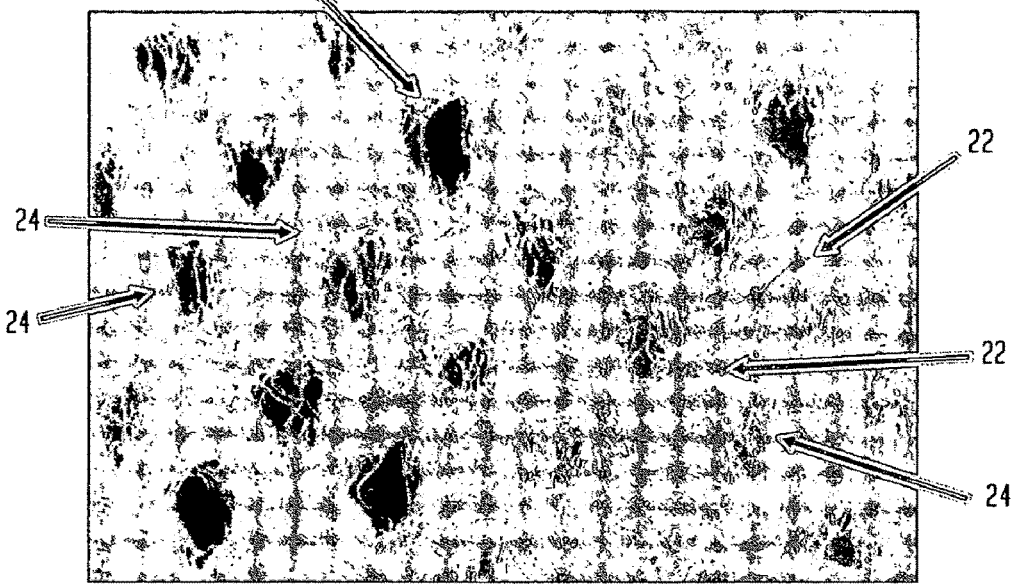
FIG. 11 is a photomicrograph showing a web having a basis weight of 19 lbs/ream produced with a 40% Fabric Crepe.
Figure 12:
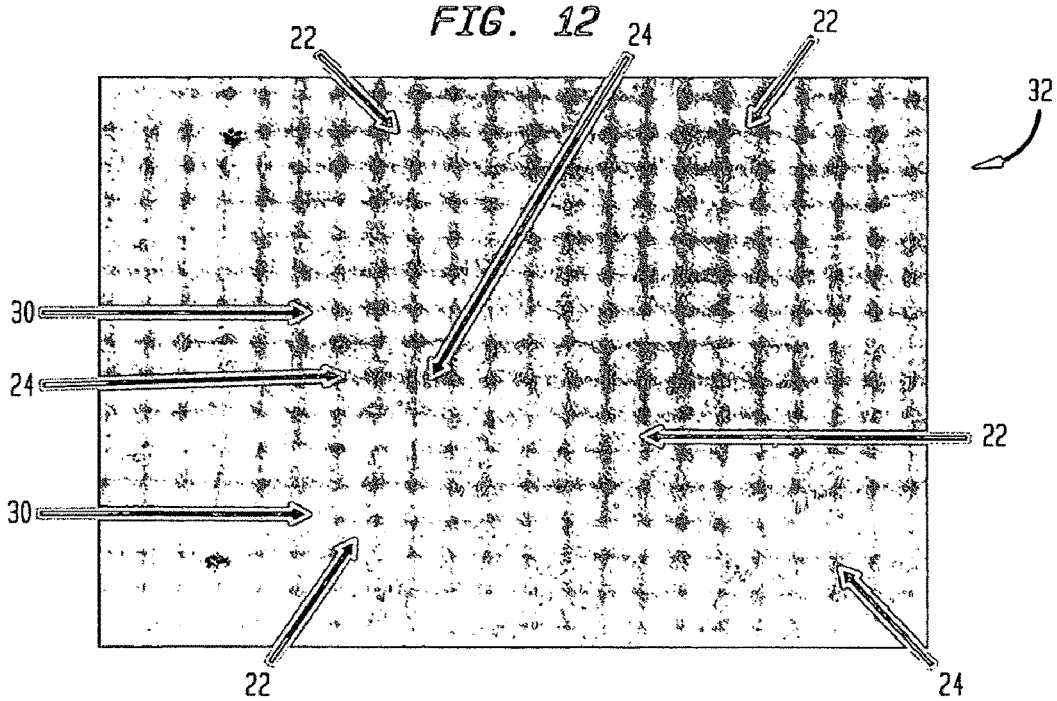
FIG. 12 is a photomicrograph showing a web having a basis weight of 27 lbs/ream produced with a 28% Fabric Crepe.
Figure 19:
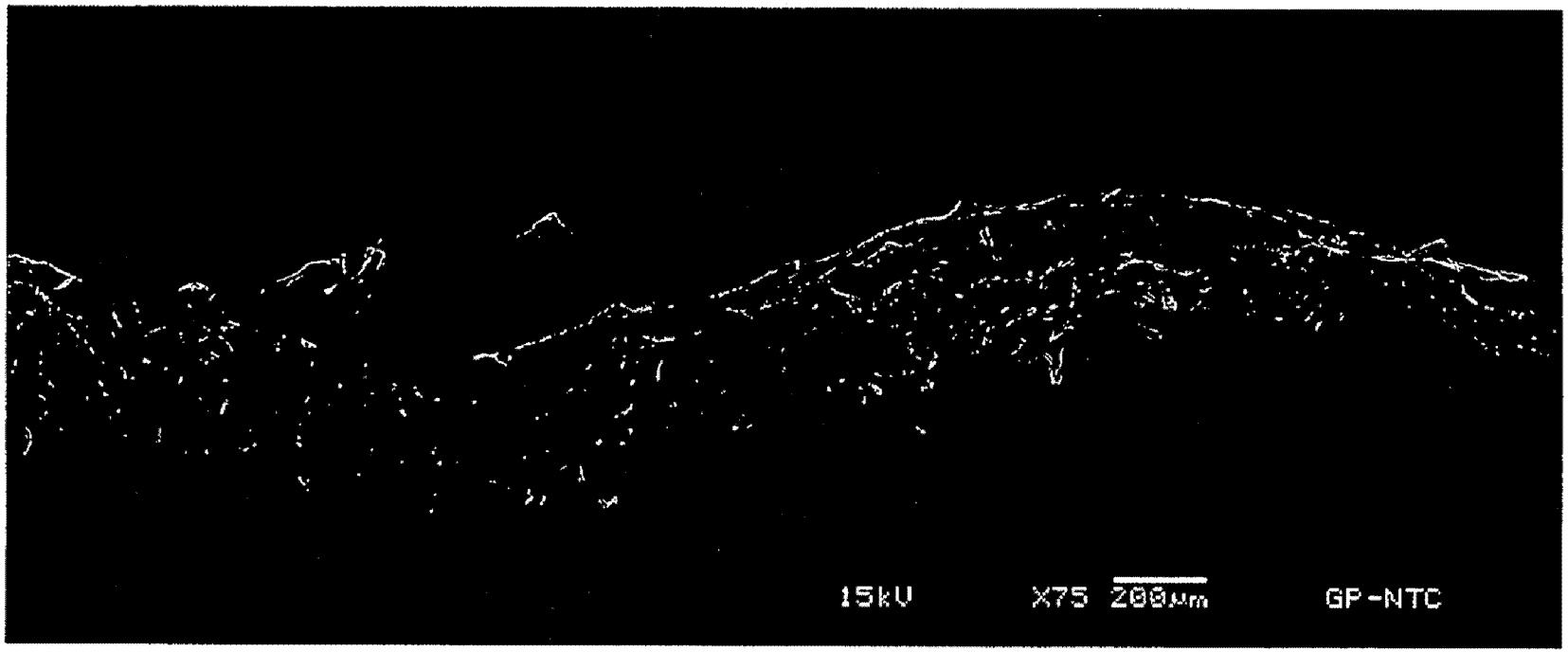
FIGS. 19 and 20 are SEMs of the sheet shown in FIG. 13 in section along the MD.
Figure 22:
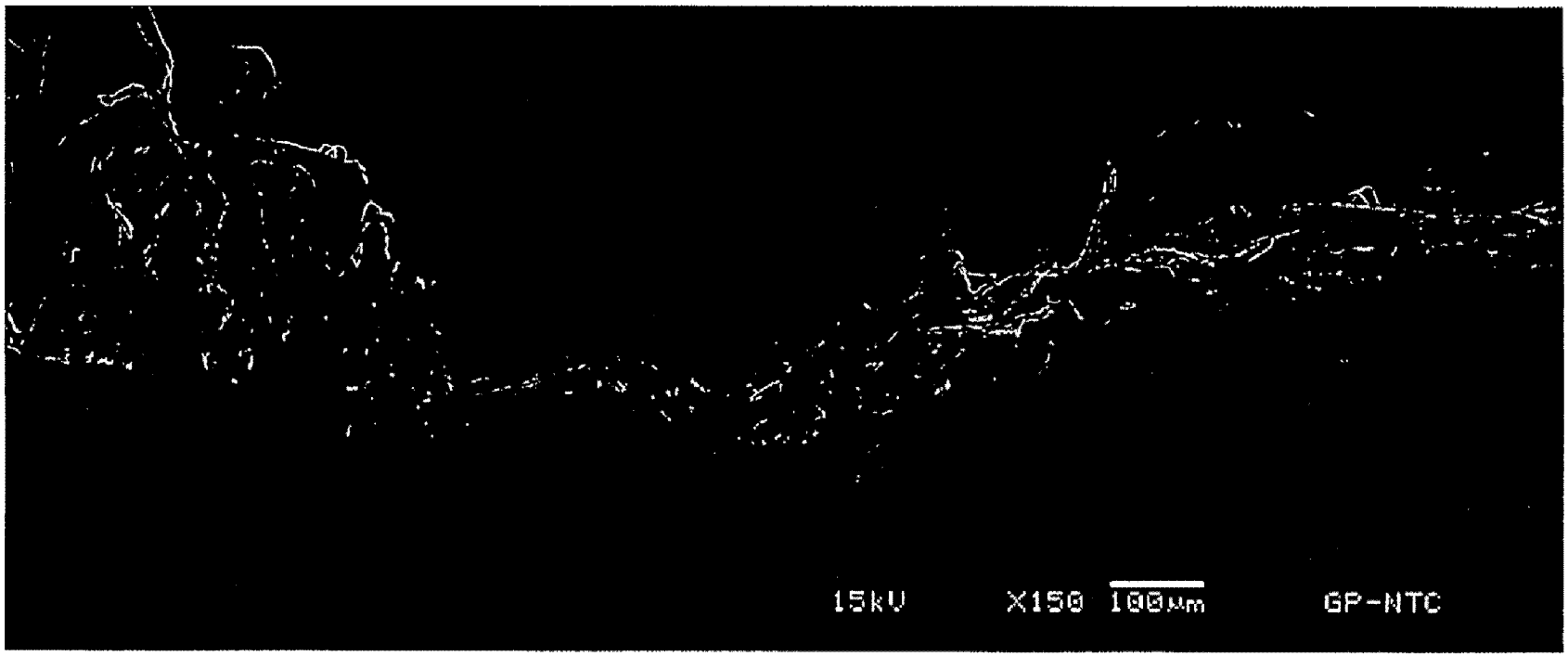

While the structure including the pileated and reoriented regions is easily observed in open meshed embodiments of very low basis weight, the ordered structure of the products of the invention is likewise seen when basis weight is increased where integument regions of fiber 30 span the pileated and linking regions, as is seen in FIGS. 10 through 12, so that a sheet 32 is provided with substantially continuous surfaces, as is seen particularly in FIGS. 19 and 22, where the darker regions are lower in basis weight, while the almost solid white regions are relatively compressed fiber.

The impact of processing variables, and so forth, is also appreciated from FIGS. 10 through 12. FIGS. 10 and 11 both show a 19 lb sheet; however, the pattern in terms of variation in basis weight is more prominent in FIG. 11, because the Fabric Crepe was much higher (40% vs. 17%). Likewise, FIG. 12 shows a higher basis weight web (27 lb) at 28% crepe where the pileated, linking and integument regions are all prominent.

Redistribution of fibers from a generally random arrangement into a patterned distribution including orientation bias, as well as fiber-enriched regions corresponding to the creping fabric structure, is still further appreciated by reference to FIGS. 13 through 24.

Figure 13:
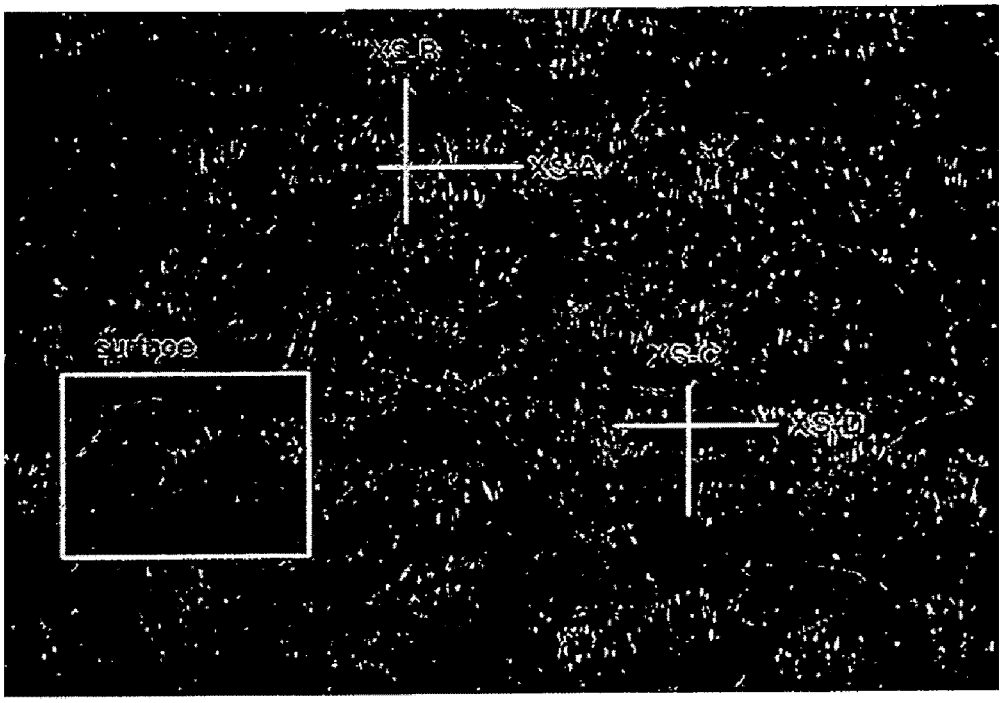
FIG. 13 is a surface image (10×) of an absorbent sheet, indicating areas where samples for surface and section scanning electron micrographs (SEMs) were taken.
Figure 14:
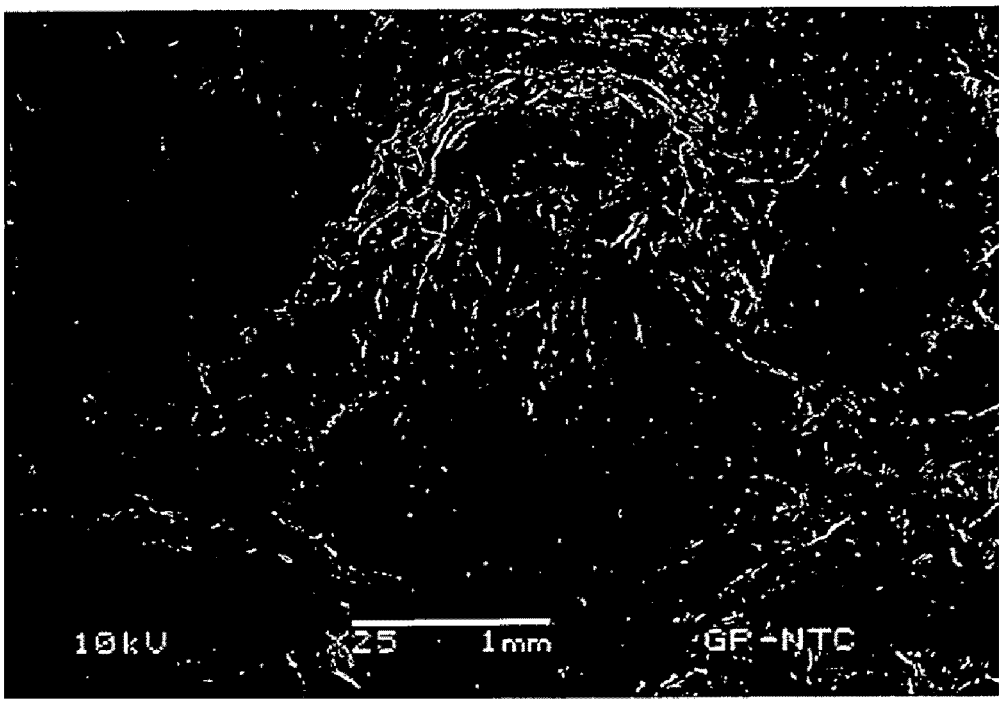
FIGS. 14-16 are surface SEMs of a sample of material taken from the sheet seen in FIG. 13.
Figure 15:
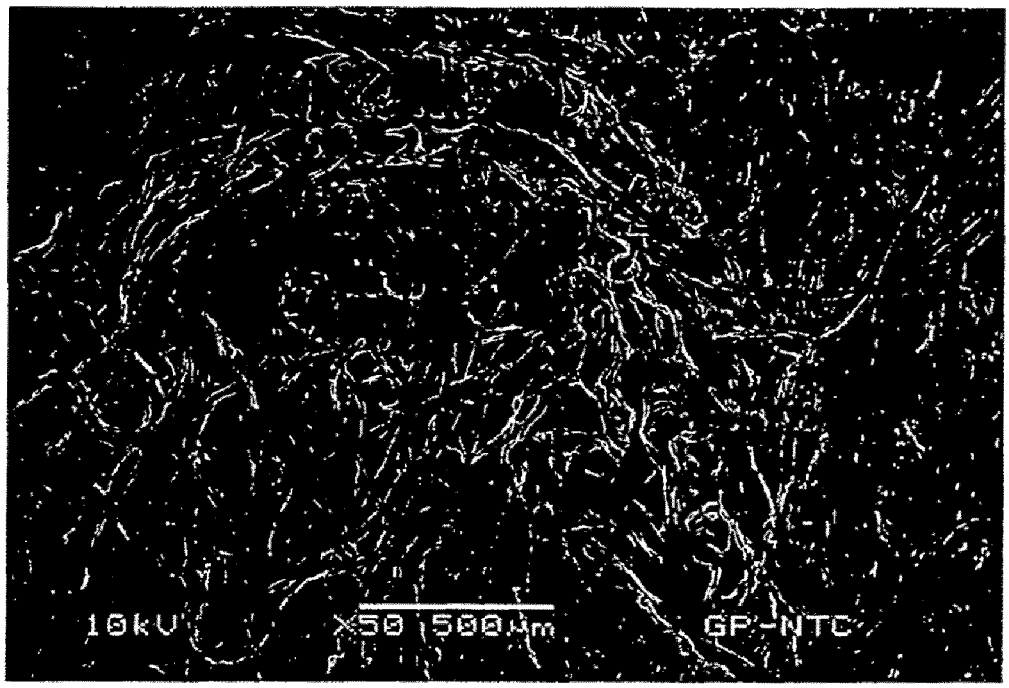
Figure 16:
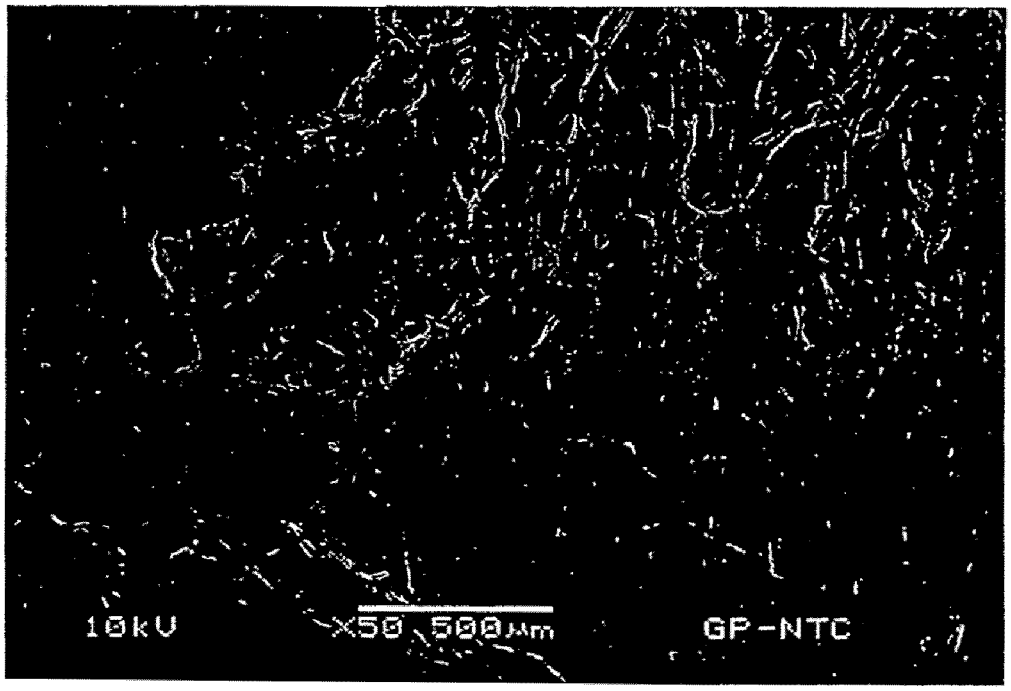

FIG. 13 is a photomicrograph (10×) showing a cellulosic web from which a series of samples was prepared and scanning electron micrographs (SEMs) made to further show the fiber structure. On the left of FIG. 13 is shown a surface area from which the SEM surface images 14, 15 and 16 were prepared. It is seen in these SEMs that the fibers of the linking regions have an orientation biased along their direction between pileated regions, as was noted earlier in connection with the photomicrographs. It is further seen in FIGS. 14, 15 and 16 that the integument regions formed have a fiber orientation along the machine direction. The feature is illustrated rather strikingly in FIGS. 17 and 18.

Figure 17:
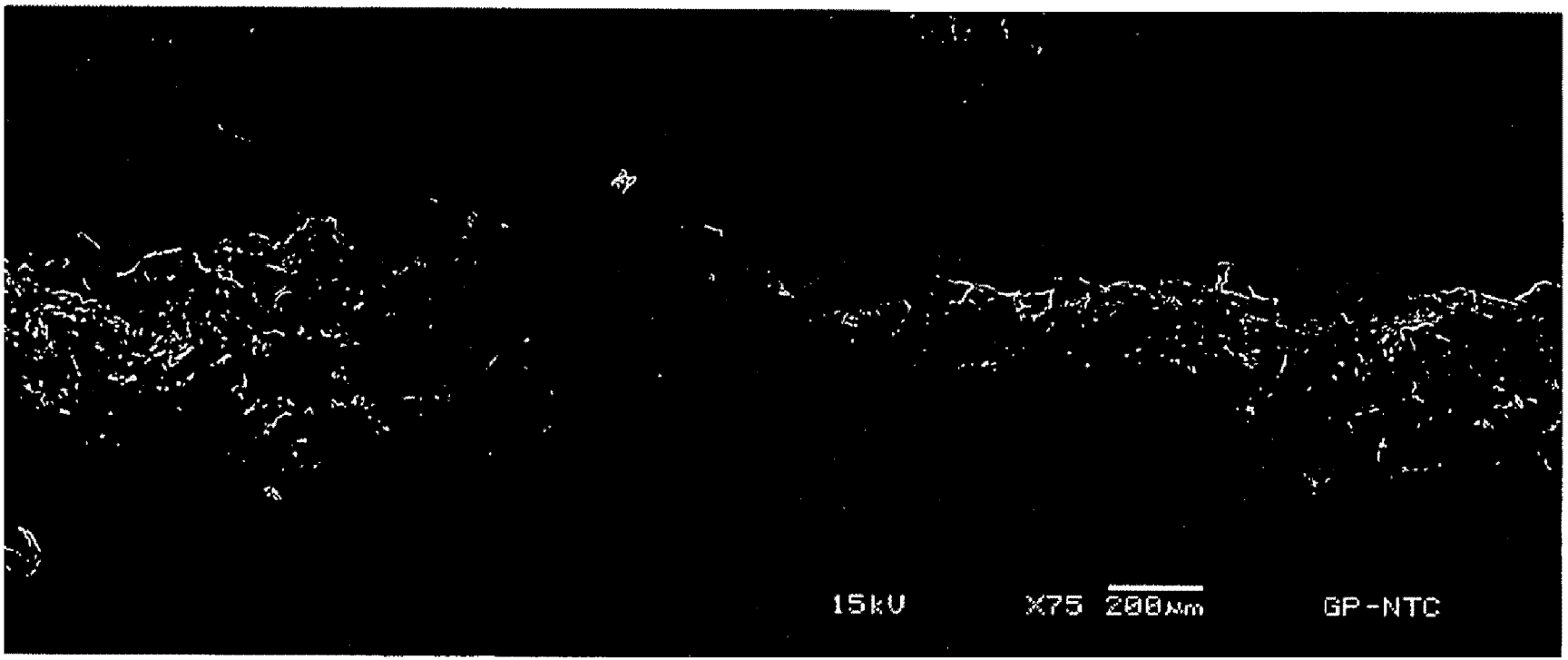
FIGS. 17 and 18 are SEMs of the sheet shown in FIG. 13 in section across the MD.
Figure 18:
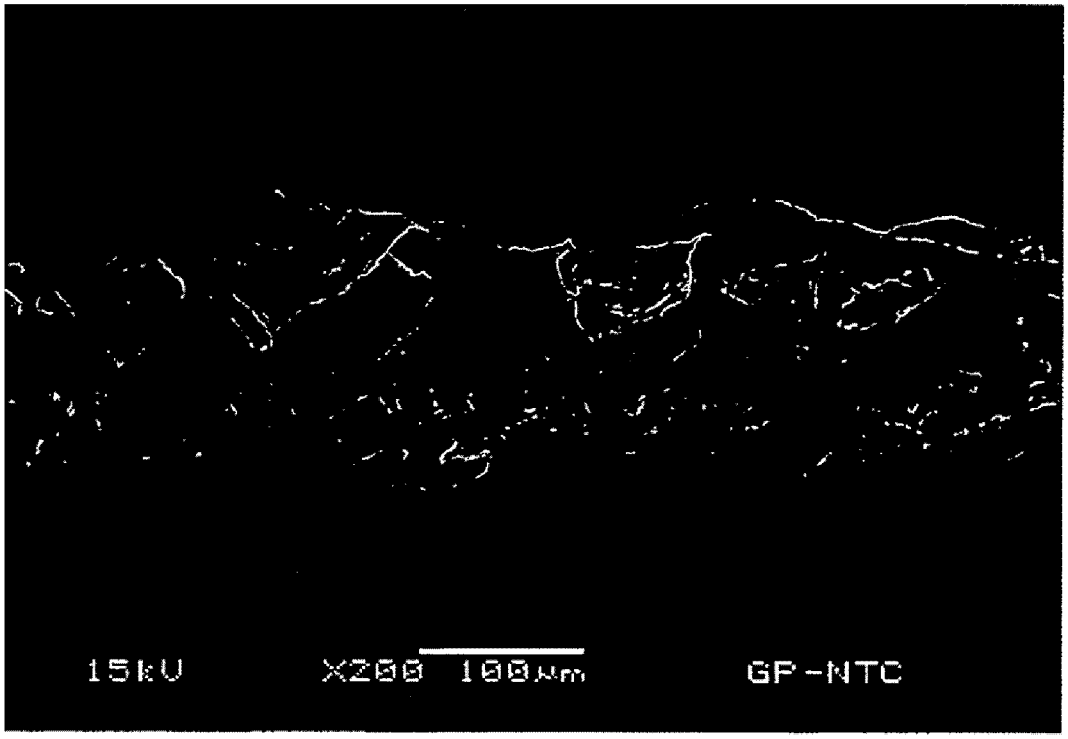

FIGS. 17 and 18 are views along line XS-A of FIG. 13, in section. It is seen especially at 200× magnification (FIG. 18) that the fibers are oriented toward the viewing plane, or machine direction, inasmuch as the majority of the fibers were cut when the sample was sectioned.

Figure 20:
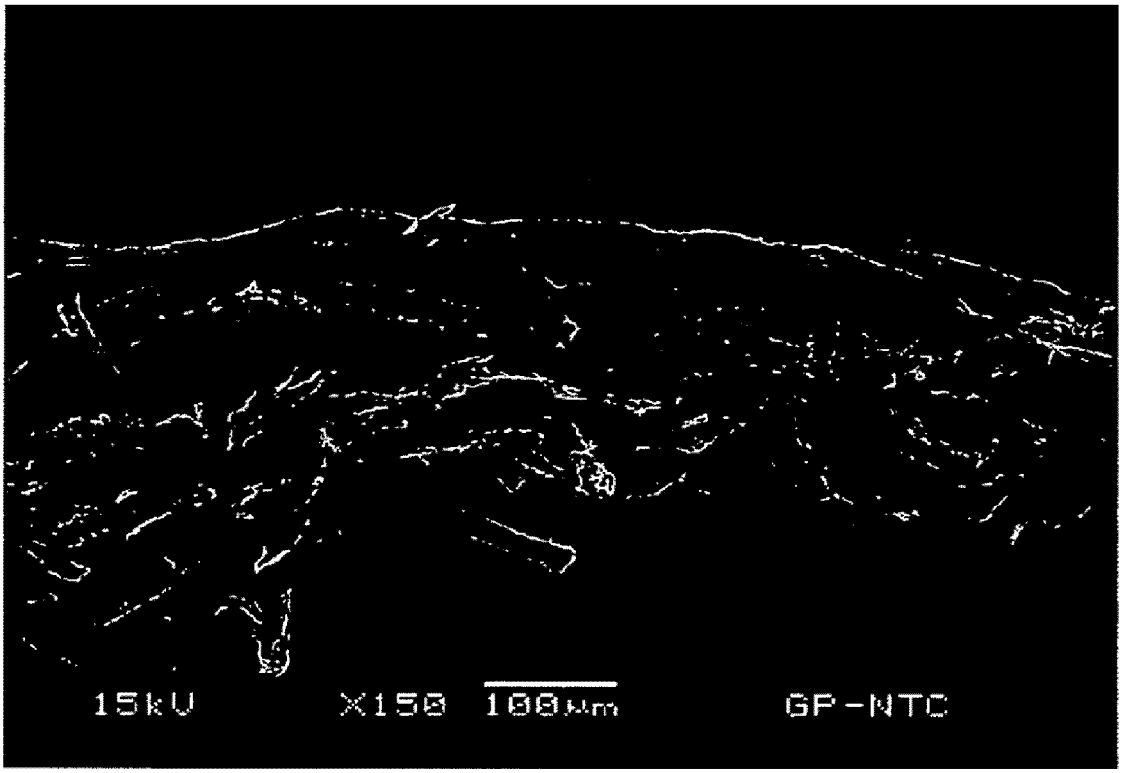

FIGS. 19 and 20, a section along line XS-B of the sample of FIG. 13, shows fewer cut fibers, especially at the middle portions of the photomicrographs, again showing an MD orientation bias in these areas. Note in FIG. 19, U-shaped folds are seen in the fiber-enriched area to the left.

Figure 21:
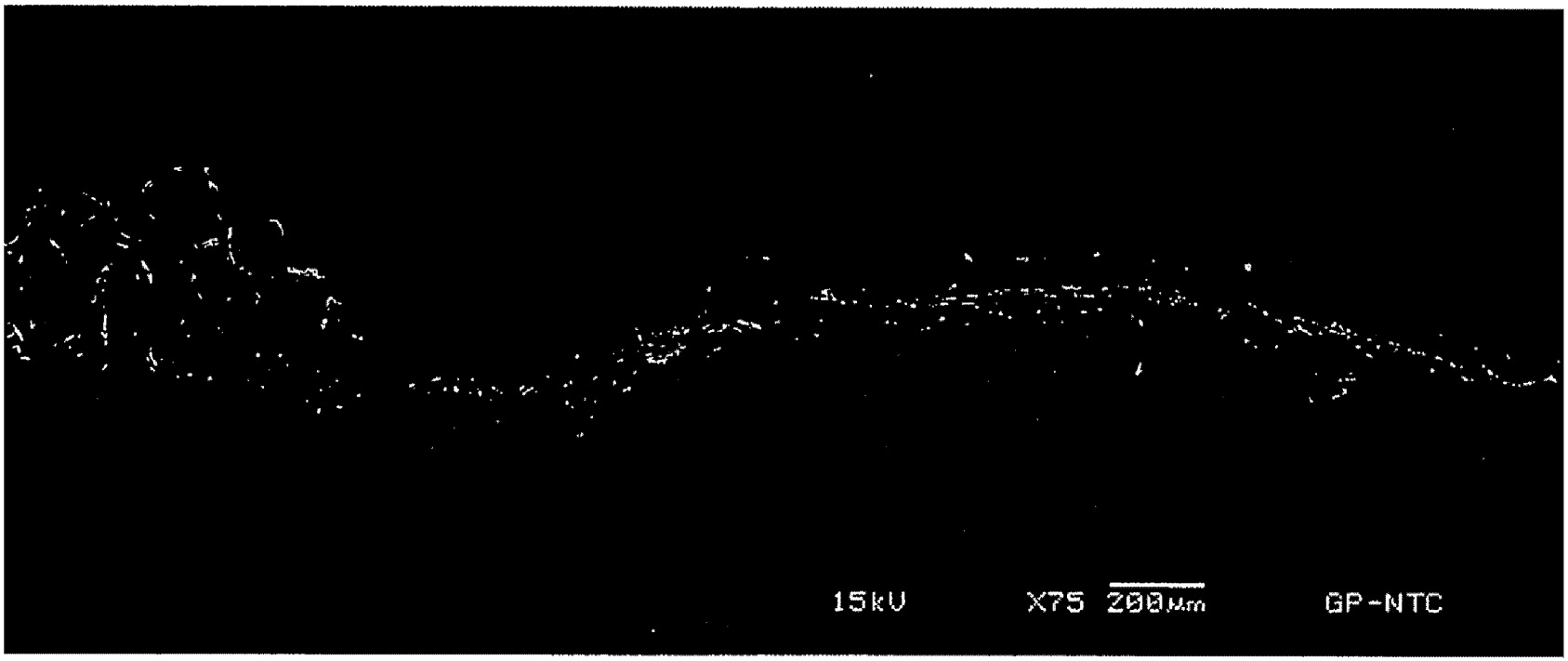
FIGS. 21 and 22 are SEMs of the sheet shown in FIG. 13 in section, also along the MD.

FIGS. 21 and 22 are SEMs of a section of the sample of FIG. 13 along line XS-C. It is seen in these Figures that the pileated regions (left side) are "stacked up" to a higher local basis weight. Moreover, it is seen in the SEM of FIG. 22 that a large number of fibers have been cut in the pileated region (left) showing reorientation of the fibers in this area in a direction transverse to the MD, in this case, along the CD. Also noteworthy is that the number of fiber ends observed diminishes as one moves from left to right, indicating orientation toward the MD as one moves away from the pileated regions.

Figure 23:
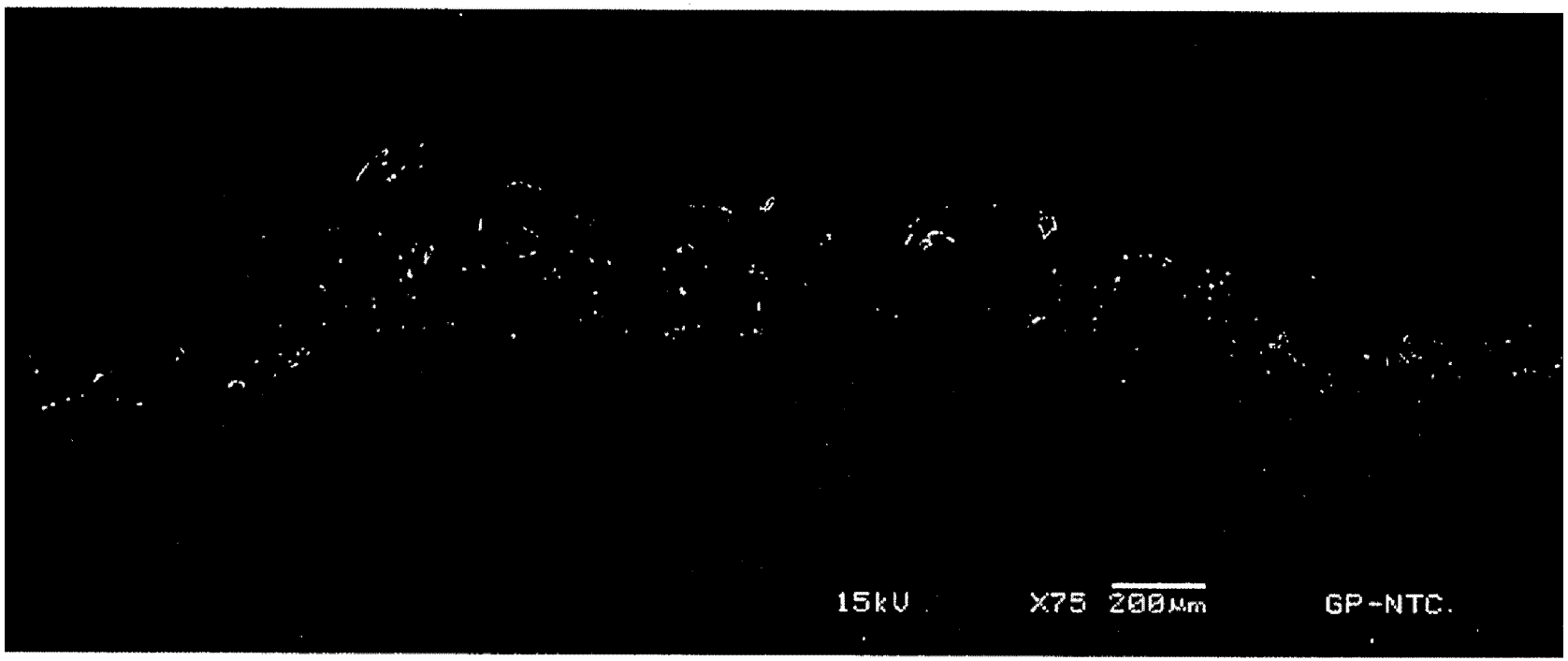
FIGS. 23 and 24 are SEMs of the sheet shown in FIG. 13 in section across the MD.
Figure 24:
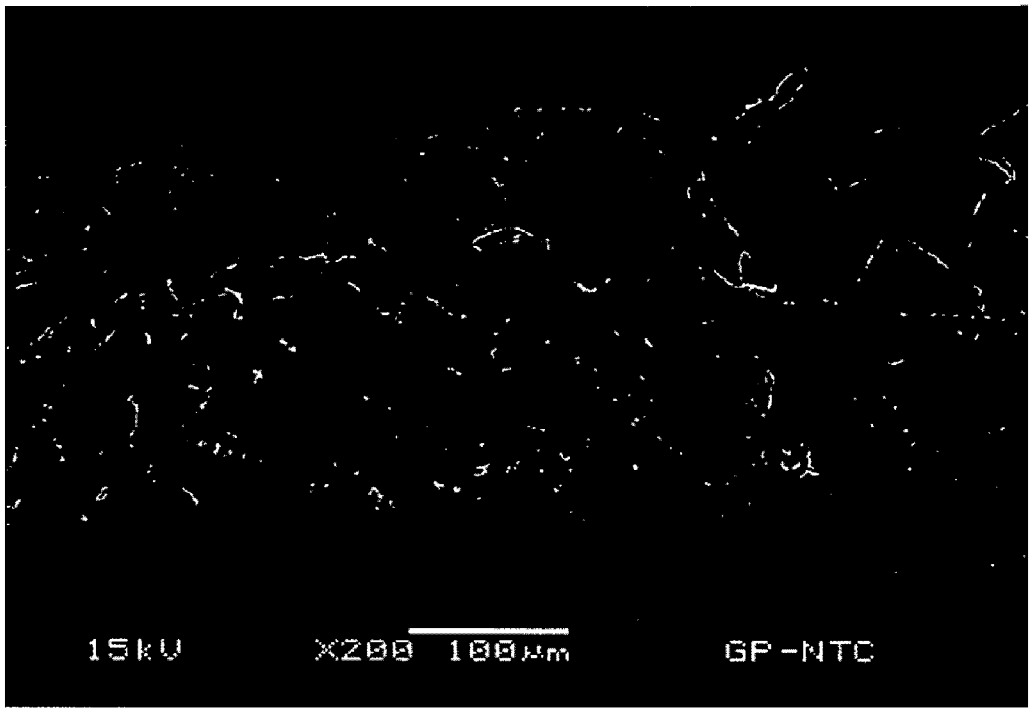

FIGS. 23 and 24 are SEMs of a section taken along the XS-D of FIG. 13. Here, it is seen that fiber orientation bias changes as one moves across the CD. On the left, in a linking or colligating region, a large number of "ends" are seen indicating MD bias. In the middle, there are fewer ends as the edge of a pileated region is traversed, indicating more CD bias until another linking region is approached and cut fibers again become more plentiful, again indicating increased MD bias.

The desired redistribution of fiber is achieved by an appropriate selection of consistency, fabric or fabric pattern, nip parameters, and velocity delta, the difference in speed between the transfer surface and creping fabric. Velocity deltas of at least 100 fpm, 200 fpm, 500 fpm, 1000 fpm, 1500 fpm or even in excess of 2000 fpm may be needed under some conditions to achieve the desired redistribution of fiber and combination of properties, as will become apparent from the discussion that follows. In many cases, velocity deltas of from about 500 fpm to about 2000 fpm will suffice. Forming the nascent web, for example, control of a headbox jet and forming wire or fabric speed is likewise important in order to achieve the desired properties of the product, especially, MD/CD tensile ratio. Likewise, drying may be carried out while preserving the drawable reticulum of the web, especially if it is desired to increase bulk substantially by drawing the web. It is seen in the discussion that follows that the following salient parameters are selected or controlled in order to achieve a desired set of characteristics in the product: consistency at a particular point in the process (especially at fabric crepe), fabric pattern, fabric creping nip parameters, fabric crepe ratio, velocity deltas, especially transfer surface/creping fabric and headbox jet/forming wire, and post fabric-crepe handling of the web. The products of the invention are compared with conventional products in Table 2 below.

TABLE 2

Comparison of Typical Web Properties

| Property | Conventional Wet Press | Conventional Throughdried | High Speed Fabric Crepe |
|---|---|---|---|
| SAT g/g | 4 | 10 | 6-9 |
| *Caliper | 40 | 120+ | 50-115 |
| MD/CD Tensile | >1 | >1 | <1 |
| CD Stretch (%) | 3-4 | 7-15 | 5-15 |

*mils/8 sheet

FIG. 25 is a schematic diagram of a papermachine 40 having a conventional twin wire forming section 42, a felt run 44, a shoe press section 46, a creping fabric 48 and a Yankee drying 50 suitable for practicing the present invention. Forming section 42 includes a pair of forming fabrics 52, 54 supported by a plurality of rolls 56, 58, 60, 62, 64, 66 and a forming roll 68. A headbox 70 provides papermaking furnish issuing therefrom as a jet in the machine direction to a nip 72 between forming roll 68 and roll 56 and the fabrics. The furnish forms a nascent web 74, which is dewatered on the fabrics with the assistance of a vacuum, for example, by way of vacuum box 76.

The nascent web is advanced to a papermaking felt 78, which is supported by a plurality of rolls 80, 82, 84, 85, and the felt is contact with a shoe press roll 86. The web is a of low consistency as it is transferred to the felt. Transfer may be assisted by a vacuum, for example, roll 80 may be a vacuum roll if so desired or a pickup or vacuum shoe as is known in the art. As the web reaches the shoe press roll, it may have a consistency of 10-25 percent, preferably, 20 to 25 percent or so as it enters nip 88 between the shoe press roll 86 and transfer roll 90. Transfer roll 90 may be a heated roll if so desired. Instead of a shoe press roll, roll 86 could be a conventional suction pressure roll. If a shoe press is employed, it is desirable and preferred that roll 84 be a vacuum roll effective to remove water from the felt prior to the felt entering the shoe press nip, since water from the furnish will be pressed into the felt in the shoe press nip. In any case, using a vacuum roll at 84 is typically desirable to ensure that the web remains in contact with the felt during the direction change as one of skill in the art will appreciate from the diagram.

Web 74 is wet-pressed on the felt in nip 88 with the assistance of pressure shoe 92. The web is thus compactively dewatered at nip 88, typically, by increasing the consistency by 15 or more points at this stage of the process. The configuration shown at nip 88 is generally termed a shoe press; in connection with the present invention, cylinder 90 is operative as a transfer cylinder that operates to convey web 74 at high speed, typically, 1000 fpm-6000 fpm, to the creping fabric.

Cylinder 90 has a smooth surface 94, which may be provided with adhesive and/or release agents if needed. Web 74 is adhered to transfer surface 94 of cylinder 90, which is rotating at a high angular velocity as the web continues to advance in the machine-direction, indicated by arrows 96. On the cylinder, web 74 has a generally random apparent distribution of fiber.

Direction 96 is referred to as the machine-direction (MD) of the web, as well as that of papermachine 40; whereas the cross-machine-direction (CD) is the direction in the plane of the web perpendicular to the MD.

Web 74 enters nip 88, typically at consistencies of 10-25 percent or so, and is dewatered and dried to consistencies of from about 25 to about 70 by the time it is transferred to creping fabric 48, as shown in the diagram.

Fabric 48 is supported on a plurality of rolls 98, 100, 102 and a press nip roll 104 and forms a fabric crepe nip 106 with transfer cylinder 90 as shown.

The creping fabric defines a creping nip over the distance in which creping fabric 48 is adapted to contact roll 90; that is, applies significant pressure to the web against the transfer cylinder. To this end, backing (or creping) roll 100 may be provided with a soft deformable surface that will increase the length of the creping nip and increase the fabric creping angle between the fabric and the sheet, and the point of contact or a shoe press roll could be used as roll 100 to increase effective contact with the web in high impact fabric creping nip 106 where web 74 is transferred to fabric 48 and advanced in the machine-direction. By using different equipment at the creping nip, it is possible to adjust the fabric creping angle or the takeaway angle from the creping nip. Thus, it is possible to influence the nature and amount of redistribution of fiber, delamination/debonding which may occur at a fabric creping nip 106 by adjusting these nip parameters. In some embodiments, it may be desirable to restructure the z-direction inter-fiber characteristics; while in other cases, it may be desired to influence properties only in the plane of the web. The creping nip parameters can influence the distribution of fiber in the web in a variety of directions, including inducing changes in the z-direction, as well as the MD and CD. In any case, the transfer from the transfer cylinder to the creping fabric is high impact in that the fabric is traveling slower than the web, and a significant velocity change occurs. Typically, the web is fabric creped anywhere from 10-60 percent and higher (200-300%) during transfer from the transfer cylinder to the fabric.

Creping nip 106 generally extends over a fabric creping nip distance of anywhere from about ⅛" to about 2", typically, ½" to 2". For a creping fabric with 32 CD strands per inch, web 74 thus will encounter anywhere from about 4 to 64 weft filaments in the nip.

The nip pressure in nip 106, that is, the loading between backing roll 100 and transfer roll 90 is suitably 20-200, preferably, 40-70 pounds per linear inch (PLI).

After fabric creping, the web continues to advance along MD 96 where it is wet-pressed onto Yankee cylinder 110 in transfer nip 112. Transfer at nip 112 occurs at a web consistency of generally from about 25 to about 70 percent. At these consistencies, it is difficult to adhere the web to surface 114 of cylinder 110 firmly enough to remove the web from the fabric thoroughly. This aspect of the process is important, particularly, when it is desired to use a high velocity drying hood as well as to maintain high impact creping conditions.

In this connection, it is noted that conventional TAD processes do not employ high velocity hoods, since sufficient adhesion to the Yankee is not achieved.

It has been found, in accordance with the present invention, that the use of particular adhesives cooperate with a moderately moist web (25-70 percent consistency) to adhere it to the Yankee sufficiently to allow for high velocity operation of the system and high jet velocity impingement air drying. In this connection, a poly(vinyl alcohol)/polyamide adhesive composition, as noted above, is applied at 116 as needed.

The web is dried on Yankee cylinder 110, which is a heated cylinder and by high jet velocity impingement air in Yankee hood 118. As the cylinder rotates, web 74 is creped from the cylinder by creping doctor 119 and wound on a take-up roll 120. Creping of the paper from a Yankee dryer may be carried out using an undulatory creping blade, such as that disclosed in U.S. Pat. No. 5,690,788, the disclosure of which is incorporated by reference. Use of the undulatory crepe blade has been shown to impart several advantages when used in production of soft tissue products. In general, tissue products creped using an undulatory blade have higher caliper (thickness), increased CD stretch, and a higher void volume than do comparable tissue products produced using conventional crepe blades. All of these changes effected by use of the undulatory blade tend to correlate with improved softness perception of the tissue products.

When a wet-crepe process is employed, an impingement air dryer, a through-air dryer, or a plurality of can dryers can be used instead of a Yankee dryer. Impingement air dryers are disclosed in the following patents and applications, the disclosures of which are incorporated herein by reference:

U.S. Pat. No. 5,865,955 to Ilvespaaet et al.

U.S. Pat. No. 5,968,590 to Ahonen et al.

U.S. Pat. No. 6,001,421 to Ahonen et al.

U.S. Pat. No. 6,119,362 to Sundqvist et al.

U.S. patent application Ser. No. 09/733,172, entitled Wet Crepe,

Impingement-Air dry Process for Making Absorbent Sheet, now U.S. Pat. No. 6,432,267.

A throughdrying unit is well known in the art and described in U.S. Pat. No. 3,432,936 to Cole et al., the disclosure of which is incorporated herein by reference, as is that of U.S. Pat. No. 5,851,353, which discloses a can-drying system.

Figure 26:
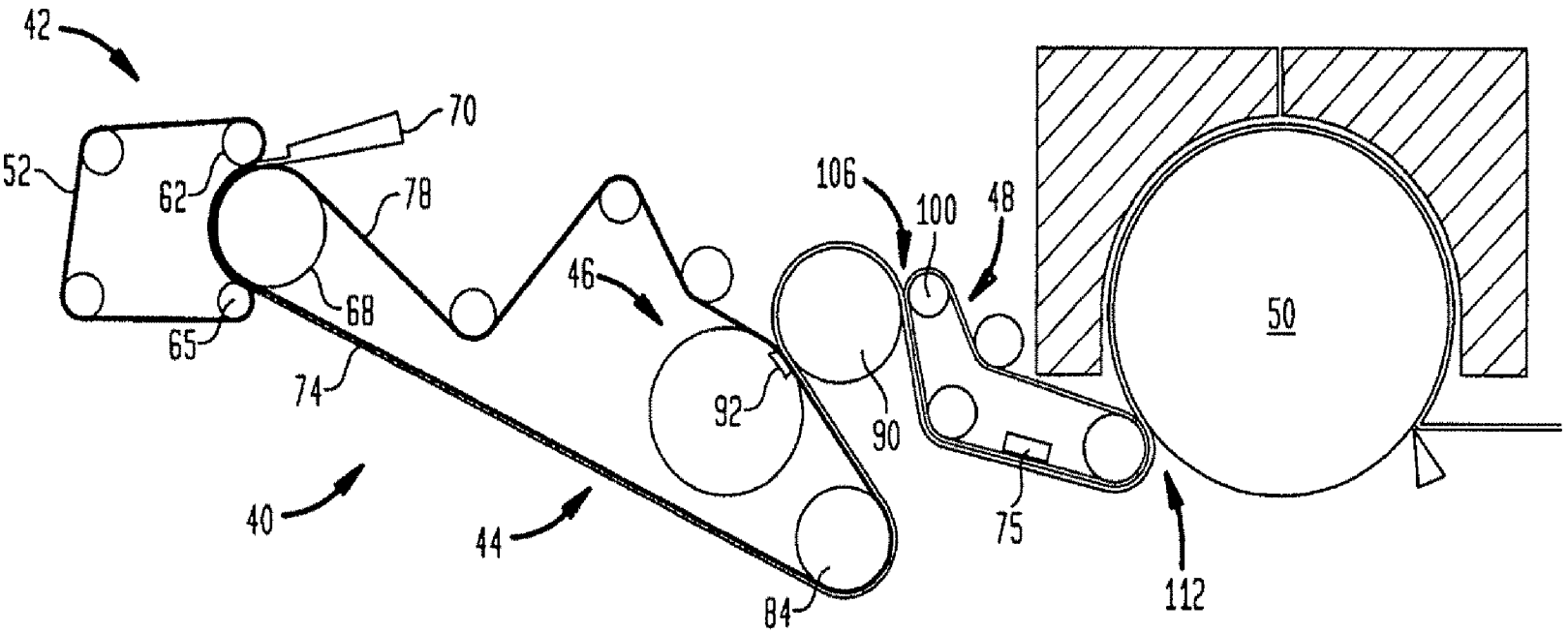
FIG. 26 is a schematic diagram of another paper machine for practicing the process of the present invention.

FIG. 26 shows a preferred papermachine 40 for use in connection with the present invention. Papermachine 40 is a three fabric loop machine having a forming section 42 generally referred to in the art as a crescent former. Forming section 42 includes a forming wire 52 supported by a plurality of rolls such as rolls 62, 65. The forming section also includes a forming roll 68, which supports paper making felt 78, such that web 74 is formed directly on felt 78. Felt run 44 extends to a shoe press section 46, wherein the moist web is deposited on a transfer roll 90 as described above. Thereafter, web 74 is creped onto fabric in fabric crepe nip between rolls 90, 100 before being deposited on Yankee dryer in another press nip 112. A vacuum is optionally applied by vacuum box 75 as the web is held in fabric. Headbox 70 and press shoe 92 operate as noted above in connection with FIG. 25. The system includes a vacuum turning roll 84, in some embodiments; however, the three loop system may be configured in a variety of ways, wherein a turning roll is not necessary. This feature is particularly important in connection with the rebuild of a papermachine, inasmuch as the expense of relocating associated equipment, i.e., pulping or fiber processing equipment and/or the large and expensive drying equipment, such as the Yankee dryer or plurality of can dryers, would make a rebuild prohibitively expensive, unless the improvements could be configured to be compatible with the existing facility.

Figure 27:
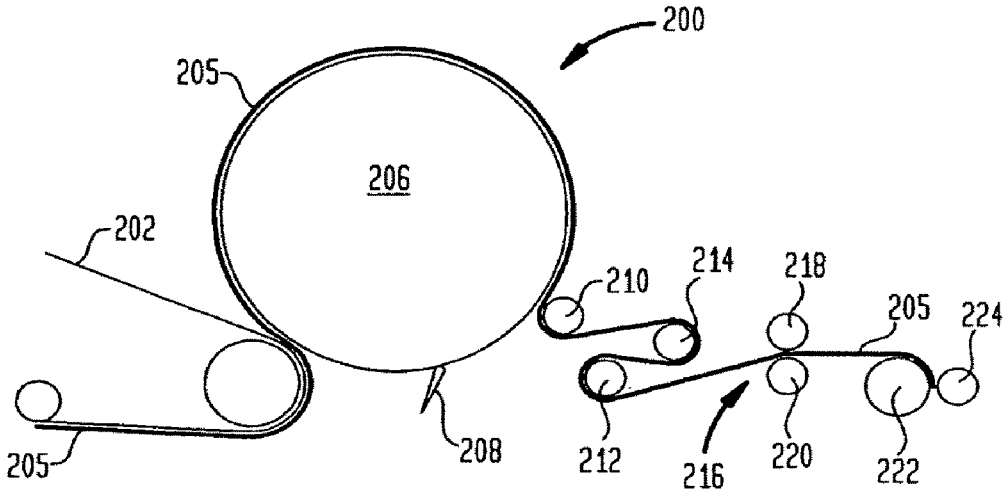
FIG. 27 is a schematic diagram of a portion of still yet another paper machine for practicing the process of the present invention.

FIG. 27 schematically shows a portion of a paper machine 200. Paper machine 200 is provided with a forming and fabric creping section, as described above, wherein a web 205 is fabric-creped onto a creping fabric 202. Web 205 is transferred from the creping fabric to a Yankee dryer 206. Rather than being creped from the Yankee dryer, the web is transferred off the dryer at sheet control 210. The web is then fed to a pair of draw rolls 212, 214, as described in more detail hereafter. There is optionally provided a calendering station 216 having a pair of calender rolls 218 220. Web 205 is thus calendered on line before being wound onto reel 224 over guide roll 222.

In order to achieve the advantages of the invention, it is believed that high fabric crepe ratios should be practiced at the creping section. The sheet so made may then be attached to a Yankee dryer as shown generally in FIG. 27, but with a special adhesion system explained in more detail hereafter. The sheet is preferably dried to the desired dryness on the Yankee cylinder. Instead of creping the sheet off the cylinder, a relatively small diameter control roll 210 is located very close to, and optionally touching, the Yankee dryer. This relatively smaller diameter roll controls the sheet pull off angle so that the sheet does not dance up and down on the dryer surface. The smaller the diameter, the sharper the take off angle, and the sharper the take off angle, the less tension is required in the machine direction of the sheet to break the adhesion of web 205 to Yankee dryer 206. The sheet may subsequently be taken through a pull out section where a major portion of the fabric crepe provided to the web in the creping section is removed from the sheet. This stretching or drawing of the web opens up the plies of fiber that tend to build up ahead of the creping knuckle, thereby improving the absorptive properties of the sheet, as well as the tactile properties. The sheet or web can then be calendered to reduce two-sidedness and to maintain the desired caliper properties. As shown in FIG. 27, calendering is preferably done on line.

Figure 28A:
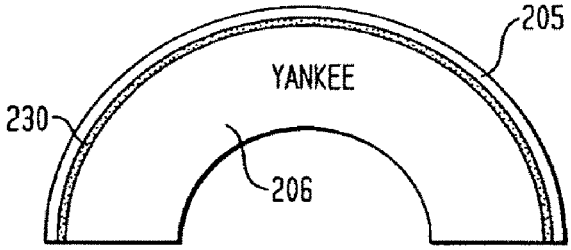
FIGS. 28A and 28B are schematic diagrams illustrating an adhesive and protecting coating for use in connection with the present invention.
Figure 28B:
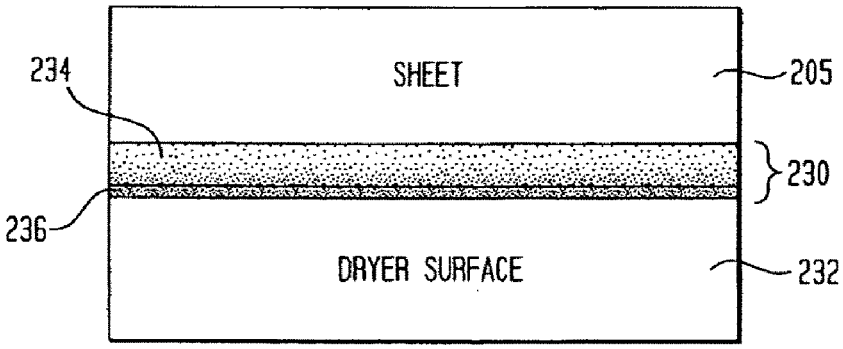

It will be appreciated by those of skill in the art that the overall process is exceedingly efficient as the wet end may be run very fast as compared with the Yankee dryer, and the reel can also be run considerably faster than the Yankee dryer. The slow Yankee dryer speeds mean that more efficient drying of heavy weight sheets can be readily achieved with the apparatus of the present invention. Referring to FIGS. 28A and 28B, a preferred adhesive system for use with the present invention is schematically shown. FIG. 28A is a schematic profile of a Yankee dryer, such as a Yankee dryer 206, wherein an adhesive layer 230 is provided under web 205. FIG. 28B is an enlarged view showing the various layers of FIG. 28A. The Yankee dryer surface is indicated as 232, while the web is indicated at 205. Adhesive layer 230 includes soft adhesive 234, as well as a dryer protection layer 236.

For the process of the invention to be operated in preferred embodiments, the dryer coating should have the following characteristics.

Because the sheet has been embedded into the creping fabric at the creping fabric step, the adhesive needs to exhibit considerable wet tack properties in order to effectively transfer the web from the creping fabric to the Yankee dryer. For this reason, the creping process of the present invention generally requires an adhesive with high wet tact, such as PVOH, to be used in the adhesive mix. However, PVOH, while exhibiting high wet tact, also exhibits very high dry adhesion levels, requiring the use of a creping blade to remove the dried sheet from the dryer surface. For the process of FIG. 27 to run, the sheet must be drawn off the dryer surface without excessively pulling the stretch out of the sheet, destroying the integrity of the web or breaking the sheet at defect points. Therefore, this adhesive level, described as soft adhesive must be aggressive in tacking the wet sheet to the dryer surface, strong enough in holding the sheet to the dryer under the influence of high velocity drying hoods, but at the removal point, the adhesive must exhibit sufficient release characteristics so the desired sheet properties are preserved. That is to say, the nature of the drawable fiber reticulum should be preserved. It is believed that the adhesive must exhibit: high wet tack and low dry adhesion to the sheet, cohesive internal strength much greater than the dried paper adhesion strength, so that bits of adhesive do not leave with the sheet, and very high dry adhesion to the dryer surface. The dryer protection layer should have very high dry adhesion to the dryer surface. In normal operations, a creping blade is required to start the sheet in the winding process before it can be pulled off the dryer surface. During this time, care must be taken to prevent the blade from damaging the dryer surface or removing the adhesive coating. This can be accomplished with the nature of these coating materials by using a soft, non-metallic creping blade for sheet starting. The dryer protection layer is applied and cured prior to the drying being used to dry paper. This layer can be applied after a dryer grind or after thoroughly cleaning the old coatings off the dryer surface. This coating is usually a polyamide based, cross linkable material that is applied and then cured with heat prior to start up.

Figure 29A:
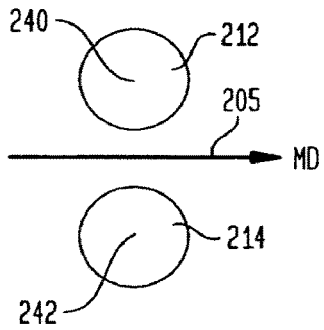
FIGS. 29A and 29B are schematic diagrams illustrating draw rolls that can be used in connection with the paper machine of FIG. 27.
Figure 29B:
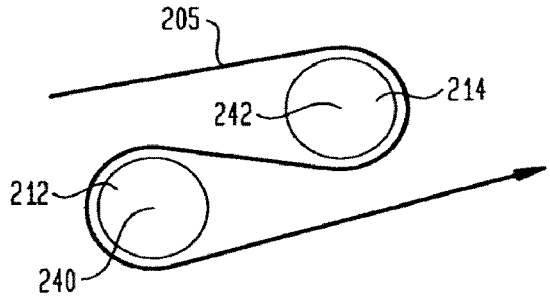

FIGS. 29A and 29B are schematic diagrams showing the starting and operating configuration of draw rolls 212 and 214. The draw rolls are mounted on moveable axles at 240 and 242, respectively. During start up, rolls 212 and 214 are generally disposed in opposing relationship on either side of web 205. The configuration shown is particularly convenient for threading web 205. Once threaded, the rolls are rotated upwards of 270 E so that the sheet will wrap around the two rolls sufficiently, so the sheet can be gripped and pulled out by each of the driven rolls. The operational configuration is shown in FIG. 29B, where the rolls run at speeds that are above the speeds of Yankee dryer. Roll 214 is run at speeds slightly faster than the Yankee dryer, so that the sheet can be pulled off the Yankee dryer and the stretching process begun. Roll 212 will run considerably faster than roll 214. Downstream of this stretch section, may be further provided calender stations where the remaining pull out will occur between the calender rolls and roll 212. It is preferable that all of the rolls are located as closely as is practical, to minimize open sheet draws as the web progresses in the machine direction.

Further refinement will be readily appreciated by those of skill in the art. For example, FIG. 30 shows a paper machine 300 substantially the same as paper machine 200, additionally provided with an embossing roll 315 provided to emboss the web shortly after it is applied to the Yankee dryer.

Figure 30:
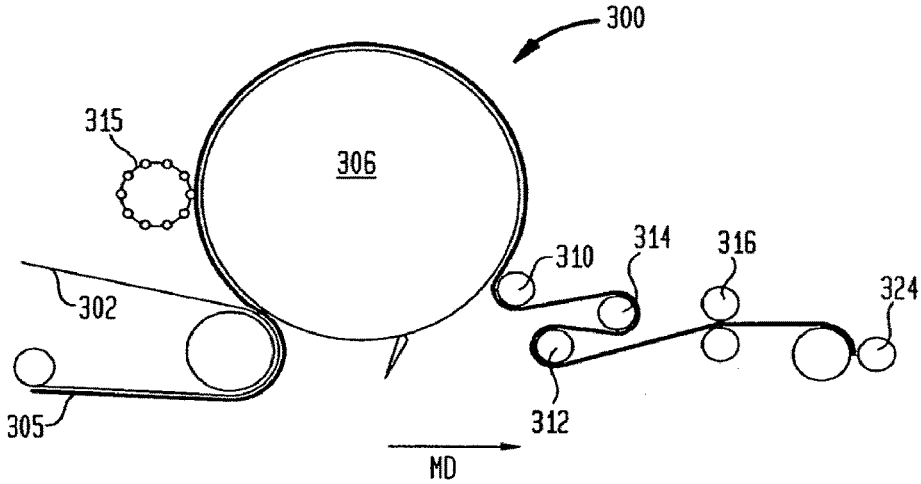
FIG. 30 is a schematic diagram of a portion of another paper machine provided with an embossing roll that embosses the web while it is adhered to the Yankee cylinder.

That is to say, FIG. 30 shows a paper machine 300 including a conventional forming section, a fabric creping section (not shown), which includes a creping fabric 302, which carries a web 305 to a Yankee dryer 306. Web 305 is transferred to the surface of Yankee dryer 306, and shortly thereafter, embossed with an embossing roll 315 as web 305 is dried. In some cases, when it is desired to peel the web from the Yankee dryer, it may be preferred to run the embossing roll and the dryer surface at a slight speed differential. Preferably, the Yankee dryer 306 is provided with an adhesive system having a Yankee protection layer and a soft layer as noted above. The web is dried on the Yankee and removed at control roll 310. The web is drawn or stretched by draw rolls 312, 314, and then calendered at 316 prior to being rolled up on reel 324.

EXAMPLES 1-8 AND EXAMPLES A-F

A series of absorbent sheets was prepared with different amounts of fabric crepe and overall crepe. In general, a 50/50 southern softwood kraft/southern hardwood kraft furnish was used with a 36*m* (M weave with CD knuckles to the sheet). Chemicals such as debonders and strength resins were not used. The fabric crepe ratio was about 1.6. The sheet was fabric creped at about 50% consistency using a line force of about 25 pli against the backing roll. Thereafter, the sheet was dried in the fabric by bringing it into contact with heated dryer cans, removed from the fabric and wound onto the reel of the papermachine. Data from these trials are designated as Examples 1-8 in Table 3, where post fabric creping draw is also specified.

Further trials were made with an apparatus using compactive dewatering, fabric creping and Yankee drying (instead of can drying) using an apparatus of the class shown in FIGS. 25 and 26, wherein the web was adhered to the Yankee cylinder with a polyvinyl alcohol containing adhesive and removed by blade creping. Data from these trials appears in Table 3 as Examples A-F.

TABLE 3

Sheet Properties
Examples 1-8; A-F

| Sample | Description | VV | Fabric Fric 1 | Fabric Fric 2 | Opp. Fric 1 | Opp. Fric 2 | Fric Ratio1 | Fric Ratio2 | Percent Draw | Basis Weight | Caliper, 1 Sheet, 0.001 in | Calc'd Bulk, cc/gram |
|---|---|---|---|---|---|---|---|---|---|---|---|---|
| 1 | Control | 5.15 | 2.379 | 2.266 | | | 2.16 | 2.74 | 0 | 19.6 | 11.5 | 9.1 |
| 2 | 15% Draw | 5.33 | 1.402 | 1.542 | | | 1.15 | 1.53 | 15 | 20.1 | 12.0 | 9.3 |
| 3 | 30% Draw | 5.45 | 2.016 | 1.662 | | | 1.83 | 1.27 | 30 | 18.4 | 11.7 | 9.9 |
| 4 | 45% Draw | 6.32 | 1.843 | 1.784 | | | 1.02 | 1.78 | 45 | 15.3 | 10.2 | 10.4 |
| 5 | Control | | | | 1.100 | 0.828 | | | 0 | | | |

TABLE 3-continued

Sheet Properties
Examples 1-8; A-F

| Sample | Description | VV | Fabric Fric 1 | Fabric Fric 2 | Opp. Fric 1 | Opp. Fric 2 | Fric Ratio1 | Fric Ratio2 | Percent Draw | Basis Weight | Caliper, 1 Sheet, 0.001 in | Calc'd Bulk, cc/gram |
|---|---|---|---|---|---|---|---|---|---|---|---|---|
| 6 | 15% Draw | | | | 1.216 | 1.011 | | | 15 | | | |
| 7 | 30% Draw | | | | 1.099 | 1.304 | | | 30 | | | |
| 8 | 45% Draw | | | | 1.815 | 1.002 | | | 45 | | | |
| A | Control | 5.727 | 1.904 | 1.730 | | | 2.13 | 1.68 | 0 | 21.6 | 14.2 | 10.3 |
| B | 10% Draw | 5.013 | 2.093 | 2.003 | | | 1.56 | 1.48 | 10 | 20.0 | 13.2 | 10.3 |
| C | 17% Draw | 4.771 | 0.846 | 0.818 | | | 0.76 | 0.84 | 17 | 19.1 | 11.4 | 9.3 |
| D | Control | | | | 0.895 | 1.029 | | | 0 | | 14.2 | |
| E | 10% Draw | | | | 1.345 | 1.356 | | | 10 | | 12.7 | |
| F | 17% Draw | | | | 1.107 | 0.971 | | | 17 | | 11.5 | |

Without intending to be bound by any theory, it is believed that if the cohesiveness of the fabric-creped, drawable reticulum of the web is preserved during drying, then drying the web will unfold or otherwise attenuate the fiber-enriched regions of the web to increase absorbency. In Table 4, it is seen that conventional wet press (CWP) and throughdried products (TAD) exhibit much less property change upon drawing than fabric creped/can-dried absorbent sheet of the invention. These results are discussed further below together with additional examples.

Following generally the procedures noted above, additional runs were made with in-fabric (can) dried and Yankee-dried basesheet. The Yankee-dried material was adhered to a Yankee dryer with a polyvinyl alcohol adhesive and blade-creped. The Yankee-dried material generally exhibits less property change upon drawing (until most of the stretch is pulled out) than did the can-dried material. This may be altered with less aggressive blade creping, so that the product behaves more like the can-dried product. Test data is summarized in Tables 5 and 12 and FIGS. 31 through 39. Fabrics tested included 44G, 44M and 36M oriented in the MD or CD. Vacuum molding with a vacuum box such as box 75 (FIG. 26) included testing with a narrow ¼" and wider 1.5" slot up to about 25" Hg vacuum.

TABLE 4

| Example | Description | Caliper 1 Sheet mils/ 1 sht | Void Volume Dry Wt g | Void Volume Wet Wt g | Void Volume Wt Inc. % | Void Volume Ratio | Void Volume grams/gram | Basis Weight lbs/3000 ft2 |
|---|---|---|---|---|---|---|---|---|
| G | TAD @ 0 | 18.8 | 0.0152 | 0.1481 | 873.970 | 4.600 | 8.74 | 14.5 |
| H | TAD @ 10% Pullout | 18.5 | 0.0146 | 0.1455 | 900.005 | 4.737 | 9.00 | 13.8 |
| I | TAD @ 15% | 17.0 | 0.0138 | 0.1379 | 902.631 | 4.751 | 9.03 | 13.1 |
| J | TAD @ 20% | 16.2 | 0.0134 | 0.1346 | 904.478 | 4.760 | 9.04 | 12.8 |
| K | CWP @ 0 | 5.2 | 0.0156 | 0.0855 | 449.628 | 2.366 | 4.50 | 14.8 |
| L | CWP @ 10% Pullout | 5.1 | 0.0145 | 0.0866 | 497.013 | 2.616 | 4.97 | 13.8 |
| M | CWP @ 15% | 5.0 | 0.0141 | 0.0830 | 488.119 | 2.569 | 4.88 | 13.4 |
| | CWP @ 20% | 4.6 | 0.0139 | 0.0793 | 472.606 | 2.487 | 4.73 | 13.2 |

TABLE 5

Representative Examples 9-34

| Description | Recovered Stretch (%) | Caliper After Recovery 1 Sheet (mils/ 1 sht) | Initial Caliper 1 Sheet (mils/ 1 sht) | Void Vol. Dry Wt (g) | Void Vol. Wet Wt (g) | Void Vol. Wt Inc. (%) | Void Volume Ratio | Basis Weight | Void Volume | Original Caliper | Void Volume Change |
|---|---|---|---|---|---|---|---|---|---|---|---|
| Yankee-Dried | 0 | 16.5 | 16.5 | 0.0274 | 0.228 | 732 | 3.8516 | 26.0247 | 7.3180 | 1.0000 | |
| | 0 | 16.3 | 16.3 | 0.0269 | 0.221 | 722 | 3.7988 | 25.5489 | 7.2178 | 1.0000 | |
| | 15 | 15.3 | 16.4 | 0.0264 | 0.217 | 725 | 3.8162 | 25.0731 | 7.2508 | 0.9329 | −0.0023 |
| | 15 | 15.4 | 16.4 | 0.0264 | 0.218 | 726 | 3.8220 | 25.1207 | 7.2619 | 0.9390 | −0.0008 |
| | 25 | 13.7 | 16.5 | 0.0237 | 0.200 | 747 | 3.9333 | 22.5040 | 7.4732 | 0.8303 | 0.0283 |
| | 25 | 13.6 | 16.3 | 0.0240 | 0.198 | 725 | 3.8150 | 22.7894 | 7.2485 | 0.8344 | −0.0027 |
| | 30 | 12.9 | 16.6 | 0.0227 | 0.191 | 742 | 3.9049 | 21.5524 | 7.4193 | 0.7771 | 0.0208 |
| | 30 | 13.0 | 16.6 | 0.0227 | 0.188 | 732 | 3.8515 | 21.5524 | 7.3178 | 0.7831 | 0.0069 |
| | 35 | 12.4 | 16.4 | 0.0221 | 0.190 | 760 | 3.9987 | 21.0291 | 7.5975 | 0.7561 | 0.0454 |
| | 35 | 12.4 | 16.4 | 0.0224 | 0.189 | 742 | 3.9065 | 21.3145 | 7.4224 | 0.7561 | 0.0213 |
| | 40 | 11.6 | 16.4 | 0.0213 | 0.187 | 782 | 4.1164 | 20.2203 | 7.8212 | 0.7073 | 0.0761 |
| | 40 | 11.8 | 16.4 | 0.0213 | 0.190 | 793 | 4.1760 | 20.2203 | 7.9344 | 0.7195 | 0.0917 |
| Can-dried | 0 | 12.4 | 12.4 | 0.0226 | 0.132 | 482 | 2.5395 | 21.5048 | 4.8250 | 1.0000 | |
| | 0 | 12.4 | 12.4 | 0.0230 | 0.138 | 503 | 2.6478 | 21.8379 | 5.0308 | 1.0000 | |

TABLE 5-continued

Representative Examples 9-34

| Description | Recovered Stretch (%) | Caliper After Recovery 1 Sheet (mils/ 1 sht) | Initial Caliper 1 Sheet (mils/ 1 sht) | Void Vol. Dry Wt (g) | Void Vol. Wet Wt (g) | Void Vol. Wt Inc. (%) | Void Volume Ratio | Basis Weight | Void Volume | Original Caliper | Void Volume Change |
|---|---|---|---|---|---|---|---|---|---|---|---|
| | 20 | 12.6 | 12.7 | 0.0202 | 0.135 | 568 | 2.9908 | 19.2211 | 5.6826 | 0.9921 | 0.1531 |
| | 20 | 11.9 | 12.4 | 0.0200 | 0.130 | 549 | 2.8884 | 19.0308 | 5.4880 | 0.9597 | 0.1137 |
| | 40 | 11.1 | 12.2 | 0.0176 | 0.129 | 635 | 3.3427 | 16.6996 | 6.3512 | 0.9098 | 0.2888 |
| | 40 | 11.1 | 12.1 | 0.0177 | 0.128 | 621 | 3.2679 | 16.8423 | 6.2091 | 0.9174 | 0.2600 |
| | 45 | 11.1 | 12.2 | 0.0175 | 0.129 | 635 | 3.3399 | 16.6520 | 6.3457 | 0.9098 | 0.2877 |
| | 45 | 11.0 | 12.1 | 0.0160 | 0.121 | 654 | 3.4406 | 15.2247 | 6.5371 | 0.9091 | 0.3265 |
| | 50 | 11.1 | 12.8 | 0.0168 | 0.124 | 641 | 3.3762 | 15.9383 | 6.4147 | 0.8672 | 0.3017 |
| | 50 | 10.5 | 12.2 | 0.0162 | 0.122 | 653 | 3.4364 | 15.3674 | 6.5291 | 0.8607 | 0.3249 |
| | 55 | 10.3 | 12.1 | 0.0166 | 0.125 | 653 | 3.4395 | 15.7480 | 6.5350 | 0.8512 | 0.3261 |
| | 55 | 10.0 | 12.4 | 0.0165 | 0.123 | 651 | 3.4277 | 15.6529 | 6.5126 | 0.8065 | 0.3216 |
| | 60 | 9.6 | 12.2 | 0.0141 | 0.117 | 731 | 3.8463 | 13.4167 | 7.3080 | 0.7869 | 0.4830 |
| | 60 | 9.6 | 12.5 | 0.0151 | 0.116 | 673 | 3.5404 | 14.3207 | 6.7267 | 0.7680 | 0.3650 |

TABLE 6

Modulus Data Can-Dried Sheet

| Stretch | 7 Point Modulus |
|---|---|
| 0.0% | |
| 0.1% | |
| 0.2% | |
| 0.2% | |
| 0.3% | |
| 0.3% | |
| 0.4% | |
| 0.4% | 2.901 |
| 0.5% | 0.800 |
| 0.6% | 6.463 |
| 0.6% | 8.599 |
| 0.7% | 7.007 |
| 0.7% | 9.578 |
| 0.8% | 10.241 |
| 0.8% | 9.671 |
| 0.9% | 8.230 |
| 0.9% | 8.739 |
| 1.0% | 11.834 |
| 1.1% | 11.704 |
| 1.1% | 7.344 |
| 1.2% | 4.605 |
| 1.2% | 5.874 |
| 1.3% | 9.812 |
| 1.3% | 7.364 |
| 1.4% | 7.395 |
| 1.4% | 3.595 |
| 1.5% | 9.846 |
| 1.6% | 9.273 |
| 1.6% | 9.320 |
| 1.7% | 9.044 |
| 1.7% | 8.392 |
| 1.8% | 6.904 |
| 1.8% | 9.106 |
| 1.9% | 4.188 |
| 1.9% | 9.058 |
| 2.0% | 5.812 |
| 2.1% | 6.829 |
| 2.1% | 8.861 |
| 2.2% | 8.726 |
| 2.2% | 7.547 |
| 2.3% | 8.551 |
| 2.3% | 5.323 |
| 2.4% | 8.749 |
| 2.4% | 8.335 |
| 2.5% | 3.565 |
| 2.6% | 7.184 |
| 2.6% | 10.009 |
| 2.7% | 6.210 |

TABLE 6-continued

Modulus Data Can-Dried Sheet

| Stretch | 7 Point Modulus |
|---|---|
| 2.7% | 4.050 |
| 2.8% | 6.196 |
| 2.8% | 6.650 |
| 2.9% | 3.741 |
| 2.9% | 4.788 |
| 3.0% | 1.204 |
| 3.1% | 4.713 |
| 3.1% | 6.730 |
| 3.2% | 1.970 |
| 3.2% | 6.071 |
| 3.3% | 9.930 |
| 3.3% | 1.369 |
| 3.4% | 6.921 |
| 3.4% | 4.998 |
| 3.5% | 3.646 |
| 3.6% | 8.263 |
| 3.6% | 1.287 |
| 3.7% | 2.850 |
| 3.7% | 4.314 |
| 3.8% | 3.653 |
| 3.8% | 4.033 |
| 3.9% | 3.033 |
| 3.9% | 2.546 |
| 4.0% | 2.951 |
| 4.1% | −1.750 |
| 4.1% | 3.651 |
| 4.2% | 3.476 |
| 4.2% | 1.422 |
| 4.3% | 2.573 |
| 4.3% | 2.629 |
| 4.4% | 0.131 |
| 4.4% | 7.777 |
| 4.5% | 2.504 |
| 4.6% | 0.845 |
| 4.6% | 4.639 |
| 4.7% | 2.827 |
| 4.7% | 1.037 |
| 4.8% | 4.396 |
| 4.8% | −0.680 |
| 4.9% | 3.015 |
| 4.9% | 4.976 |
| 5.0% | 2.223 |
| 5.1% | 2.288 |
| 5.1% | 1.501 |
| 5.2% | −0.534 |
| 5.2% | 3.253 |
| 5.3% | 1.184 |
| 5.3% | 0.749 |

TABLE 6-continued

Modulus Data Can-Dried Sheet

| Stretch | 7 Point Modulus |
|---|---|
| 5.4% | −0.231 |
| 5.4% | 0.069 |
| 5.5% | 2.161 |
| 5.6% | 6.864 |
| 5.6% | 1.515 |
| 5.7% | −0.281 |
| 5.7% | −2.001 |
| 5.8% | 2.136 |
| 5.8% | 4.216 |
| 5.9% | −0.066 |
| 5.9% | −0.596 |
| 6.0% | −0.031 |
| 6.1% | 1.187 |
| 6.1% | 1.689 |
| 6.2% | 1.424 |
| 6.2% | 1.363 |
| 6.3% | 3.877 |
| 6.3% | 0.712 |
| 6.4% | 1.810 |
| 6.4% | 2.368 |
| 6.5% | 1.531 |
| 6.6% | 1.984 |
| 6.6% | 0.014 |
| 6.7% | −4.405 |
| 6.7% | 1.606 |
| 6.8% | 2.634 |
| 6.8% | −0.467 |
| 6.9% | 1.865 |
| 6.9% | −3.493 |
| 7.0% | 1.088 |
| 7.1% | 7.333 |
| 7.1% | −0.900 |
| 7.2% | −2.607 |
| 7.2% | 3.199 |
| 7.3% | 1.892 |
| 7.3% | 1.306 |
| 7.4% | 1.063 |
| 7.4% | −0.836 |
| 7.5% | 1.785 |
| 7.6% | 4.308 |
| 7.6% | −0.647 |
| 7.7% | 2.090 |
| 7.7% | 2.956 |
| 7.8% | −0.666 |
| 7.8% | 1.187 |
| 7.9% | −0.059 |
| 7.9% | −2.503 |
| 8.0% | 0.420 |
| 8.1% | −0.130 |
| 8.1% | −1.059 |
| 8.2% | 4.016 |
| 8.2% | −0.561 |
| 8.3% | 0.784 |
| 8.3% | 4.101 |
| 8.4% | 3.313 |
| 8.4% | 1.557 |
| 8.5% | 1.425 |
| 8.6% | −1.135 |
| 8.6% | 3.694 |
| 8.7% | 0.668 |
| 8.7% | −1.626 |
| 8.8% | −0.210 |
| 8.8% | −0.014 |
| 8.9% | 2.920 |
| 8.9% | 3.213 |
| 9.0% | −0.456 |
| 9.1% | 3.403 |
| 9.1% | 2.034 |
| 9.2% | −1.436 |
| 9.2% | −2.670 |
| 9.3% | −0.091 |
| 9.3% | −1.808 |
| 9.4% | 1.817 |
| 9.4% | −1.529 |
| 9.5% | −1.259 |

TABLE 6-continued

Modulus Data Can-Dried Sheet

| Stretch | 7 Point Modulus |
|---|---|
| 9.6% | 4.814 |
| 9.6% | 3.044 |
| 9.7% | 2.383 |
| 9.7% | 0.411 |
| 9.8% | −1.111 |
| 9.8% | 1.785 |
| 9.9% | 2.055 |
| 9.9% | −0.801 |
| 10.0% | 0.466 |
| 10.1% | −0.899 |
| 10.1% | 0.396 |
| 10.2% | 2.543 |
| 10.2% | 0.226 |
| 10.3% | 1.842 |
| 10.3% | −0.704 |
| 10.4% | 2.350 |
| 10.4% | 1.707 |
| 10.5% | 0.120 |
| 10.6% | 1.741 |
| 10.6% | 0.553 |
| 10.7% | −0.931 |
| 10.7% | −0.635 |
| 10.8% | 0.713 |
| 10.8% | 0.040 |
| 10.9% | 0.645 |
| 10.9% | 0.111 |
| 11.0% | 1.532 |
| 11.1% | 2.753 |
| 11.1% | 3.364 |
| 11.2% | −0.970 |
| 11.2% | −0.717 |
| 11.3% | 3.049 |
| 11.3% | −1.919 |
| 11.4% | 0.342 |
| 11.4% | 0.354 |
| 11.5% | −1.510 |
| 11.6% | 2.085 |
| 11.6% | 1.217 |
| 11.7% | −0.780 |
| 11.7% | 4.265 |
| 11.8% | −0.565 |
| 11.8% | 1.150 |
| 11.9% | 3.509 |
| 11.9% | 1.145 |
| 12.0% | 1.268 |
| 12.1% | 1.923 |
| 12.1% | −1.835 |
| 12.2% | 0.943 |
| 12.4% | 0.581 |
| 12.7% | 0.634 |
| 13.0% | 1.556 |
| 13.3% | 1.290 |
| 13.6% | 0.467 |
| 13.8% | 1.042 |
| 14.1% | 1.116 |
| 14.4% | 0.339 |
| 14.7% | 0.869 |
| 14.9% | −0.213 |
| 15.2% | 0.192 |
| 15.5% | 0.757 |
| 15.8% | 0.652 |
| 16.1% | 0.648 |
| 16.3% | 0.461 |
| 16.6% | 0.142 |
| 16.9% | 0.976 |
| 17.2% | 0.958 |
| 17.4% | 0.816 |
| 17.7% | 0.180 |
| 18.0% | 0.318 |
| 18.3% | 1.122 |
| 18.6% | 1.011 |
| 18.8% | 0.756 |
| 19.1% | 0.292 |
| 19.4% | 0.257 |
| 19.7% | 1.411 |

TABLE 6-continued

Modulus Data Can-Dried Sheet

| Stretch | 7 Point Modulus |
|---|---|
| 19.9% | 1.295 |
| 20.2% | 0.467 |
| 20.5% | 0.858 |
| 20.8% | −0.177 |
| 21.1% | 1.148 |
| 21.3% | 1.047 |
| 21.6% | 0.758 |
| 21.9% | 0.056 |
| 22.2% | 1.050 |
| 22.4% | 0.450 |
| 22.7% | 1.128 |
| 23.0% | 0.589 |
| 23.3% | 0.679 |
| 23.6% | 0.618 |
| 23.8% | 1.539 |
| 24.1% | 0.867 |
| 24.4% | 1.251 |
| 24.7% | 1.613 |
| 24.9% | 0.798 |
| 25.2% | 0.959 |
| 25.5% | 0.896 |
| 25.8% | 0.533 |
| 26.1% | 1.354 |
| 26.3% | 0.530 |
| 26.6% | 0.905 |
| 26.9% | 1.304 |
| 27.2% | 1.596 |
| 27.4% | 1.333 |
| 27.7% | 1.307 |
| 28.0% | 0.425 |
| 28.3% | 1.695 |
| 28.6% | 0.966 |
| 28.8% | 0.425 |
| 29.1% | 0.100 |
| 29.4% | 0.774 |
| 29.7% | 1.388 |
| 29.9% | 1.413 |
| 30.2% | 0.636 |
| 30.5% | 1.316 |
| 30.8% | 1.738 |
| 31.1% | 1.870 |
| 31.3% | 1.460 |
| 31.6% | 1.317 |
| 31.9% | 1.209 |
| 32.2% | 1.623 |
| 32.4% | 1.304 |
| 32.7% | 1.434 |
| 33.0% | 1.265 |
| 33.3% | 1.649 |
| 33.6% | 1.194 |
| 33.8% | 1.354 |
| 34.1% | 0.968 |
| 34.4% | 0.932 |
| 34.7% | 1.107 |
| 34.9% | 1.554 |
| 35.2% | 0.880 |
| 35.5% | 1.389 |
| 35.8% | 1.876 |
| 36.1% | 1.733 |
| 36.3% | 2.109 |
| 36.6% | 1.920 |
| 36.9% | 1.854 |
| 37.2% | 1.480 |
| 37.4% | 1.780 |
| 37.7% | 1.441 |
| 38.0% | 2.547 |
| 38.3% | 1.780 |
| 38.6% | 1.762 |
| 38.8% | 2.129 |
| 39.1% | 2.132 |
| 39.4% | 1.968 |
| 39.7% | 2.307 |
| 39.9% | 1.983 |
| 40.2% | 1.929 |
| 40.5% | 2.692 |

TABLE 6-continued

Modulus Data Can-Dried Sheet

| Stretch | 7 Point Modulus |
|---|---|
| 40.8% | 2.018 |
| 41.1% | 3.112 |
| 41.3% | 2.261 |
| 41.6% | 3.022 |
| 41.9% | 1.739 |
| 42.2% | 3.274 |
| 42.4% | 2.516 |
| 42.7% | 2.436 |
| 43.0% | 1.949 |
| 43.3% | 3.357 |
| 43.6% | 1.880 |
| 43.8% | 3.140 |
| 44.1% | 2.899 |
| 44.4% | 2.993 |
| 44.7% | 3.665 |
| 44.9% | 3.671 |
| 45.2% | 2.694 |
| 45.5% | 4.047 |
| 45.8% | 3.875 |
| 46.1% | 2.465 |
| 46.3% | 3.712 |
| 46.6% | 3.560 |
| 46.9% | 2.967 |
| 47.2% | 3.945 |
| 47.4% | 3.337 |
| 47.7% | 4.052 |
| 48.0% | 5.070 |
| 48.3% | 4.113 |
| 48.6% | 4.044 |
| 48.8% | 4.366 |
| 49.1% | 4.639 |
| 49.4% | 5.178 |
| 49.7% | 4.315 |
| 49.9% | 4.674 |
| 50.2% | 4.061 |
| 50.5% | 4.884 |
| 50.8% | 6.005 |
| 51.1% | 5.250 |
| 51.3% | 4.888 |
| 51.6% | 4.868 |
| 51.9% | 5.304 |
| 52.2% | 5.920 |
| 52.4% | 5.849 |
| 52.7% | 4.768 |
| 53.0% | 5.280 |
| 53.3% | 5.097 |
| 53.6% | 6.320 |
| 53.8% | 5.780 |
| 54.1% | 6.064 |
| 54.4% | 5.595 |
| 54.7% | 6.350 |
| 54.9% | 5.647 |
| 55.2% | 6.049 |
| 55.5% | 5.907 |
| 55.8% | 5.092 |
| 56.1% | 5.315 |
| 56.3% | 5.821 |
| 56.6% | 5.179 |
| 56.9% | 5.790 |
| 57.2% | 6.432 |
| 57.4% | 5.358 |
| 57.7% | 5.858 |
| 57.8% | 5.528 |
| 58.1% | −0.539 |
| 58.3% | −4.473 |
| 58.6% | −7.596 |
| 58.8% | −16.304 |
| 59.1% | −19.957 |
| 59.3% | −27.423 |
| 59.6% | −24.870 |
| 59.8% | −24.354 |
| 60.1% | −26.042 |
| 60.2% | −33.413 |
| 60.3% | −33.355 |
| 60.4% | −39.617 |

TABLE 6-continued

| Modulus Data Can-Dried Sheet | |
|---|---|
| Stretch | 7 Point Modulus |
| 60.5% | −49.495 |
| 60.8% | −54.166 |

TABLE 7

| Modulus Data Yankee-Dried Sheet | |
|---|---|
| Stretch (%) | 7 Point Modulus |
| 0.0% | |
| 0.0% | |
| 0.1% | |
| 0.2% | |
| 0.2% | |
| 0.3% | |
| 0.3% | |
| 0.4% | |
| 0.4% | −1.070 |
| 0.5% | 1.632 |
| 0.6% | −0.636 |
| 0.6% | 2.379 |
| 0.7% | −0.488 |
| 0.7% | −0.594 |
| 0.8% | 4.041 |
| 0.8% | 2.522 |
| 0.9% | −1.569 |
| 0.9% | 0.684 |
| 1.0% | −1.694 |
| 1.1% | 1.769 |
| 1.1% | 1.536 |
| 1.2% | −1.383 |
| 1.2% | −1.222 |
| 1.3% | 0.462 |
| 1.3% | 3.474 |
| 1.4% | 4.228 |
| 1.4% | −1.074 |
| 1.5% | 0.133 |
| 1.6% | −0.563 |
| 1.6% | 1.659 |
| 1.7% | 0.430 |
| 1.7% | 0.204 |
| 1.8% | −2.271 |
| 1.8% | 0.536 |
| 1.9% | 0.850 |
| 1.9% | 1.918 |
| 2.0% | 3.341 |
| 2.1% | 3.455 |
| 2.1% | 1.837 |
| 2.2% | 1.079 |
| 2.2% | 1.027 |
| 2.3% | 1.637 |
| 2.3% | 1.999 |
| 2.4% | 0.340 |
| 2.4% | 0.744 |
| 2.5% | 1.202 |
| 2.6% | 2.405 |
| 2.6% | 1.714 |
| 2.7% | −0.616 |
| 2.7% | −0.934 |
| 2.8% | −1.307 |
| 2.8% | 0.976 |
| 2.9% | 1.584 |
| 2.9% | 2.162 |
| 3.0% | 1.594 |
| 3.1% | 2.895 |
| 3.1% | 1.606 |
| 3.2% | 4.526 |
| 3.2% | 1.075 |
| 3.3% | 1.206 |
| 3.3% | 0.414 |
| 3.4% | 0.611 |

TABLE 7-continued

| Modulus Data Yankee-Dried Sheet | |
|---|---|
| Stretch (%) | 7 Point Modulus |
| 3.4% | −0.006 |
| 3.5% | 3.757 |
| 3.6% | −0.541 |
| 3.6% | 0.524 |
| 3.7% | −0.531 |
| 3.7% | −0.563 |
| 3.8% | 2.439 |
| 3.8% | 2.976 |
| 3.9% | −1.508 |
| 3.9% | 0.142 |
| 4.0% | 2.031 |
| 4.1% | 2.765 |
| 4.1% | 1.384 |
| 4.2% | 2.172 |
| 4.2% | −0.561 |
| 4.3% | 2.293 |
| 4.3% | 0.745 |
| 4.4% | 1.172 |
| 4.4% | −2.196 |
| 4.5% | 0.657 |
| 4.6% | −1.475 |
| 4.6% | 1.805 |
| 4.7% | −0.679 |
| 4.7% | 1.787 |
| 4.8% | 3.364 |
| 4.8% | 3.989 |
| 4.9% | 0.673 |
| 4.9% | 2.903 |
| 5.0% | −0.233 |
| 5.1% | 1.353 |
| 5.1% | 2.525 |
| 5.2% | −1.461 |
| 5.2% | 0.923 |
| 5.3% | 3.618 |
| 5.3% | 1.279 |
| 5.4% | 1.515 |
| 5.4% | 1.022 |
| 5.5% | −1.682 |
| 5.6% | 1.089 |
| 5.6% | −1.423 |
| 5.7% | −0.381 |
| 5.7% | 0.464 |
| 5.8% | 3.053 |
| 5.8% | 1.658 |
| 5.9% | 4.678 |
| 5.9% | 3.621 |
| 6.0% | 1.960 |
| 6.1% | 1.921 |
| 6.1% | 0.775 |
| 6.2% | 1.072 |
| 6.2% | 1.441 |
| 6.3% | −1.200 |
| 6.3% | 0.089 |
| 6.4% | 2.611 |
| 6.4% | 2.132 |
| 6.5% | 0.832 |
| 6.6% | 0.665 |
| 6.6% | 3.531 |
| 6.7% | 2.040 |
| 6.7% | 0.289 |
| 6.8% | 0.654 |
| 6.8% | 2.516 |
| 6.9% | 2.139 |
| 6.9% | 1.454 |
| 7.0% | −0.256 |
| 7.1% | 2.056 |
| 7.1% | 2.278 |
| 7.2% | 3.943 |
| 7.2% | 0.398 |
| 7.3% | 2.336 |
| 7.3% | −1.757 |
| 7.4% | 1.079 |
| 7.4% | 0.113 |
| 7.5% | −0.534 |
| 7.6% | −2.582 |

TABLE 7-continued

Modulus Data Yankee-Dried Sheet

| Stretch (%) | 7 Point Modulus |
|---|---|
| 7.6% | 0.738 |
| 7.7% | −1.566 |
| 7.7% | 4.872 |
| 7.8% | 0.032 |
| 7.8% | 0.591 |
| 7.9% | 2.197 |
| 7.9% | 3.343 |
| 8.0% | −0.128 |
| 8.1% | 2.866 |
| 8.1% | 1.846 |
| 8.2% | 2.232 |
| 8.2% | 2.015 |
| 8.3% | 1.955 |
| 8.3% | 1.117 |
| 8.4% | 2.535 |
| 8.4% | 0.939 |
| 8.5% | 0.684 |
| 8.6% | 1.770 |
| 8.6% | 1.808 |
| 8.7% | 0.904 |
| 8.7% | 0.990 |
| 8.8% | 1.683 |
| 8.8% | 1.088 |
| 8.9% | 0.840 |
| 8.9% | 1.290 |
| 9.0% | 1.118 |
| 9.1% | 1.210 |
| 9.1% | 1.270 |
| 9.2% | 0.469 |
| 9.2% | 0.958 |
| 9.3% | 1.209 |
| 9.3% | 0.845 |
| 9.4% | 0.841 |
| 9.4% | 1.195 |
| 9.5% | 1.445 |
| 9.6% | 1.655 |
| 9.8% | 1.449 |
| 10.1% | 1.206 |
| 10.4% | 1.309 |
| 10.7% | 1.269 |
| 10.9% | 1.102 |
| 11.2% | 1.258 |
| 11.5% | 0.870 |
| 11.8% | 1.237 |
| 12.1% | 0.804 |
| 12.3% | 1.020 |
| 12.6% | 0.753 |
| 12.9% | 1.285 |
| 13.2% | 0.813 |
| 13.4% | 1.073 |
| 13.7% | 0.870 |
| 14.0% | 1.327 |
| 14.3% | 1.693 |
| 14.6% | 0.992 |
| 14.8% | 1.296 |
| 15.1% | 1.329 |
| 15.4% | 1.372 |
| 15.7% | 1.292 |
| 15.9% | 1.045 |
| 16.2% | 0.377 |
| 16.5% | 1.694 |
| 16.8% | 0.310 |
| 17.1% | 0.637 |
| 17.3% | 0.929 |
| 17.6% | 1.506 |
| 17.9% | 1.005 |
| 18.2% | 1.360 |
| 18.4% | 0.723 |
| 18.7% | 1.746 |
| 19.0% | 1.706 |
| 19.3% | 1.339 |
| 19.6% | 0.488 |
| 19.8% | 1.269 |
| 20.1% | 0.884 |
| 20.4% | 1.600 |

TABLE 7-continued

Modulus Data Yankee-Dried Sheet

| Stretch (%) | 7 Point Modulus |
|---|---|
| 20.7% | 0.979 |
| 20.9% | 0.969 |
| 21.2% | 0.970 |
| 21.5% | 1.395 |
| 21.8% | 1.352 |
| 22.1% | 1.175 |
| 22.3% | 0.860 |
| 22.6% | 0.895 |
| 22.9% | 1.456 |
| 23.2% | 1.254 |
| 23.4% | 1.140 |
| 23.7% | 0.913 |
| 24.0% | 1.293 |
| 24.3% | 0.674 |
| 24.6% | 1.326 |
| 24.8% | 1.071 |
| 25.1% | 1.386 |
| 25.4% | 1.253 |
| 25.7% | 1.467 |
| 25.9% | 1.078 |
| 26.2% | 1.772 |
| 26.5% | 1.464 |
| 26.8% | 1.177 |
| 27.1% | 1.125 |
| 27.3% | 0.929 |
| 27.6% | 1.538 |
| 27.9% | 2.302 |
| 28.2% | 1.871 |
| 28.4% | 1.425 |
| 28.7% | 1.751 |
| 29.0% | 1.368 |
| 29.3% | 2.044 |
| 29.6% | 1.522 |
| 29.8% | 0.797 |
| 30.1% | 1.208 |
| 30.4% | 1.567 |
| 30.7% | 1.396 |
| 30.9% | 2.030 |
| 31.2% | 1.196 |
| 31.5% | 1.311 |
| 31.8% | 1.528 |
| 32.1% | 1.803 |
| 32.3% | 1.424 |
| 32.6% | 1.627 |
| 32.9% | 1.458 |
| 33.2% | 2.377 |
| 33.4% | 2.158 |
| 33.7% | 1.866 |
| 34.0% | 1.749 |
| 34.3% | 1.924 |
| 34.6% | 2.075 |
| 34.8% | 2.551 |
| 35.1% | 1.869 |
| 35.4% | 2.248 |
| 35.7% | 2.498 |
| 35.9% | 2.400 |
| 36.2% | 3.339 |
| 36.5% | 2.649 |
| 36.8% | 2.267 |
| 37.1% | 2.878 |
| 37.3% | 2.005 |
| 37.6% | 2.636 |
| 37.9% | 2.793 |
| 38.2% | 2.104 |
| 38.4% | 2.511 |
| 38.7% | 2.605 |
| 39.0% | 2.521 |
| 39.3% | 2.875 |
| 39.6% | 2.766 |
| 39.8% | 2.753 |
| 40.1% | 2.619 |
| 40.4% | 2.698 |
| 40.7% | 3.165 |
| 40.9% | 3.134 |
| 41.2% | 4.025 |

TABLE 7-continued

| Modulus Data Yankee-Dried Sheet | |
|---|---|
| Stretch (%) | 7 Point Modulus |
| 41.5% | 4.118 |
| 41.8% | 4.165 |
| 42.1% | 3.912 |
| 42.3% | 4.667 |
| 42.6% | 3.692 |
| 42.9% | 3.871 |
| 43.2% | 3.261 |
| 43.4% | 3.661 |
| 43.7% | 3.470 |
| 44.0% | 4.725 |
| 44.3% | 3.424 |
| 44.6% | 3.444 |
| 44.8% | 4.148 |
| 45.1% | 5.041 |

TABLE 7-continued

| Modulus Data Yankee-Dried Sheet | |
|---|---|
| Stretch (%) | 7 Point Modulus |
| 45.4% | 3.676 |
| 45.7% | 4.125 |
| 45.9% | 3.372 |
| 46.2% | 3.748 |
| 46.5% | 4.368 |
| 46.8% | 3.565 |
| 46.8% | 3.132 |
| 47.1% | 2.726 |
| 47.4% | −4.019 |
| 47.4% | −10.656 |
| 47.5% | −21.712 |
| 47.6% | −45.557 |
| 47.6% | −62.257 |

TABLE 8

| Roll Number Count | Vac Level | Long Fabric Strands to Sheet | Molding Box Slot Width. Inches | Fabric Crepe Ratio | Caliper mils/ 8 sht | Basis Weight Lb/3000 ft^2 | Tensile GM g/3 in. | Cal/Bwt cc/gram | Void Volume grams/ gram |
|---|---|---|---|---|---|---|---|---|---|
| Caliper Gain Comparison Representative Examples 35-56 | | | | | | | | | |
| 7306 | 0 | MD | 0.25 | 1.30 | 65.18 | 13.82 | 718 | 9.2 | 7.4 |
| 7307 | 10 | MD | 0.25 | 1.30 | 77.05 | 13.21 | 624 | 11.4 | 7.6 |
| 7308 | 5 | MD | 1.50 | 1.30 | 68.60 | 13.51 | 690 | 9.9 | 7.2 |
| 7309 | 10 | MD | 1.50 | 1.30 | 77.70 | 13.25 | 575 | 11.4 | 6.7 |
| 7310 | 20 | MD | 0.25 | 1.30 | 88.75 | 13.19 | 535 | 13.1 | 8.2 |
| 7311 | 20 | MD | 0.25 | 1.30 | 91.05 | 13.24 | 534 | 13.4 | 8.2 |
| 7312 | 20 | MD | 1.50 | 1.30 | 87.73 | 13.23 | 561 | 12.9 | 8.4 |
| 7313 | 0 | MD | 1.50 | 1.33 | 64.83 | 13.50 | 619 | 9.4 | |
| 7314 | 0 | MD | 1.50 | 1.30 | 64.18 | 13.47 | 611 | 9.3 | |
| 7315 | 5 | MD | 0.25 | 1.30 | 70.55 | 13.38 | 653 | 10.3 | |
| 7316 | 0 | MD | 0.25 | 1.15 | 52.58 | 13.23 | 1063 | 7.7 | |
| 7317 | 0 | MD | 0.25 | 1.15 | 53.05 | 13.12 | 970 | 7.9 | 6.3 |
| 7318 | 5 | MD | 0.25 | 1.15 | 57.40 | 13.20 | 1032 | 8.5 | 6.5 |
| 7319 | 10 | MD | 0.25 | 1.15 | 62.45 | 13.01 | 969 | 9.4 | 6.7 |
| 7320 | 5 | MD | 1.50 | 1.15 | 54.65 | 12.98 | 1018 | 8.2 | 6.0 |
| 7321 | 10 | MD | 1.50 | 1.15 | 62.43 | 13.02 | 991 | 9.3 | 6.2 |
| 7322 | 20 | MD | 1.50 | 1.15 | 71.40 | 13.08 | 869 | 10.6 | 7.5 |
| 7323 | 24 | MD | 0.25 | 1.15 | 77.68 | 13.21 | 797 | 11.5 | |
| 7324 | 0 | MD | 0.25 | 1.15 | 75.75 | 23.53 | 1518 | 6.3 | |
| 7325 | 0 | MD | 0.25 | 1.15 | 78.90 | 24.13 | 1488 | 6.4 | |
| 7326 | 0 | MD | 0.25 | 1.15 | 78.40 | 24.53 | 1412 | 6.2 | 5.8 |
| 7327 | 15 | MD | 0.25 | 1.15 | 83.93 | 24.09 | 1314 | 6.8 | 6.1 |
| Caliper Gain Comparison Representative Examples 57-78 | | | | | | | | | |
| 7328 | 10 | MD | 1.50 | 1.15 | 83.18 | 24.15 | 1280 | 6.7 | 6.2 |
| 7329 | 20 | MD | 0.25 | 1.15 | 88.35 | 24.33 | 1316 | 7.1 | 6.2 |
| 7330 | 15 | MD | 1.50 | 1.15 | 86.55 | 24.40 | 1364 | 6.9 | 6.3 |
| 7331 | 24 | MD | 1.50 | 1.15 | 93.03 | 24.43 | 1333 | 7.4 | 6.4 |
| 7332 | 24 | MD | 0.25 | 1.15 | 93.13 | 24.62 | 1264 | 7.4 | 6.5 |
| 7333 | 5 | MD | 0.25 | 1.15 | 79.10 | 24.68 | 1537 | 6.2 | 5.9 |
| 7334 | 0 | MD | 0.25 | 1.30 | 92.00 | 25.16 | 779 | 7.1 | |
| 7335 | 0 | MD | 0.25 | 1.30 | 90.98 | 24.89 | 1055 | 7.1 | |
| 7336 | 0 | MD | 0.25 | 1.30 | 91.45 | 24.15 | 1016 | 7.4 | 6.3 |
| 7337 | 5 | MD | 0.25 | 1.30 | 90.13 | 23.98 | 1022 | 7.3 | 6.5 |
| 7338 | 10 | MD | 0.25 | 1.30 | 94.93 | 23.92 | 980 | 7.7 | 6.6 |
| 7339 | 5 | MD | 1.50 | 1.30 | 95.23 | 24.05 | 1081 | 7.7 | 6.6 |
| 7340 | 20 | MD | 0.25 | 1.30 | 103.20 | 23.43 | 961 | 8.6 | |
| 7341 | 15 | MD | 1.50 | 1.30 | 99.88 | 23.60 | 996 | 8.2 | 6.5 |
| 7342 | 20 | MD | 1.50 | 1.30 | 104.83 | 24.13 | 934 | 8.5 | 7.1 |
| 7343 | 24 | MD | 0.25 | 1.30 | 106.20 | 23.98 | 903 | 8.6 | 6.7 |
| 7344 | 24 | MD | 0.25 | 1.30 | 111.20 | 23.93 | 876 | 9.1 | |
| 7345 | 0 | MD | 0.25 | 1.30 | 92.08 | 24.44 | 967 | 7.3 | 6.7 |
| 7346 | 15 | MD | 0.25 | 1.30 | 102.90 | 23.89 | 788 | 8.4 | 7.2 |
| 7347 | 15 | MD | 0.25 | 1.15 | 91.68 | 24.15 | 1159 | 7.4 | 6.5 |
| 7348 | 0 | MD | 0.25 | 1.15 | 83.98 | 24.27 | 1343 | 6.7 | 6.5 |
| 7349 | 24 | MD | 0.25 | 1.15 | 96.43 | 23.91 | 1146 | 7.9 | 6.9 |

TABLE 8-continued

| Roll Number Count | Vac Level | Long Fabric Strands to Sheet | Molding Box Slot Width. Inches | Fabric Crepe Ratio | Caliper mils/ 8 sht | Basis Weight Lb/3000 ft ^2 | Tensile GM g/3 in. | Cal/Bwt cc/gram | Void Volume grams/ gram |
|---|---|---|---|---|---|---|---|---|---|
| Caliper Gain Comparison Representative Examples 79-100 | | | | | | | | | |
| 7351 | 0 | CD | 0.25 | 1.15 | 86.65 | 24.33 | 1709 | 6.9 | |
| 7352 | 0 | CD | 0.25 | 1.15 | 87.60 | 24.62 | 1744 | 6.9 | 5.9 |
| 7353 | 5 | CD | 0.25 | 1.15 | 88.60 | 24.76 | 1681 | 7.0 | 5.6 |
| 7354 | 15 | CD | 0.25 | 1.15 | 100.58 | 24.50 | 1614 | 8.0 | 6.2 |
| 7355 | 24 | CD | 0.25 | 1.15 | 100.33 | 24.44 | 1638 | 8.0 | 6.3 |
| 7356 | 0 | CD | 1.50 | 1.15 | 88.40 | 24.18 | 1548 | 7.1 | |
| 7357 | 0 | CD | 1.50 | 1.15 | 87.05 | 24.12 | 1565 | 7.0 | |
| 7358 | 24 | CD | 1.50 | 1.15 | 99.30 | 24.17 | 1489 | 8.0 | |
| 7359 | 24 | CD | 0.25 | 1.15 | 104.08 | 24.21 | 1407 | 8.4 | |
| 7360 | 0 | CD | 0.25 | 1.15 | 91.18 | 24.13 | 1415 | 7.4 | 6.3 |
| 7361 | 5 | CD | 0.25 | 1.15 | 92.43 | 24.18 | 1509 | 7.4 | 6.3 |
| 7362 | 15 | CD | 0.25 | 1.15 | 102.15 | 24.21 | 1506 | 8.2 | 6.7 |
| 7363 | 24 | CD | 0.25 | 1.15 | 104.50 | 24.58 | 1476 | 8.3 | 6.7 |
| 7364 | 24 | CD | 0.25 | 1.30 | 119.45 | 24.72 | 1056 | 9.4 | |
| 7365 | 24 | CD | 0.25 | 1.30 | 123.25 | 24.46 | 952 | 9.8 | |
| 7366 | 24 | CD | 0.25 | 1.30 | 124.30 | 24.62 | 1041 | 9.8 | 7.0 |
| 7367 | 0 | CD | 0.25 | 1.30 | 100.18 | 24.52 | 1019 | 8.0 | 6.6 |
| 7368 | 15 | CD | 0.25 | 1.30 | 113.95 | 24.29 | 1023 | 9.1 | 6.8 |
| 7369 | 5 | CD | 0.25 | 1.30 | 106.55 | 24.56 | 1106 | 8.5 | 6.6 |
| 7370 | 0 | CD | 0.25 | 1.30 | 96.28 | 24.68 | 1238 | 7.6 | 6.1 |
| 7371 | 5 | CD | 0.25 | 1.30 | 98.80 | 24.65 | 1239 | 7.8 | 6.1 |
| 7372 | 15 | CD | 0.25 | 1.30 | 109.80 | 24.64 | 1110 | 8.7 | 6.4 |
| Caliper Gain Comparison Representative Examples 101-122 | | | | | | | | | |
| 7373 | 24 | CD | 0.25 | 1.30 | 114.65 | 24.75 | 1182 | 9.0 | 6.6 |
| 7376 | 0 | CD | 0.25 | 1.30 | 70.88 | 13.32 | 723 | 10.4 | 6.5 |
| 7377 | 5 | CD | 0.25 | 1.30 | 80.48 | 13.38 | 629 | 11.7 | 7.5 |
| 7378 | 15 | CD | 0.25 | 1.30 | 100.90 | 13.71 | 503 | 14.3 | 8.9 |
| 7379 | 20 | CD | 0.25 | 1.30 | 112.55 | 13.87 | 468 | 15.8 | 9.2 |
| 7380 | 20 | CD | 0.25 | 1.30 | 112.60 | 12.80 | 345 | 17.1 | 9.8 |
| 7381 | 15 | CD | 0.25 | 1.30 | 103.93 | 12.96 | 488 | 15.6 | 9.1 |
| 7382 | 5 | CD | 0.25 | 1.30 | 91.35 | 13.06 | 499 | 13.6 | 7.8 |
| 7383 | 0 | CD | 0.25 | 1.30 | 73.03 | 13.17 | 613 | 10.8 | 8.1 |
| 7386 | 0 | CD | 0.25 | 1.15 | 59.35 | 13.21 | 1138 | 8.8 | 5.9 |
| 7387 | 5 | CD | 0.25 | 1.15 | 64.35 | 13.20 | 1153 | 9.5 | 6.1 |
| 7388 | 15 | CD | 0.25 | 1.15 | 77.43 | 13.22 | 1109 | 11.4 | 6.7 |
| 7389 | 24 | CD | 0.25 | 1.15 | 83.38 | 13.31 | 971 | 12.2 | 7.4 |
| 7390 | 24 | CD | 0.25 | 1.15 | 87.28 | 13.20 | 895 | 12.9 | 7.6 |
| 7391 | 15 | CD | 0.25 | 1.15 | 82.58 | 13.02 | 935 | 12.4 | 7.2 |
| 7392 | 5 | CD | 0.25 | 1.15 | 68.58 | 12.97 | 1000 | 10.3 | 6.2 |
| 7393 | 0 | CD | 0.25 | 1.15 | 61.40 | 12.92 | 952 | 9.3 | 6.3 |
| 7394 | 0 | CD | 0.25 | 1.15 | 57.35 | 12.67 | 878 | 8.8 | |
| 7395 | 0 | CD | 0.25 | 1.15 | 57.45 | 12.83 | 924 | 8.7 | |
| 7396 | 0 | CD | 0.25 | 1.15 | 58.50 | 13.50 | 1053 | 8.4 | 6.2 |
| 7397 | 5 | CD | 0.25 | 1.15 | 63.75 | 13.20 | 1094 | 9.4 | 6.5 |
| 7398 | 15 | CD | 0.25 | 1.15 | 79.08 | 13.95 | 878 | 11.0 | 6.9 |
| Caliper Gain Comparison Representative Examples 123-144 | | | | | | | | | |
| 7399 | 24 | CD | 0.25 | 1.15 | 82.50 | 13.44 | 811 | 12.0 | 6.7 |
| 7400 | 24 | CD | 0.25 | 1.30 | 96.88 | 13.68 | 566 | 13.8 | |
| 7401 | 24 | CD | 0.25 | 1.30 | 96.78 | 13.70 | 556 | 13.8 | 7.9 |
| 7402 | 15 | CD | 0.25 | 1.30 | 91.00 | 13.75 | 585 | 12.9 | 8.1 |
| 7403 | 5 | CD | 0.25 | 1.30 | 76.03 | 13.50 | 633 | 11.0 | 6.9 |
| 7404 | 0 | CD | 0.25 | 1.30 | 69.98 | 13.19 | 605 | 10.3 | 7.2 |
| 7405 | 0 | CD | 0.25 | 1.30 | 96.58 | 24.55 | 1091 | 7.7 | |
| 7406 | 0 | CD | 0.25 | 1.30 | 94.05 | 24.17 | 1023 | 7.6 | 6.4 |
| 7407 | 5 | CD | 0.25 | 1.30 | 93.65 | 24.41 | 888 | 7.5 | 6.5 |
| 7408 | 15 | CD | 0.25 | 1.30 | 99.13 | 24.31 | 1051 | 7.9 | 7.0 |
| 7409 | 24 | CD | 0.25 | 1.30 | 104.48 | 24.47 | 988 | 8.3 | 7.0 |
| 7410 | 24 | CD | 0.25 | 1.15 | 100.38 | 24.40 | 1278 | 8.0 | |
| 7411 | 24 | CD | 0.25 | 1.15 | 97.33 | 24.33 | 1302 | 7.8 | |
| 7412 | 24 | CD | 0.25 | 1.15 | 96.83 | 24.73 | 1311 | 7.6 | |
| 7413 | 24 | CD | 0.25 | 1.15 | 96.00 | 24.58 | 1291 | 7.6 | 5.9 |
| 7414 | 15 | CD | 0.25 | 1.15 | 91.88 | 24.41 | 1477 | 7.3 | 6.2 |
| 7415 | 5 | CD | 0.25 | 1.15 | 84.88 | 24.37 | 1521 | 6.8 | 6.0 |
| 7416 | 0 | CD | 0.25 | 1.15 | 83.60 | 23.89 | 1531 | 6.8 | 6.1 |
| 7417 | 0 | CD | 0.25 | 1.15 | 85.33 | 23.72 | 1310 | 7.0 | 6.2 |
| 7418 | 24 | CD | 0.25 | 1.15 | 103.48 | 24.05 | 1252 | 8.4 | 6.1 |
| 7419 | 24 | CD | 0.25 | 1.30 | 108.75 | 24.37 | 979 | 8.7 | |
| 7420 | 24 | CD | 0.25 | 1.30 | 113.00 | 24.23 | 967 | 9.1 | 7.4 |

TABLE 8-continued

| Roll Number Count | Vac Level | Long Fabric Strands to Sheet | Molding Box Slot Width. Inches | Fabric Crepe Ratio | Caliper mils/ 8 sht | Basis Weight Lb/3000 ft ^2 | Tensile GM g/3 in. | Cal/Bwt cc/gram | Void Volume grams/ gram |
|---|---|---|---|---|---|---|---|---|---|
| Caliper Gain Comparison Representative Examples 145-166 | | | | | | | | | |
| 7421 | 0 | CD | 0.25 | 1.30 | 94.43 | 24.27 | 954 | 7.6 | 6.6 |
| 7423 | 0 | MD | 0.25 | 1.30 | 94.00 | 24.75 | 1164 | 7.4 | |
| 7424 | 0 | MD | 0.25 | 1.30 | 93.83 | 24.41 | 969 | 7.5 | 6.5 |
| 7425 | 5 | MD | 0.25 | 1.30 | 94.55 | 23.96 | 1018 | 7.7 | 6.8 |
| 7426 | 15 | MD | 0.25 | 1.30 | 110.53 | 24.17 | 1018 | 8.9 | 6.7 |
| 7427 | 24 | MD | 0.25 | 1.30 | 115.93 | 24.39 | 997 | 9.3 | 6.9 |
| 7428 | 24 | MD | 0.25 | 1.30 | 122.83 | 23.86 | 834 | 10.0 | |
| 7429 | 0 | MD | 0.25 | 1.30 | 95.40 | 23.88 | 915 | 7.8 | |
| 7430 | 0 | MD | 0.25 | 1.15 | 78.25 | 24.15 | 1424 | 6.3 | |
| 7431 | 0 | MD | 0.25 | 1.15 | 80.30 | 23.60 | 1365 | 6.6 | |
| 7432 | 0 | MD | 0.25 | 1.15 | 80.53 | 23.91 | 1418 | 6.6 | 6.0 |
| 7433 | 5 | MD | 0.25 | 1.15 | 81.50 | 24.37 | 1432 | 6.5 | 5.9 |
| 7434 | 15 | MD | 0.25 | 1.15 | 94.43 | 23.84 | 1349 | 7.7 | 6.2 |
| 7435 | 24 | MD | 0.25 | 1.15 | 101.90 | 24.22 | 1273 | 8.2 | 6.6 |
| 7438 | 0 | MD | 0.25 | 1.30 | 72.53 | 13.82 | 475 | 10.2 | |
| 7439 | 0 | MD | 0.25 | 1.30 | 71.63 | 13.47 | 478 | 10.4 | 7.9 |
| 7440 | 5 | MD | 0.25 | 1.30 | 82.75 | 13.70 | 541 | 11.8 | 7.7 |
| 7441 | 15 | MD | 0.25 | 1.30 | 102.48 | 13.77 | 529 | 14.5 | 7.8 |
| 7442 | 24 | MD | 0.25 | 1.30 | 104.23 | 13.80 | 502 | 14.7 | 8.3 |
| 7446 | 0 | MD | 0.25 | 1.30 | 87.08 | 24.39 | 1155 | 7.0 | |
| 7447 | 0 | MD | 0.25 | 1.30 | 88.53 | 24.41 | 1111 | 7.1 | |
| 7448 | 5 | MD | 0.25 | 1.30 | 90.60 | 24.50 | 1105 | 7.2 | 6.5 |
| Caliper Gain Comparison Representative Examples 167-187 | | | | | | | | | |
| 7449 | 5 | MD | 0.25 | 1.30 | 89.15 | 24.59 | 1085 | 7.1 | 6.3 |
| 7450 | 15 | MD | 0.25 | 1.30 | 99.03 | 24.26 | 1014 | 8.0 | 6.8 |
| 7451 | 24 | MD | 0.25 | 1.30 | 106.90 | 24.54 | 960 | 8.5 | 7.4 |
| 7452 | 24 | MD | 0.25 | 1.15 | 87.23 | 23.90 | 1346 | 7.1 | |
| 7453 | 24 | MD | 0.25 | 1.15 | 94.05 | 23.54 | 1207 | 7.8 | 7.2 |
| 7454 | 15 | MD | 0.25 | 1.15 | 87.38 | 24.15 | 1363 | 7.1 | 6.2 |
| 7455 | 5 | MD | 0.25 | 1.15 | 79.40 | 24.27 | 1476 | 6.4 | 5.9 |
| 7456 | 0 | MD | 0.25 | 1.15 | 79.45 | 23.89 | 1464 | 6.5 | 6.1 |
| 7457 | 0 | CD | 0.25 | 1.15 | 88.00 | 24.48 | 1667 | 7.0 | |
| 7458 | 0 | CD | 0.25 | 1.15 | 88.43 | 24.15 | 1705 | 7.1 | |
| 7459 | 0 | CD | 0.25 | 1.15 | 87.88 | 24.32 | 1663 | 7.0 | 6.0 |
| 7460 | 5 | CD | 0.25 | 1.15 | 87.13 | 24.01 | 1639 | 7.1 | 6.2 |
| 7461 | 15 | CD | 0.25 | 1.15 | 99.50 | 24.18 | 1580 | 8.0 | 6.7 |
| 7462 | 24 | CD | 0.25 | 1.15 | 107.68 | 24.58 | 1422 | 8.5 | 7.3 |
| 7463 | 24 | CD | 0.25 | 1.30 | 118.33 | 25.38 | 1008 | 9.1 | |
| 7464 | 24 | CD | 0.25 | 1.30 | 123.75 | 24.57 | 1056 | 9.8 | |
| 7465 | 24 | CD | 0.25 | 1.30 | 120.00 | 24.86 | 1035 | 9.4 | |
| 7466 | 15 | CD | 0.25 | 1.30 | 113.10 | 24.28 | 1072 | 9.1 | 6.4 |
| 7467 | 15 | CD | 0.25 | 1.30 | 110.25 | 24.49 | 1092 | 8.8 | 7.2 |
| 7468 | 0 | CD | 0.25 | 1.30 | 97.70 | 24.38 | 1095 | 7.8 | 6.5 |
| 7469 | 0 | CD | 0.25 | 1.30 | 96.83 | 23.09 | 1042 | 8.2 | 5.6 |

TABLE 9

Caliper Change With Vacuum

| Fabric Ct | Fabric Type | Fabric Orientation | Basis Weight | Fabric Crepe Ratio | Slope | Intercept | Caliper @ 25 in Hg |
|---|---|---|---|---|---|---|---|
| 44 | M | MD | 13 | 1.15 | 1.0369 | 51.7 | 77.6 |
| 44 | G | CD | 13 | 1.15 | 1.1449 | 57.9 | 86.6 |
| 44 | M | CD | 13 | 1.15 | 1.1464 | 59.8 | 88.4 |
| 44 | M | MD | 13 | 1.30 | 1.3260 | 64.0 | 97.1 |
| 44 | G | CD | 13 | 1.30 | 1.1682 | 70.5 | 99.7 |
| 44 | G | MD | 13 | 1.30 | 1.5370 | 73.2 | 111.6 |
| 44 | M | CD | 13 | 1.30 | 1.9913 | 72.6 | 122.4 |
| 36 | M | MD | 24 | 1.15 | 0.5189 | 78.4 | 91.4 |
| 44 | M | MD | 24 | 1.15 | 0.6246 | 78.2 | 93.8 |
| 44 | G | CD | 24 | 1.15 | 0.6324 | 83.3 | 99.2 |
| 44 | G | MD | 24 | 1.15 | 0.9689 | 78.9 | 103.1 |
| 44 | M | CD | 24 | 1.15 | 0.6295 | 88.1 | 103.8 |
| 36 | M | CD | 24 | 1.15 | 0.8385 | 86.7 | 107.7 |

TABLE 9-continued

| Caliper Change With Vacuum | | | | | | | |
|---|---|---|---|---|---|---|---|
| Fabric Ct | Fabric Type | Fabric Orientation | Basis Weight | Fabric Crepe Ratio | Slope | Intercept | Caliper @ 25 in Hg |
| 44 | M | MD | 24 | 1.30 | 0.6771 | 90.2 | 107.1 |
| 36 | M | MD | 24 | 1.30 | 0.8260 | 86.6 | 107.2 |
| 44 | G | CD | 24 | 1.30 | 0.5974 | 93.5 | 108.4 |
| 44 | G | MD | 24 | 1.30 | 1.1069 | 92.7 | 120.4 |
| 44 | M | CD | 24 | 1.30 | 0.9261 | 97.6 | 120.7 |
| 36 | M | CD | 24 | 1.30 | 0.9942 | 96.7 | 121.6 |

TABLE 10

| Void Volume Change With Vacuum | | | | | | | |
|---|---|---|---|---|---|---|---|
| Fabric Ct | Fabric Type | Fabric Orientation | Basis Weight | Fabric Crepe Ratio | Slope | Intercept | VV @ 25 in Hg |
| 44 | G | CD | 13 | 1.15 | 0.0237 | 6.3 | 6.9 |
| 44 | M | CD | 13 | 1.15 | 0.0617 | 6.0 | 7.5 |
| 44 | M | MD | 13 | 1.15 | 0.0653 | 6.0 | 7.6 |
| 44 | G | MD | 13 | 1.30 | 0.0431 | 7.0 | 8.1 |
| 44 | G | CD | 13 | 1.30 | 0.0194 | 7.7 | 8.2 |
| 44 | M | MD | 13 | 1.30 | 0.0589 | 7.0 | 8.4 |
| 44 | M | CD | 13 | 1.30 | 0.1191 | 7.1 | 10.1 |
| 44 | G | CD | 24 | 1.15 | −0.0040 | 6.1 | 6.0 |
| 44 | M | MD | 24 | 1.15 | 0.0204 | 6.0 | 6.5 |
| 44 | G | MD | 24 | 1.15 | 0.0212 | 6.0 | 6.5 |
| 44 | G | CD | 24 | 1.15 | 0.0269 | 5.9 | 6.6 |
| 36 | M | MD | 24 | 1.15 | 0.0456 | 5.8 | 7.0 |
| 36 | M | CD | 24 | 1.15 | 0.0539 | 5.9 | 7.3 |
| 44 | M | CD | 24 | 1.30 | 0.0187 | 6.3 | 6.8 |
| 44 | G | MD | 24 | 1.30 | 0.0140 | 6.6 | 6.9 |
| 44 | M | MD | 24 | 1.30 | 0.0177 | 6.5 | 6.9 |
| 36 | M | CD | 24 | 1.30 | 0.0465 | 6.1 | 7.2 |
| 44 | G | CD | 24 | 1.30 | 0.0309 | 6.5 | 7.3 |
| 36 | M | MD | 24 | 1.30 | 0.0516 | 6.1 | 7.4 |

TABLE 11

| CD Stretch Change With Vacuum | | | | | | | |
|---|---|---|---|---|---|---|---|
| Fabric Ct | Fabric Type | Fabric Orientation | Basis Weight | Fabric Crepe Ratio | Slope | Intercept | Stretch @ 25 in Hg |
| 44 | M | MD | 13 | 1.15 | 0.0582 | 4.147 | 5.6 |
| 44 | G | CD | 13 | 1.15 | 0.0836 | 4.278 | 6.4 |
| 44 | G | CD | 13 | 1.30 | 0.0689 | 6.747 | 8.5 |
| 44 | M | MD | 13 | 1.30 | 0.1289 | 6.729 | 10.0 |
| 44 | G | MD | 13 | 1.30 | 0.0769 | 8.583 | 10.5 |
| 36 | M | MD | 24 | 1.15 | 0.0279 | 4.179 | 4.9 |
| 44 | M | MD | 24 | 1.15 | 0.0387 | 4.526 | 5.5 |
| 44 | G | MD | 24 | 1.15 | 0.0534 | 4.265 | 5.6 |
| 36 | M | MD | 24 | 1.30 | 0.0634 | 5.589 | 7.2 |
| 44 | G | MD | 24 | 1.30 | 0.0498 | 6.602 | 7.8 |
| 44 | M | MD | 24 | 1.30 | 0.0596 | 6.893 | 8.4 |

TABLE 12

| TMI Friction Data | | | |
|---|---|---|---|
| Fabric | Stretch (%) | TMI Friction Top (Unitless) | TMI Friction Bottom (Unitless) |
| Yankee-Dried | 0 | 0.885 | 1.715 |
| | 0 | 1.022 | 1.261 |
| | 15 | 0.879 | 1.444 |
| | 15 | 0.840 | 1.235 |
| | 25 | 1.237 | 1.358 |
| | 25 | 0.845 | 1.063 |
| | 30 | 1.216 | 1.306 |
| | 30 | 0.800 | 0.844 |
| | 35 | 1.221 | 1.444 |
| | 35 | 0.871 | 1.107 |
| | 40 | 0.811 | 0.937 |
| | 40 | 1.086 | 1.100 |
| Can-Dried | 0 | 0.615 | 3.651 |
| | 0 | 0.689 | 1.774 |
| | 20 | 0.859 | 2.100 |
| | 20 | 0.715 | 2.144 |
| | 40 | 0.607 | 2.587 |
| | 40 | 0.748 | 2.439 |
| | 45 | 0.757 | 3.566 |
| | 45 | 0.887 | 2.490 |
| | 50 | 0.724 | 2.034 |
| | 50 | 0.929 | 2.188 |
| | 55 | 0.947 | 1.961 |
| | 55 | 1.213 | 1.631 |
| | 60 | 0.514 | 2.685 |
| | 60 | 0.655 | 2.102 |

Figure 31:
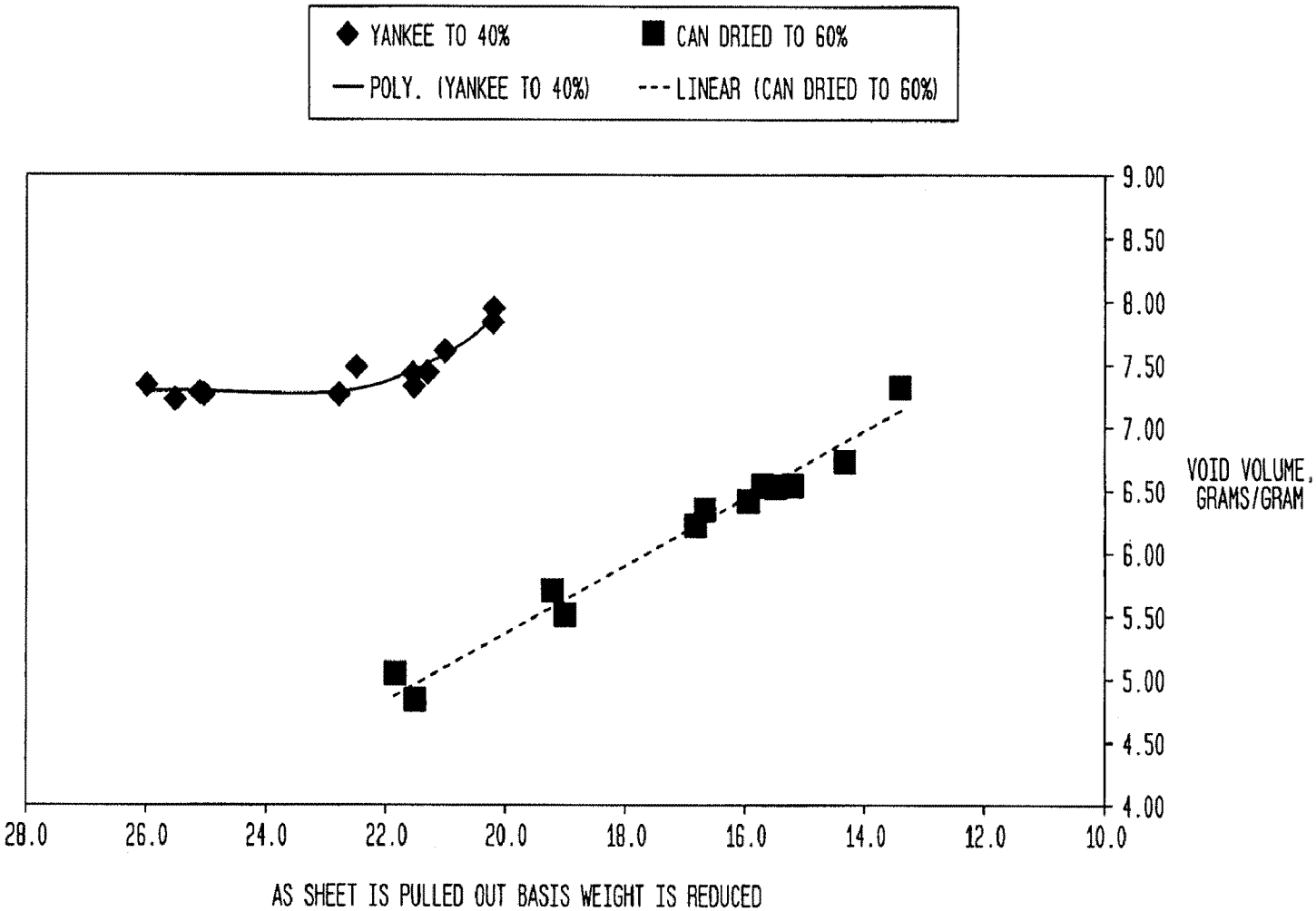
FIG. 31 is a plot of void volume versus basis weight as webs are drawn.

It is seen in FIG. 31 that the can-dried materials exhibit more void volume gain as the basis weight is reduced when the sheet was drawn. Moreover, the Yankee-dried and blade-creped material did not exhibit any significant void volume gain until relatively large elongation.

Figure 32:
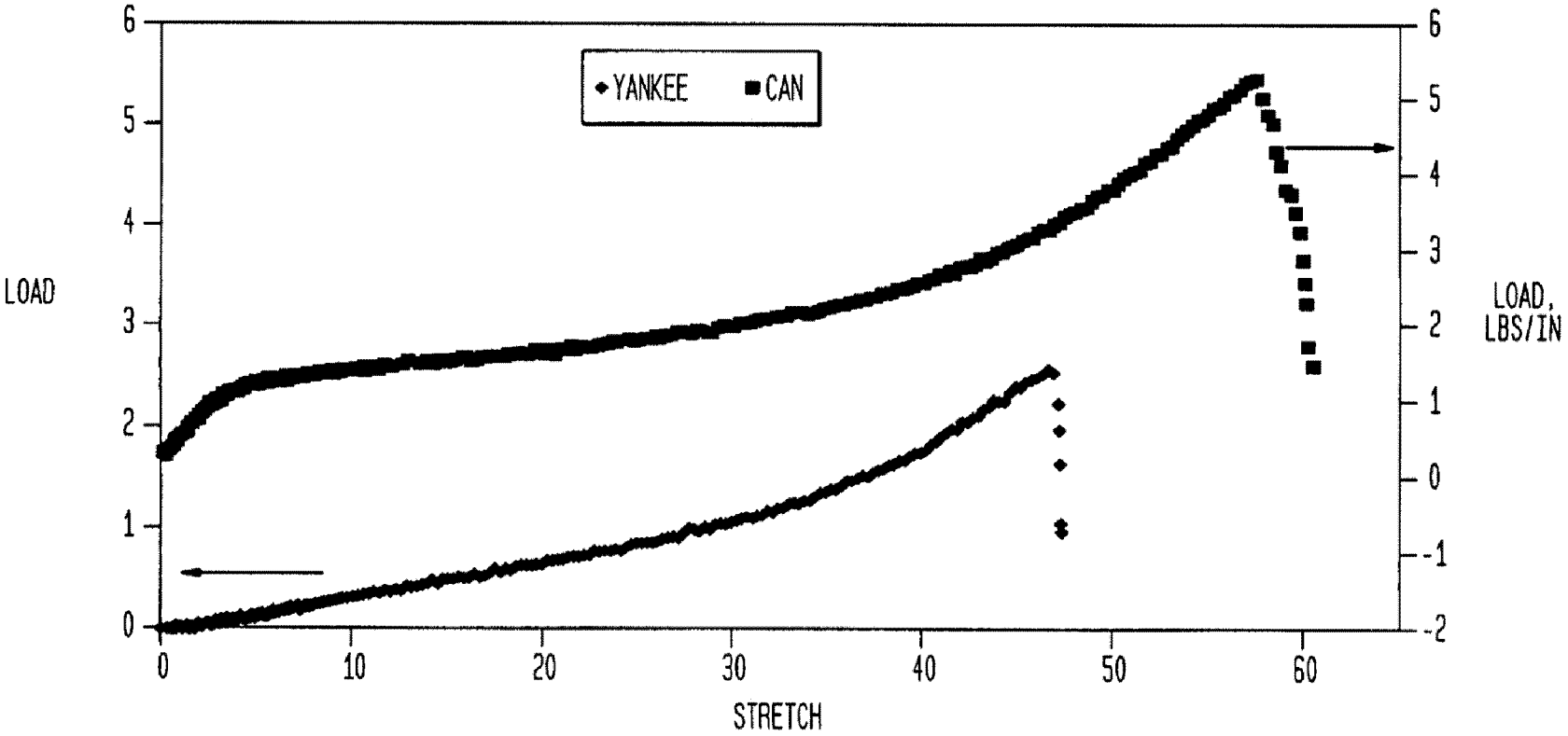
FIG. 32 is a diagram showing the machine direction modulus of webs of the invention wherein the abscissa have been shifted for purposes of clarity.
Figure 33:
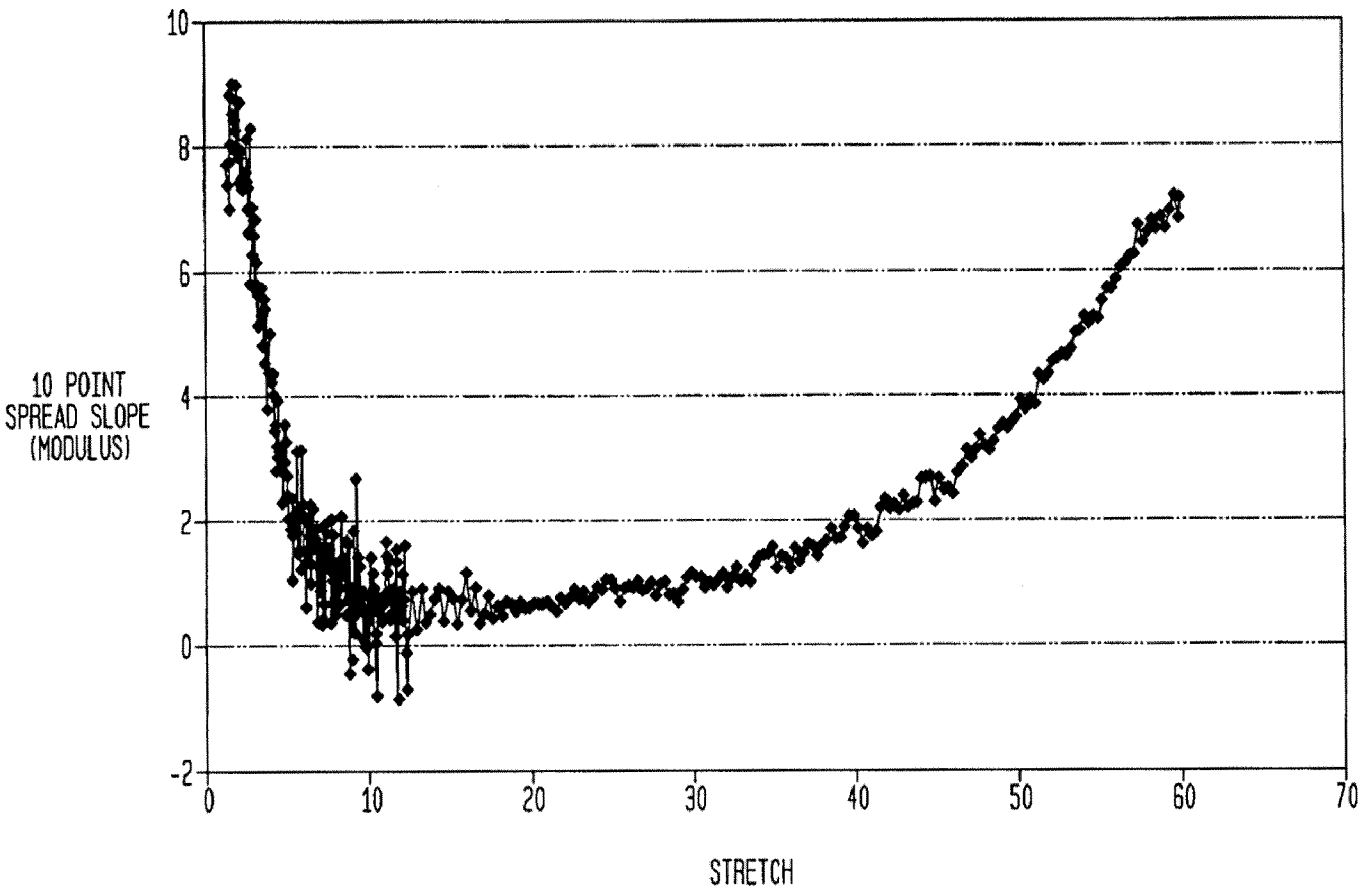
FIG. 33 is a plot of machine direction modulus versus percent stretch for products of the present invention.

In Table 6 and Table 7, as well as FIGS. 32 and 33, it is seen that can-dried material and Yankee-dried material exhibit similar stress/strain behavior; however, the can-dried material has a higher initial modulus, which may be beneficial to runnability. Modulus is calculated by dividing the incremental stress (per inch of sample width) in lbs by the additional elongation observed. Nominally, the quantity has units lbs/in$^2$.

Figure 34:
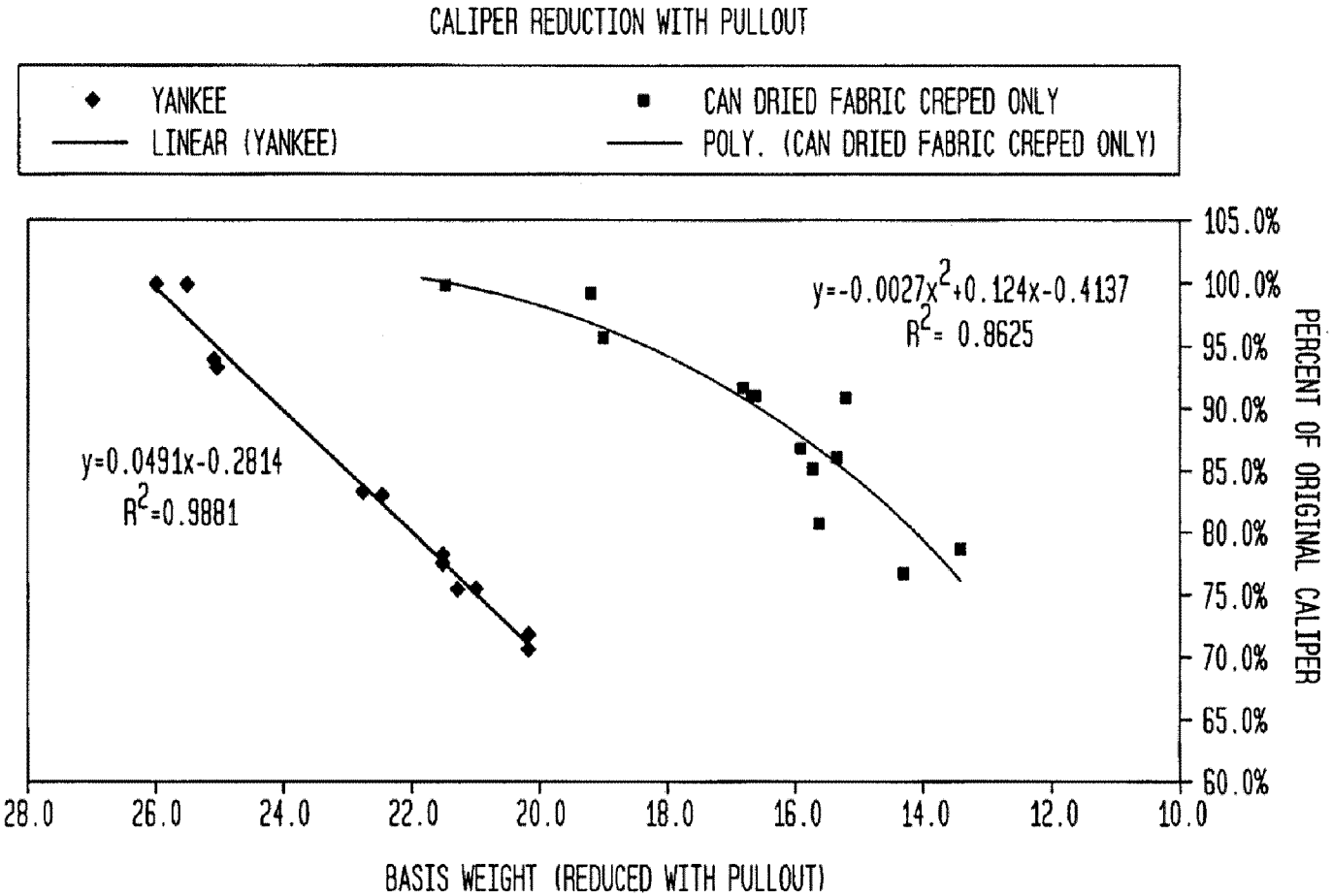
FIG. 34 is a plot of caliper change versus basis weight change for various products of the invention.

FIG. 34 is a plot of caliper versus basis weight as the product is drawn. The Yankee-dried, aggressively creped web exhibited approximately 1:1 loss of caliper with basis weight (i.e., approximately constant bulk), whereas the can-dried web lost much more basis weight than caliper. This result is consistent with the data set of Examples 1-8, and with the void volume data. The ratio of percent decrease in basis weight may be calculated and compared for the different processes. The Yankee-dried material has an undrawn basis weight of about 26 lbs and a caliper loss of about 28% when drawn to a basis weight of about 20.5; that is, the material has only about 72% of its original caliper. The basis weight loss is about 5.5/26 or 21%; thus, the ratio of percent decrease in caliper/percent decrease in basis weight is approximately 28/21 or 1.3. It is seen in FIG. 34 that the can-dried material loses caliper much more slowly with basis weight reduction as the material is drawn. As the can-dried sheet is drawn from a basis weight of about 22 lbs to about 14 lbs, only about 20% of the caliper is lost; and the ratio of % decrease in caliper/percent decrease in basis weight is about 20/36 or 0.55.

Figure 35:
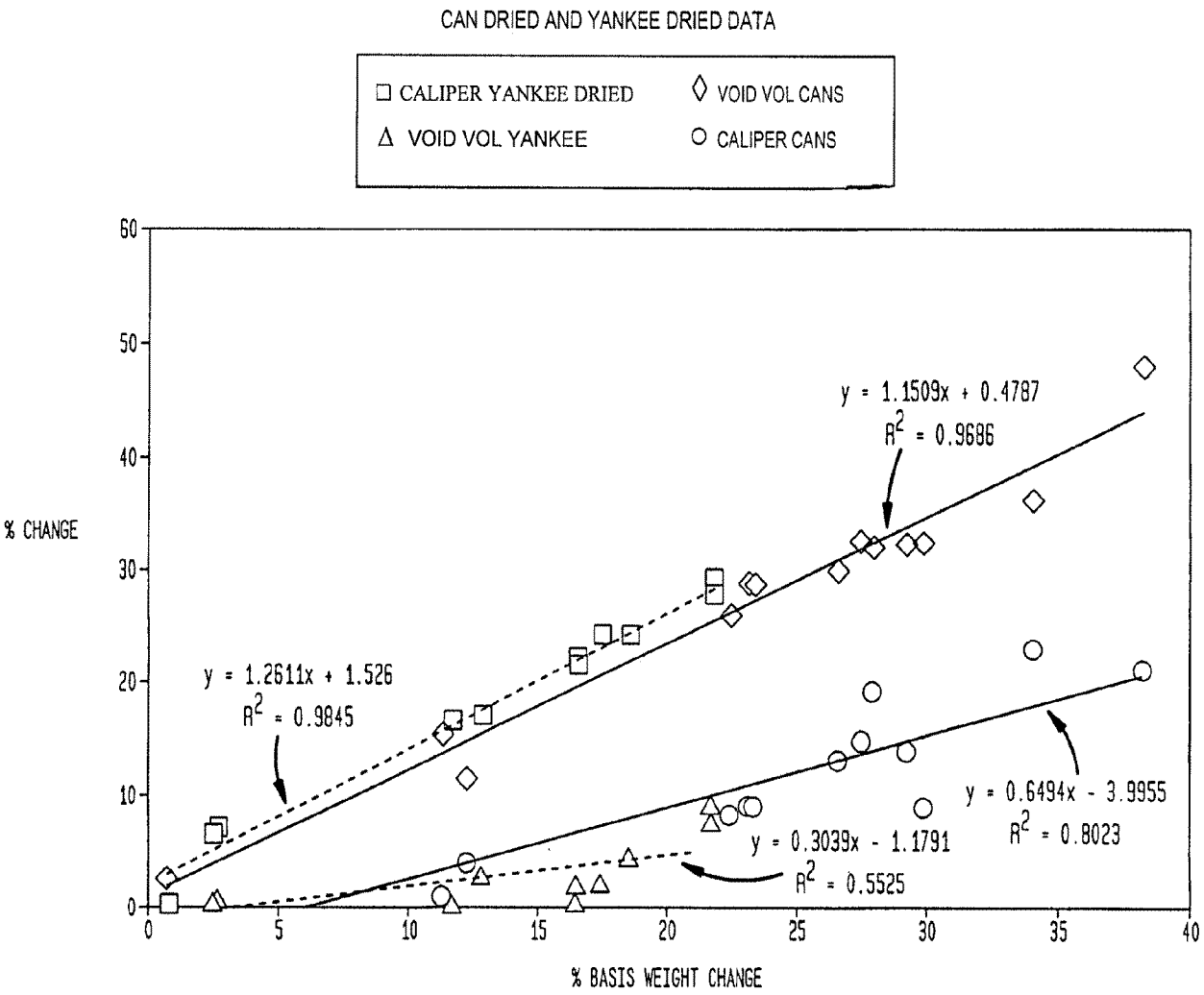
FIG. 35 is a plot of caliper versus applied vacuum for fabric-creped webs.

Results for Yankee-dried and can-dried material upon drawing is summarized graphically in FIG. 35. It is again seen here that the caliper of the can-dried material changes less than that of the Yankee-dried material as the basis weight is reduced. Moreover, large changes in void volume are observed when the can-dried material is drawn.

Figure 36:
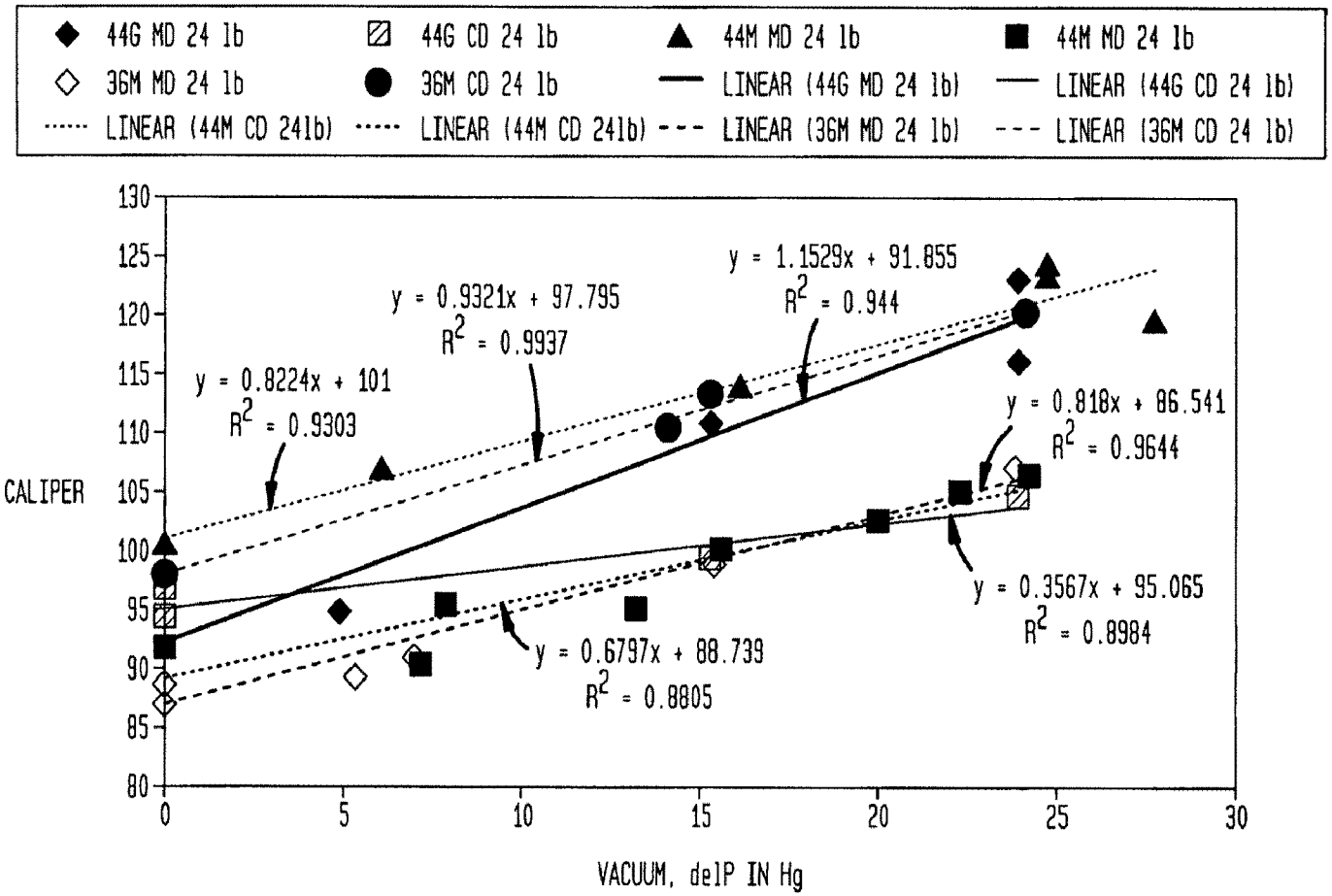
FIG. 36 is a plot of caliper versus applied vacuum for fabric-creped webs and various creping fabrics.
Figure 37:
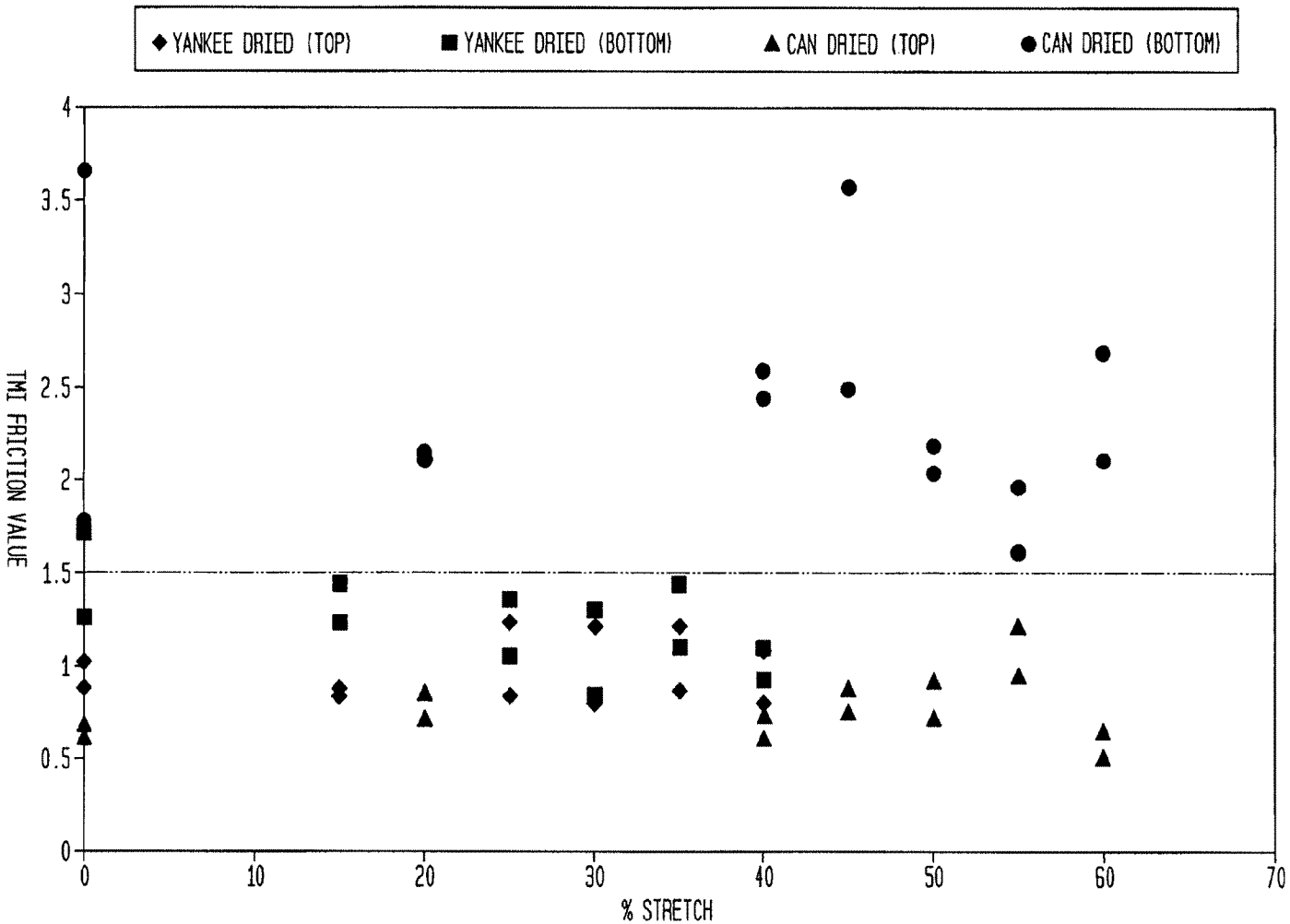
FIG. 37 is a plot of TMI Friction values versus draw for various webs of the invention.

In FIG. 36, it is seen that caliper is influenced by selection of vacuum and creping fabric; while Table 12 and FIG. 37 show that the in-fabric can-dried material exhibited much higher TMI Friction values. In general, friction values decrease as the material is drawn. It will be appreciated from the data in Table 12 and FIG. 37 that even though samples were run only in the MD, that as the samples were drawn, the friction values on either side of the sheet converge; for example, the can-dried samples had average values of 2.7/0.65 fabric side/can side prior to drawing and average values of 1.8/1.1 at 55% draw.

Figure 38:
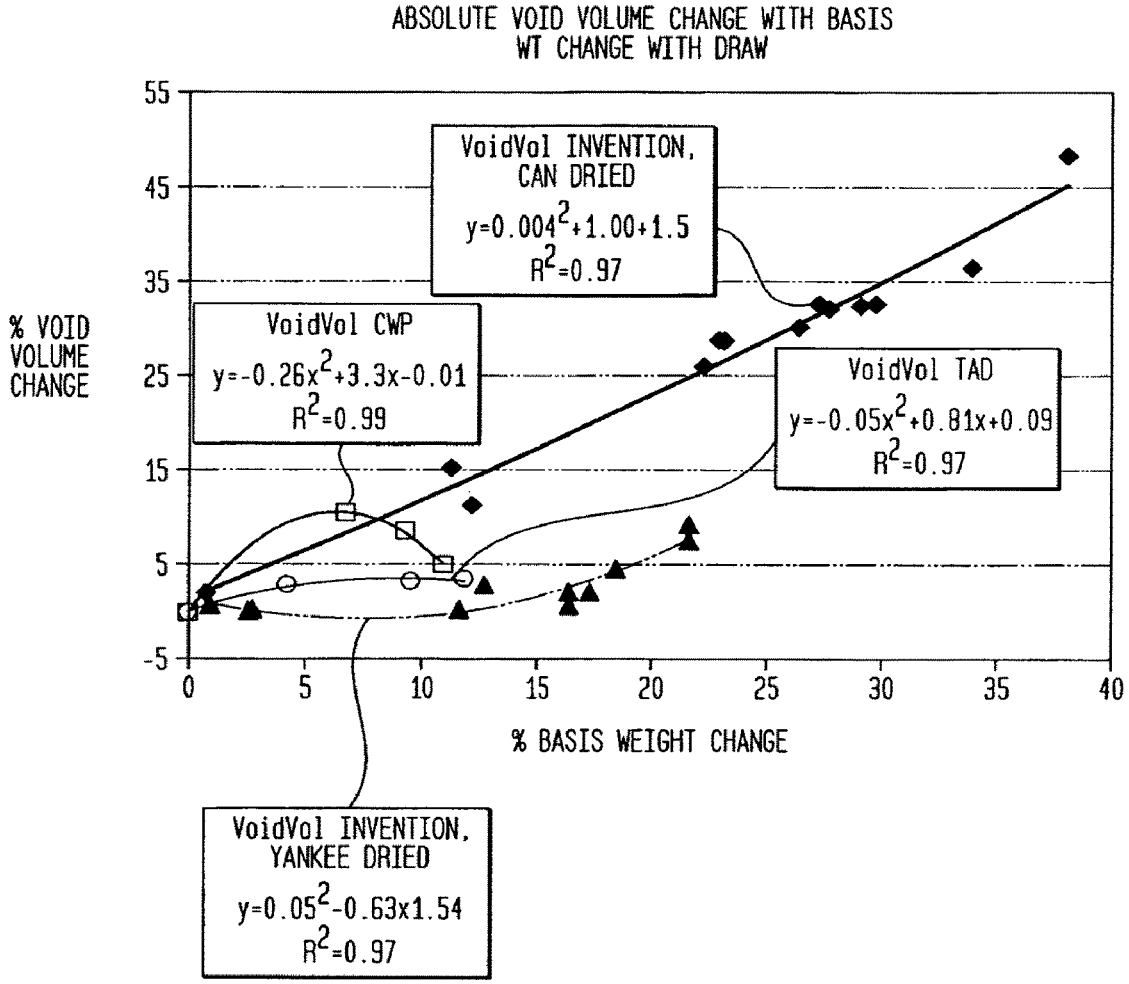
FIG. 38 is a plot of void volume change versus basis weight change for various products.

Differences between products of the invention and conventional products are particularly appreciated by reference to Table 4 and FIG. 38. It is seen that conventional through dried (TAD) products do not exhibit substantial increases in void volume (<5%) upon drawing, and that the increase in void volume is not progressive beyond 7% draw; that is, the void volume does not increase significantly (less than 1%) as the web is drawn beyond 10%. The conventional wet press (CWP) towel tested exhibited a modest increase in void volume when drawn to 10% elongation; however, the void volume decreased at more elongation, again not progressively increasing. The products of the present invention exhibited large, progressive increases in void volume as they are drawn. Void volume increases of 20%, 30%, 40% and more are readily achieved.

Figure 39:
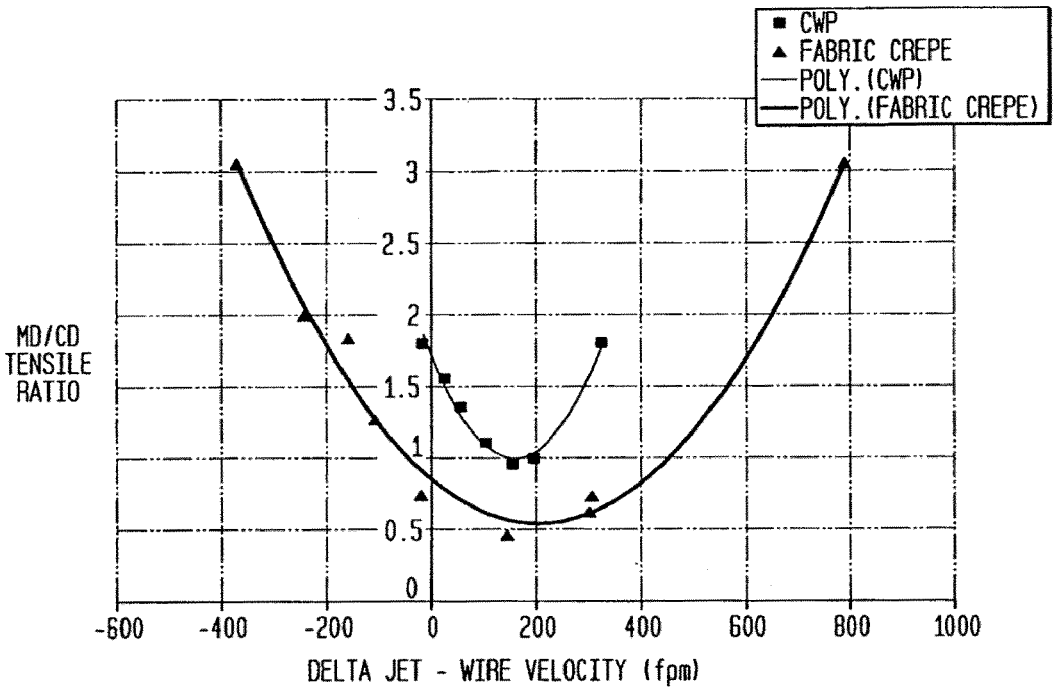
FIG. 39 is a diagram showing representative curves of MD/CD tensile ratio versus jet to wire velocity delta for the products of the invention, and conventional wet press (CWP) absorbent sheet.

Further differences between the inventive processes and products and conventional products and processes are seen in FIG. 39. FIG. 39 is a plot of MD/CD tensile ratio (strength at break) versus the difference between headbox jet velocity and forming wire speed (fpm). The upper U-shaped curve is typical of conventional wet-press absorbent sheet. The lower, broader curve is typical of fabric-creped products of the invention over a wide range of jet to wire velocity deltas, a range that is more than twice that of the CWP curve shown. Thus, control of the headbox jet/forming wire velocity delta may be used to achieve desired sheet properties.

It is also seen from FIG. 39 that MD/CD ratios below square (i.e., below 1) are difficult, if not impossible, to obtain with conventional processing. Furthermore, square or below sheets are formed by way of the invention without excessive fiber aggregates or "flocs," which is not the case with the CWP products having low MD/CD tensile ratios. This difference is due, in part, to the relatively low velocity deltas required to achieve low tensile ratios in CWP products, and may be due in part to the fact that fiber is redistributed on the creping fabric when the web is creped from the transfer surface in accordance with the invention. Surprisingly, square products of the invention resist propagation of tears in the CD and exhibit a tendency to self-healing. This is a major processing advantage, since the web, even though square, exhibits reduced tendency to break easily when being wound.

In many products, the cross machine properties are more important than the MD properties, particularly, in commercial toweling where CD wet strength is critical. A major source of product failure is "tabbing" or tearing off only a piece of towel rather than the entirety of the intended sheet. In accordance with the invention, CD tensiles may be selectively elevated by control of the headbox to forming wire velocity delta and fabric creping.

While the invention has been described in connection with several examples, modifications to those examples within the spirit and scope of the invention will be readily apparent to those of skill in the art. In view of the foregoing discussion, relevant knowledge in the art and references including copending applications discussed above in connection with the Background and Detailed Description, the disclosures of which are all incorporated herein by reference, further description is deemed unnecessary.

We claim:

1. A method of making a fabric-creped absorbent cellulosic sheet, the method comprising:

(a) compactively dewatering a papermaking furnish to form a nascent web having a random distribution of papermaking fiber;

(b) applying the nascent web having the random fiber distribution to a translating transfer surface that is moving at a transfer surface speed;

(c) fabric-creping the nascent web from the transfer surface at a consistency of from about 30 percent to about 60 percent utilizing a patterned creping fabric that is traveling at a fabric-creping speed, the fabric-creping speed being lower than the transfer surface speed, the fabric-creping step occurring under pressure in a fabric creping nip defined between the transfer surface and the creping fabric, such that the nascent web is creped from the transfer surface and redistributed on the creping fabric to form a creped web with a drawable reticulum having a plurality of interconnected regions of different local basis weights, including at least (i) a plurality of fiber enriched regions having a high local basis weight, interconnected by way of (ii) a plurality of lower local basis weight linking regions;

(d) applying the creped web to a drying cylinder;

(e) drying the creped web on the drying cylinder to form a dried web;

(f) peeling the dried web from the drying cylinder;

(g) controlling the takeaway angle of the dried web from the drying cylinder, wherein steps (d), (e), (f) and (g) are performed so as to substantially preserve the drawable reticulum; and (h) drawing the dried web between a first draw roll and a second draw roll, the first draw roll moving at a first machine-direction velocity that is eater than the fabric-creping speed.

2. The method according to claim 1, wherein the step of controlling the takeaway angle from the drying cylinder is carried out utilizing a sheet control cylinder.

3. The method according to claim 2, wherein the sheet control cylinder is disposed adjacent to the drying cylinder such that the gap between the surface of the drying cylinder and the surface of the sheet control cylinder is less than about twice the thickness of the dried web.

4. The method according to claim 3, wherein the sheet control cylinder is disposed adjacent to the drying cylinder such that the gap between the surface of the drying cylinder and the surface of the sheet control cylinder is at most about the thickness of the dried web.

5. The method according to claim 1, wherein the drawing step comprises drawing the dried web on-line after the web is peeled from the drying cylinder in the peeling step.

6. The method according to claim 5, wherein the drawing step includes drawing the dried web by at least about 10%.

7. The method according to claim 5, wherein the drawing step includes drawing the dried web by at least about 15%.

8. The method according to claim 5, wherein the drawing step includes drawing the dried web by at least about 30%.

9. The method according to claim 5, wherein the drawing step includes drawing the dried web by at least about 45%.

10. The method according to claim 5, wherein the drawing step includes drawing the dried web by at least about 75%.

11. The method according to claim 1, wherein the drawing step imparts an increase in void volume to the dried web.

12. The method according to claim 1, wherein the drawing step results in a ratio of percent decrease in caliper to percent decrease in basis weight of the dried web being less than 0.85.

13. The method according to claim 1, wherein the drawing step results in a ratio of percent decrease in caliper to percent decrease in basis weight of the dried web being less than 0.7.

14. The method according to claim 1, wherein the drawing step results in a ratio of percent decrease in caliper to percent decrease in basis weight of the dried web being less than 0.6.

15. The method according to claim 1, wherein the second draw roll is moving at a second machine-direction velocity that is greater than the first machine-direction velocity.

16. The method according to claim 1, wherein the dried web wraps over the first draw roll by more than one hundred eighty degrees of the circumference of the first draw roll.

17. The method according to claim 16, wherein the dried web wraps over the second draw roll by more than one hundred eighty degrees of the circumference of the second draw roll.

18. The method according to claim 1, wherein the dried web wraps over each of the first and second draw rolls from about two hundred degrees to about three hundred degrees of the respective circumferences of the first and second draw rolls.

19. The method according to claim 1, wherein the first and second draw rolls are movable with respect to each other.

20. The method according to claim 1, further comprising applying a vacuum of at least five inches of mercury to the creped web after the fabric-creping step.

21. The method according to claim 1, wherein the fabric-creping step occurs under a pressure of at least 20 pounds per linear inch.

22. The method according to claim 1, wherein the fabric-creping step occurs under a pressure of from about 20 to about 200 pounds per linear inch.

23. The method according to claim 1, wherein the fabric-creping step occurs under a pressure of from about 40 to about 70 pounds per linear inch.

24. A method of making a fabric-creped absorbent cellulosic sheet, the method comprising:

(a) compactively dewatering a papermaking furnish to form a nascent web having a random distribution of papermaking fiber;

(b) applying the nascent web having the random fiber distribution to a translating transfer surface that is moving at a transfer surface speed;

(c) fabric-creping the nascent web from the transfer surface at a consistency of from about 30 percent to about 60 percent utilizing a patterned creping fabric that is traveling at a fabric-creping speed, the fabric-creping speed being lower than the transfer surface speed, the fabric-creping step occurring under pressure in a fabric creping nip defined between the transfer surface and the creping fabric, such that the fibers of the nascent web are redistributed on the creping fabric to form a creped web with a drawable reticulum having a plurality of interconnected regions of different local basis weights, including at least (i) a plurality of fiber enriched regions having a high local basis weight, interconnected by way of (ii) a plurality of lower local basis weight linking regions;

(d) adhering the creped web to a drying cylinder with a resinous adhesive coating composition;

(e) drying the creped web on the drying cylinder to form a dried web;

(f) removing the dried web from the drying cylinder, wherein steps (d), (e) and (f) are performed so as to substantially preserve the drawable reticulum; and (g) drawing the dried web between a first draw roll and a second draw roll, the first draw roll moving at a first machine-direction velocity that is greater than the fabric-creping speed.

25. The method according to claim 24, wherein the removing step comprises removing the dried web from the drying cylinder without substantial creping.

26. The method according to claim 24, wherein the removing step comprises removing the dried web from the drying cylinder subsequent to startup, without a creping blade.

27. The method according to claim 24, wherein the removing step comprises peeling the dried web from the drying cylinder while a sheet control cylinder controls the takeaway angle of the web.

28. The method according to claim 24, wherein the resinous adhesive coating composition is a resinous protective coating layer.

29. The method according to claim 28, wherein the resinous protective coating layer comprises a polyamide resin.

30. The method according to claim 29, wherein the polyamide resin is cross-linked.

31. The method according to claim 24, wherein the resinous adhesive coating composition is re-wettable.

32. The method according to claim 24, further comprising a step of maintaining the resinous adhesive coating composition on the drying cylinder such that the composition provides a sufficient wet tack strength upon transfer of the creped web to the drying cylinder to secure the creped web thereto during drying, and wherein the resinous adhesive coating composition is maintained pliant during drying such that the dried web may be removed from the drying cylinder without a creping blade.

33. The method according to claim 24, wherein the resinous adhesive coating composition comprises a polyvinyl alcohol resin.

34. The method according to claim 33, wherein the resinous adhesive coating composition includes at least one resin in addition to the polyvinyl alcohol resin.

35. The method according to claim 24, wherein the resinous adhesive coating composition comprises a polysaccharide resin.

36. The method according to claim 24, wherein the fabric-creping step occurs under a pressure of at least 20 pounds per linear inch.

37. The method according to claim 24, wherein the fabric-creping step occurs under a pressure of from about 20 to about 200 pounds per linear inch.

38. The method according to claim 24, wherein the fabric-creping step occurs under a pressure of from about 40 to about 70 pounds per linear inch.

39. The method according to claim 24, wherein the second draw roll is moving at a second machine-direction velocity that is greater than the first machine-direction velocity.

40. A method of making a fabric-creped absorbent cellulosic sheet, the method comprising:

(a) compactively dewatering a papermaking furnish to form a nascent web having a random distribution of papermaking fiber;

(b) applying the nascent web having the random fiber distribution to a translating transfer surface that is moving at a transfer surface speed;

(c) fabric-creping the nascent web from the transfer surface at a consistency of from about 30 percent to about 60 percent utilizing a patterned creping fabric that is traveling at a fabric-creping speed, the fabric-creping speed being lower than the transfer surface speed, the fabric-creping step occurring under pressure in a fabric creping nip defined between the transfer surface and the creping fabric, such that the fibers of the nascent web are redistributed on the creping fabric to form a creped web with a drawable reticulum having a plurality of interconnected regions of different local basis weights, including at least (i) a plurality of fiber enriched regions having a high local basis weight, interconnected by way of (ii) a plurality of lower local basis weight linking regions;

(d) applying the creped web to a drying cylinder;

(e) embossing the creped web while the web is disposed on the drying cylinder;

(f) drying the creped web on the drying cylinder to form a dried web;

(g) removing the dried web from the drying cylinder, wherein steps (d), (e), (f) and (g) are performed so as to substantially preserve the drawable reticulum; and (h) drawing the dried web between a first draw roll and a second draw roll, the first draw roll moving at a first machine-direction velocity that is greater than the fabric-creping speed.

41. The method according to claim 40, wherein the embossing step comprises embossing the creped web when the consistency of the creped web is less than about 80%.

42. The method according to claim 40, wherein the embossing step comprises embossing the creped web when the consistency of the creped web is less than about 70%.

43. The method according to claim 40, wherein the embossing step comprises embossing the creped web when the consistency of the creped web is less than about 50%.

44. The method according to claim 40, wherein the drying cylinder is traveling at a drying cylinder speed and the step of embossing the creped web while the creped web is disposed on the drying cylinder is carried out with an embossing surface that is traveling at a machine direction speed that is lower than the drying cylinder speed.

45. The method according to claim 40, wherein the fabric-creping step occurs under a pressure of at least 20 pounds per linear inch.

46. The method according to claim 40, wherein the fabric-creping step occurs under a pressure of from about 20 to about 200 pounds per linear inch.

47. The method according to claim 40, wherein the fabric-creping step occurs under a pressure of from about 40 to about 70 pounds per linear inch.

48. The method according to claim 40, wherein the second draw roll is moving at a second machine-direction velocity that is greater than the first machine-direction velocity.

* * * * *